US008811765B2

(12) United States Patent
Gohshi

(10) Patent No.: US 8,811,765 B2
(45) **Date of Patent: *Aug. 19, 2014**

(54) ENCODING DEVICE CONFIGURED TO GENERATE A FREQUENCY COMPONENT EXTRACTION SIGNAL, CONTROL METHOD FOR AN ENCODING DEVICE USING THE FREQUENCY COMPONENT EXTRACTION SIGNAL, TRANSMISSION SYSTEM, AND COMPUTER-READABLE RECORDING MEDIUM HAVING A CONTROL PROGRAM RECORDED THEREON

(75) Inventor: Seiichi Gohshi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 94 days.

This patent is subject to a terminal disclaimer.

(21) Appl. No.: 13/504,796

(22) PCT Filed: Jun. 23, 2010

(86) PCT No.: PCT/JP2010/060681

§ 371 (c)(1),
(2), (4) Date: Apr. 27, 2012

(87) PCT Pub. No.: WO2011/061957

PCT Pub. Date: May 26, 2011

(65) Prior Publication Data

US 2012/0207226 A1 Aug. 16, 2012

(30) Foreign Application Priority Data

Nov. 17, 2009 (JP) ..... 2009-262341

(51) Int. Cl.
*G06K 9/40* (2006.01)

(52) U.S. Cl.
USPC ..... 382/263

(58) Field of Classification Search
None
See application file for complete search history.

(56) References Cited

U.S. PATENT DOCUMENTS 5,063,445 A 11/1991 Nishizawa et al.
5,089,889 A * 2/1992 Sugiyama ..... 375/240.12

(Continued)

FOREIGN PATENT DOCUMENTS

EP 2 026 560 2/2009
EP 2 124 430 11/2009

(Continued)

OTHER PUBLICATIONS

Matsumoto Nobuyuki and Ida Takashi, "A study on One Frame Reconstruction-based Super-resolution Using Image Segmentation", IEICE technical report, The Institute of Electronics, Information and Communication Engineers (IEICE), vol. 108(4), IE2008-6, pp. 31-36, Apr. 2008.

(Continued)

*Primary Examiner* — Bhavesh Mehta
*Assistant Examiner* — Feng Niu
(74) *Attorney, Agent, or Firm* — Harness, Dickey & Pierce, P.L.C.

(57) ABSTRACT

Disclosed is an encoding device, which is an encoding device that outputs an encoded signal including a signal in which an original signal is encoded, the original signal indicative of at least one of image and audio, which encoding device includes a frequency component extraction section that extracts a part of frequency components of the original signal from the original signal to generate a frequency component extraction signal and an encoding process section that encodes the frequency component extraction signal and the original signal while switching between the frequency component extraction signal and the original signal, and making the signal thus encoded be included in the encoded signal.

16 Claims, 24 Drawing Sheets

(56) References Cited

U.S. PATENT DOCUMENTS

| | | | | |
|---|---|---|---|---|
| 5,144,426 | A * | 9/1992 | Tanaka et al. | 375/240.13 |
| 5,150,432 | A | 9/1992 | Ueno et al. | |
| 5,321,511 | A | 6/1994 | Min | |
| 5,459,514 | A | 10/1995 | Sakamoto et al. | |
| 5,495,292 | A | 2/1996 | Zhang et al. | |
| 5,606,375 | A | 2/1997 | Lee | |
| 5,694,491 | A | 12/1997 | Brill et al. | |
| 5,708,693 | A | 1/1998 | Aach et al. | |
| 5,719,966 | A | 2/1998 | Brill et al. | |
| 5,805,721 | A | 9/1998 | Vuylsteke et al. | |
| 6,115,071 | A | 9/2000 | Hurst, Jr. et al. | |
| 6,173,084 | B1 | 1/2001 | Aach et al. | |
| 6,285,710 | B1 | 9/2001 | Hurst, Jr. et al. | |
| 6,295,322 | B1 | 9/2001 | Arbeiter et al. | |
| 6,377,313 | B1 | 4/2002 | Yang et al. | |
| 6,466,625 | B1 | 10/2002 | Kobayashi et al. | |
| 6,606,419 | B2 | 8/2003 | Nakaya | |
| 6,658,379 | B1 | 12/2003 | Ogata | |
| 6,732,070 | B1 | 5/2004 | Rotola-Pukkila et al. | |
| 6,791,716 | B1 | 9/2004 | Buhr et al. | |
| 6,973,127 | B1 | 12/2005 | Kolesnik et al. | |
| 7,590,589 | B2 | 9/2009 | Hoffberg | |
| 7,633,354 | B2 | 12/2009 | Kuijk et al. | |
| 7,970,212 | B2 | 6/2011 | Zahavi et al. | |
| 8,204,332 | B2 | 6/2012 | Sun | |
| 8,427,256 | B2 | 4/2013 | Gohshi | |
| 8,508,667 | B2 | 8/2013 | Goshi | |
| 2002/0090207 | A1 * | 7/2002 | Mishima et al. | 386/111 |
| 2002/0181583 | A1 | 12/2002 | Corbera | |
| 2003/0151684 | A1 | 8/2003 | Shimazaki et al. | |
| 2003/0210829 | A1 | 11/2003 | Someya et al. | |
| 2003/0218776 | A1 | 11/2003 | Morimoto et al. | |
| 2004/0049376 | A1 | 3/2004 | Sperschneider et al. | |
| 2004/0252907 | A1 | 12/2004 | Ito | |
| 2005/0008251 | A1 | 1/2005 | Chiang | |
| 2005/0091051 | A1 | 4/2005 | Moriya et al. | |
| 2005/0123214 | A1 | 6/2005 | Takahira | |
| 2006/0239361 | A1 | 10/2006 | Iguchi et al. | |
| 2006/0285766 | A1 | 12/2006 | Ali | |
| 2006/0285767 | A1 | 12/2006 | Ali | |
| 2007/0019114 | A1 | 1/2007 | De Garrido et al. | |
| 2007/0140387 | A1 | 6/2007 | Wong et al. | |
| 2007/0147478 | A1 | 6/2007 | Lai et al. | |
| 2007/0160301 | A1 | 7/2007 | Wang et al. | |
| 2007/0269137 | A1 | 11/2007 | Ida et al. | |
| 2007/0296614 | A1 | 12/2007 | Lee et al. | |
| 2008/0050032 | A1 | 2/2008 | Okuno et al. | |
| 2008/0199101 | A1 | 8/2008 | Sumiya et al. | |
| 2009/0060373 | A1 | 3/2009 | Perera et al. | |
| 2010/0119176 | A1 | 5/2010 | Ichihashi et al. | |
| 2010/0214433 | A1 | 8/2010 | Takahashi | |
| 2011/0279730 | A1 | 11/2011 | Goshi | |
| 2012/0070098 | A1 | 3/2012 | Gohshi | |
| 2012/0081198 | A1 | 4/2012 | Gohshi | |
| 2012/0213289 | A1 | 8/2012 | Gohshi | |
| 2012/0314968 | A1 | 12/2012 | Gohshi | |
| 2013/0176495 | A1 | 7/2013 | Gohshi | |

FOREIGN PATENT DOCUMENTS

| | | | |
|---|---|---|---|
| GB | 2 203 013 | | 10/1988 |
| JP | 4-219089 | A | 8/1992 |
| JP | 07-184085 | | 7/1995 |
| JP | 07-312704 | | 11/1995 |
| JP | 08-139969 | | 5/1996 |
| JP | 09-205652 | A | 8/1997 |
| JP | 09-233489 | | 9/1997 |
| JP | 09-307897 | | 11/1997 |
| JP | 09-319869 | | 12/1997 |
| JP | 11-066311 | | 3/1999 |
| JP | 11-196419 | A | 7/1999 |
| JP | 11-340878 | | 12/1999 |
| JP | 11-345331 | | 12/1999 |
| JP | 2001-169116 | | 6/2001 |
| JP | 2002-125200 | | 4/2002 |
| JP | 2002-335527 | | 11/2002 |
| JP | 2002-335527 | A | 11/2002 |
| JP | 2003-069859 | | 3/2003 |
| JP | 2003-101774 | | 4/2003 |
| JP | 2003-134352 | | 5/2003 |
| JP | 2003-198878 | | 7/2003 |
| JP | 2003-283835 | | 10/2003 |
| JP | 2005-117549 | | 4/2005 |
| JP | 2005-191895 | | 7/2005 |
| JP | 2006-157584 | | 6/2006 |
| JP | 2006-304352 | | 11/2006 |
| JP | 2006-310934 | | 11/2006 |
| JP | 2007-514362 | A | 5/2007 |
| JP | 2007-174637 | | 7/2007 |
| JP | 2007-265122 | | 10/2007 |
| JP | 2007-310837 | | 11/2007 |
| JP | 2008-103785 | | 5/2008 |
| JP | 2009-198935 | | 9/2009 |
| WO | WO 98/35449 | | 8/1998 |
| WO | WO 00/42778 | | 7/2000 |
| WO | WO 02/084997 | | 10/2002 |
| WO | WO 2007/078829 | | 7/2007 |
| WO | WO-2010113342 | A1 | 10/2010 |
| WO | WO-2010140281 | A1 | 12/2010 |
| WO | WO-2010146728 | A1 | 12/2010 |
| WO | WO 2011/061958 | | 5/2011 |

OTHER PUBLICATIONS

Luminita A. Vese and Stanley J. Osher, "Modeling textures with total variation minimization and oscillating patterns in image processing" Journal of Scientific Computing, vol. 19, Nos. 1-3, Dec. 2003.

Shingo Aoki et al., "Wavelet transform coding by zero value tree structure and vector quantization", Picture Coding Symposium of Japan, Proceedings of the 16th Symposium, Nov. 14, 2001, pp. 95 and 96.

English version of ISR including the Written Opinion of the ISA(PCT/JP2010/000299) mailed on Mar. 9, 2010.

English version of International Search Report dated Dec. 20, 2011 (PCT/JP2011/071706).

English version of International Search Report dated Apr. 6, 2010 (PCT/JP2010/000372).

English version of International Search Report dated Dec. 7, 2010 (PCT/JP2010/069841).

U.S. Restriction Requirement for corresponding U.S. Appl. No. 13/138,197 mailed Oct. 10, 2012.

U.S. Office Action for corresponding U.S. Appl. No. 13/138,197 mailed Dec. 6, 2012.

U.S. Notice of Allowance for corresponding U.S. Appl. No. 13/138,197 mailed Apr. 3, 2013.

U.S. Office Action for corresponding U.S. Appl. No. 13/823,299 mailed Jan. 21, 2014.

U.S. Notice of Allowance for corresponding U.S. Appl. No. 13/377,907 mailed Jan. 18, 2013.

U.S. Office Action for corresponding U.S. Appl. No. 13/375,251 mailed Jun. 19, 2013.

U.S. Notice of Allowance for corresponding U.S. Appl. No. 13/375,251 mailed Oct. 3, 2013.

U.S. Office Action for corresponding U.S. Appl. No. 13/504,351 mailed Nov. 29, 2013.

U.S. Appl. No. 13/504,351, filed Apr. 26, 2012, Group 2665.

U.S. Appl. No. 13/375,251, filed Nov. 30, 2011, Group 2669.

U.S. Appl. No. 13/577,953, filed Aug. 9, 2012, Group 2665.

U.S. Appl. No. 13/823,299, filed Mar. 14, 2013, Group 2422.

Gohshi, S. et al., "A Novel Super Resolution Method with Non-Linear Function", Forum on Information Technology, 2009.

Gohshi, S. et al., "A New Signal Processing Method for Video—Reproduce the Frequency Spectrum Exceeding the Nyquist Frequency-", Multimedia System Conference, 2012.

International Search Report PCT Form PCT/ISA/210, (2010).

U.S. Office Action for corresponding U.S. Appl. No. 13/504,351 mailed Mar. 21, 2014.

(56) References Cited

OTHER PUBLICATIONS

U.S. Notice of Allowance for corresponding U.S. Appl. No. 13/823,299 mailed Mar. 12, 2014.

U.S. Office Action for corresponding U.S. Appl. No. 13/577,953 mailed Jun. 2, 2014.

U.S. Notice of Allowance for corresponding U.S. Appl. No. 13/504,351 mailed Jun. 9, 2014.

* cited by examiner

ENCODING DEVICE CONFIGURED TO GENERATE A FREQUENCY COMPONENT EXTRACTION SIGNAL, CONTROL METHOD FOR AN ENCODING DEVICE USING THE FREQUENCY COMPONENT EXTRACTION SIGNAL, TRANSMISSION SYSTEM, AND COMPUTER-READABLE RECORDING MEDIUM HAVING A CONTROL PROGRAM RECORDED THEREON

TECHNICAL FIELD

The present invention relates to an encoding device that encodes a signal, a decoding device that decodes an encoded signal, a control method for an encoding device, a control method for a decoding device, a transmission system, and a computer-readable recording medium on which a control program is recorded.

BACKGROUND ART

With the recent spread of the Internet, portable phones, digital broadcast and the like, digital communication that transmits and receives multimedia contents such as images and audio are widely available. Since the multimedia contents consists of information being large in amount, a technique to reduce this information amount by encoding (compression encoding) the contents has been commonly used, in order to minimize a transmission bit rate. For example, MPEG (Moving Picture Experts Group)-2 and H.264 have been commonly used as an encoding system for video images.

Such an encoding method employs lossy encoding in which encoding is performed by use of human visual and auditory senses and information difficult for a human to recognize is deleted. Hence, a decoded signal thereof would not be a complete reproduction of an original signal prior to the encoding. Accordingly, the images and sounds indicated by the decoded signal become slightly deteriorated than the images and sounds of the original signal prior to the encoding.

There has been known techniques, which minimize deterioration of a decoded signal while maintaining the degree that the information amount is reduced by the encoding. For example, Patent Literature 1 discloses an encoding technique that optimizes image quality while maintaining a low bit rate, by having quantization be made great in a sector of a video frame in which noise and the like is not easily visualized by a human, whereas having the quantization be made small in a sector of a video frame in which noise and the like can easily be visualized by a human.

CITATION LIST

Patent Literature

Patent Literature 1
Japanese Patent Application Publication, Tokukai No. 2002-335527 A (Publication Date: Nov. 22, 2002)

SUMMARY OF INVENTION

Technical Problem

By including not enough high-frequency components in the decoded signal, this results in having an unsharp image or audio indicated by the decoded signal. In a case of an image for example, the image becomes blurred or has a lower resolution.

Unless a high-frequency component included in an original signal is encoded, the conventional technique such as Patent Literature 1 is not capable of reconstructing the high-frequency component in a decoded signal. Hence, in order to include the high-frequency component in the decoded signal, the original signal needs to be encoded in such a manner that the least possible amount of the high-frequency component is eliminated from the original signal. However, this serves as a cause for an increase in the transmission bit rate of the encoded signal.

Moreover, encoding systems such as the commonly used MPEG-2 and H.264 improve their encoding efficiency by carrying out compression encoding, such as inter-frame prediction coding, or block coding with use of DCT (Discrete Cosine Transform). However, with these encoding systems, deterioration of some kind occurs in image quality upon decoding the signal, in an area including the high frequency component.

The present invention is accomplished in view of the foregoing problem, and an object thereof is to provide an encoding device and the like that carries out encoding, which encoding enables compensation of a signal at decoding while allowing for improvement in the degree that the information amount is reduced by the encoding.

Solution to Problem

In order to attain the object, an encoding device according to the present invention is an encoding device that outputs an encoded signal, the encoded signal including a signal in which an original signal is encoded, the original signal being indicative of contents of at least one of image and audio, the encoding device including: frequency component extracting means for extracting, from the original signal, a part of frequency components included in the original signal, to generate a frequency component extraction signal; and encoding means for encoding the frequency component extraction signal and the original signal in such a manner that the encoding is carried out while switching over between the frequency component extraction signal and the original signal, and making the signal thus encoded be included in the encoded signal.

Moreover, a method according to the present invention for controlling an encoding device is a method of controlling an encoding device that outputs an encoded signal, the encoded signal including a signal in which an original signal is encoded, the original signal being indicative of contents of at least one of image and audio, the method including: extracting from the original signal a part of frequency components included in the original signal, to generate a frequency component extraction signal; encoding the frequency component extraction signal and the original signal in such a manner that the encoding is carried out while switching over between the frequency component extraction signal and the original signal; and making the signal thus encoded be included in the encoded signal.

According to the configuration, (i) a part of frequency components included in an original signal is extracted from the original signal, to generate a frequency component extraction signal, (ii) encoding is carried out to the frequency component extraction signal and the original signal by switching over between the frequency component extraction signal and the original signal, (iii) a signal thus encoded is included into an encoded signal, and thereafter (iv) the encoded signal is outputted. Note that the encoding system may be a conventionally used system, such as MPEG-2 or H.264.

As a result of the switching over, the encoded signal can include, not a signal in which the original signal is constantly encoded, but a signal in which, instead of the original signal, a frequency component extraction signal having a smaller information amount than the original signal is encoded. For example, the encoded signal may include a frequency component extraction signal in which the high-frequency component of the original signal is removed from the original signal. Information amount of an image is largely included in the high frequency component, and thus the information amount of the encoded signal is reduced in its entirety as compared to a case where the signal in which the original signal is encoded is constantly included in the encoded signal.

Accordingly, such an effect is attained that it is possible to reduce a transmission rate in a transmission path, in a case in which an encoded signal is transmitted from an encoding device to a decoding device. By reducing the transmission rate, it is possible to reduce the costs required for the transmission, such as establishment costs and maintenance costs of the transmission path.

In a case in which, for example, the original signal is indicative of contents of a video consisted of a plurality of frames that are consecutive in terms of time, the switching may be considered as being carried out in units of frames. More specifically, in one frame per several frames, the original signal is encoded, and in the remaining frames, the frequency component extraction signal is encoded. In this case, in the frames other than the one frame per several frames, the frequency component extraction signal is encoded; this allows for reducing information amount of the encoded signal than encoding the original signal in all of the frames.

Moreover, a decoding device that decodes an encoded signal outputted from the encoding device is configured so as to generate a decoded signal that is indicative of at least one of contents of image and audio by decoding an encoded signal including a signal in which the original signal is encoded and a signal in which the frequency component extraction signal is encoded. In particular, when an encoded signal that includes the signal in which the frequency component extraction signal is encoded, the decoded signal is generated by adding the signal thus decoded with a signal in which motion compensation is carried out to a decoded signal generated immediately before.

Namely, in decoding the signal in which the frequency component extraction signal is encoded, the decoding device compensates for the frequency component that has been removed by the encoding device when the frequency component extraction signal is generated. Accordingly, the decoding device reconstructs a decoded signal equivalent to the original signal, while receiving as an input, an encoded signal reduced in information amount by the encoding device. The decoding device may further carry out a sharpening process that makes a rise and fall of a signal corresponding to an edge part of the decoded signal steep. A configuration example of the decoding device is described later.

Moreover, in order to attain the object, the decoding device according to the present invention is a decoding device that generates a decoded signal by receiving, as an input, an encoded signal including a signal in which an original signal is encoded, the original signal being indicative of contents of at least one of image and audio, the contents being constituted of a plurality of frames that are consecutive in terms of time, the encoding of the original signal causing an output of motion vector information for carrying out motion compensation prediction among the frames, the encoded signal including, in each frame, any one of a first signal or a second signal, the first signal being a signal in which the original signal is encoded and the second signal being a signal in which a part of frequency components included in the original signal is encoded, the decoding device including: decoding means for generating, as the decoded signal when the first signal is decoded, a signal in which the first signal is decoded, and generating, as the decoded signal when the second signal is decoded, a signal by adding (a) a signal of a decoded signal generated immediately before that has been subjected to motion compensation with use of the motion vector information and (b) a signal in which the second signal is decoded.

Moreover, a control method according to the present invention for a decoding device is a method of controlling a decoding device that generates a decoded signal by receiving, as an input, an encoded signal including a signal in which an original signal is encoded, the original signal being indicative of contents of at least one of image and audio, the contents being constituted of a plurality of frames that are consecutive in terms of time, the encoding of the original signal causing an output of motion vector information for carrying out motion compensation prediction among the frames, the encoded signal including, in each frame, any one of a first signal or a second signal, the first signal being a signal in which the original signal is encoded and the second signal being a signal in which a part of frequency components included in the original signal is encoded, the method including: generating, as the decoded signal when the first signal is decoded, a signal in which the first signal is decoded; and generating, as the decoded signal when the second signal is decoded, a signal by adding (a) a signal of a decoded signal generated immediately before that has been subjected to motion compensation with use of the motion vector information and (b) a signal in which the second signal is decoded.

According to the configuration, an encoded signal includes, in units of frames, any one of (1) a first signal in which an original signal is encoded and (2) a second signal in which a part of frequency components included in the original signal is encoded. In a case of (1), the decoding device according to the present invention generates, as the decoded signal, a signal in which the first signal is decoded, whereas in a case of (2), the decoding device generates, as a subsequent decoded signal, a signal in which (a) a signal in which motion compensation is carried out to a decoded signal generated immediately before, is added to (b) a signal in which the second signal is decoded. As a result, the decoded signal generated by the decoding device is a signal equivalent to the original signal, with an exception of deterioration caused by the encoding and decoding.

As described above, the encoded signal including the (1) and (2) in units of frames has a lower information amount than that of the encoded signal including the signal in which just the original signal is encoded. As a result, it is possible to reduce a transmission rate in a transmission path.

This allows for decoding to a decoded signal equivalent to the original signal, by having the encoded signal with the small information amount including the (1) and (2) in units of frames serve as the input. Accordingly, such an effect is attained that the decoded signal is minimized in its degree of deterioration while maintaining the degree of reduction of the information amount by the encoding.

Furthermore, a nonlinear process described above may be carried out to the decoded signal, to sharpen rise and fall of a signal corresponding to an edge part, which signal is included in the decoded signal. This allows for highly sharpening the contents indicated by the decoded signal.

For a fuller understanding of the nature and advantages of the invention, reference should be made to the ensuing detailed description taken in conjunction with the accompanying drawings.

DESCRIPTION OF EMBODIMENTS (Overview of Transmission System)

Figure 2:
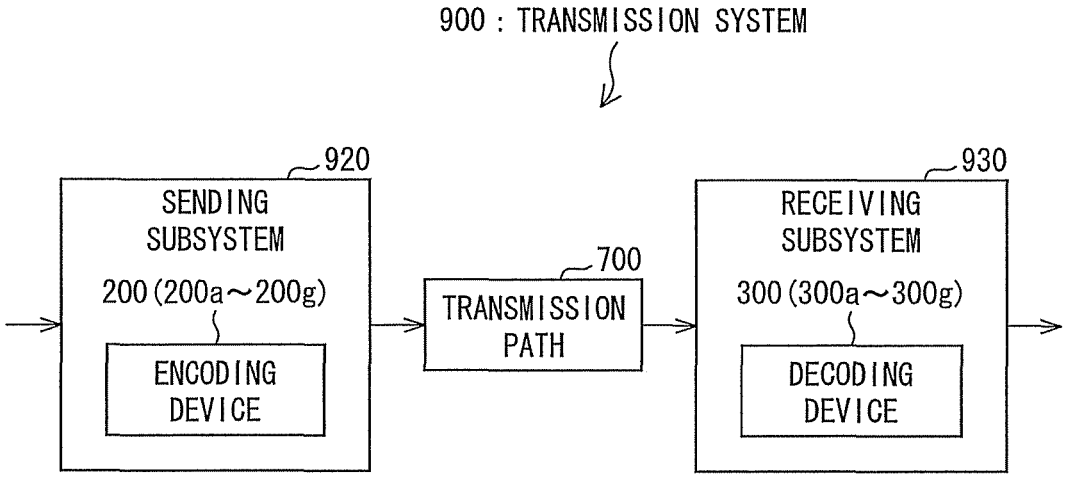
FIG. 2 is a block diagram illustrating a transmission system including an encoding device according to the present invention.

Described below is a transmission system 900 according to each of embodiments, with reference to FIG. 2. FIG. 2 is a block diagram showing a configuration of the transmission system 900.

As shown in FIG. 2, the transmission system 900 includes a sending subsystem 920 and a receiving subsystem 930. The sending subsystem 920 and the receiving subsystem 930 are connected so as to be communicable via a commonly known transmission path 700. The transmission path 700 may include a relay device such as a switch or a switchboard.

The sending subsystem 920 is, in brief, a system for sending a signal indicative of contents such as image, audio, or the like (hereinafter simply referred to as original signal SR) to the receiving subsystem 930, and includes functions that are usually provided on a sending side, such as an encoding function and a modulating function of the original signal SR. The sending subsystem 920 includes, in particular, an encoding device 200 that performs processes related to encoding. The configuration of the encoding device 200 is dealt with in the embodiments described below.

The receiving subsystem 930 is, in brief, a system for receiving a signal sent from the sending subsystem 920, and includes functions usually provided on a receiving side, such as a demodulation function, a decoding function, and the so-called 3R functions (reshaping, retiming, regenerating) of a signal. The receiving subsystem 930 in particular includes a decoding device 300 that performs processes related to decoding. The configuration of the decoding device 300 is dealt with in the embodiments described below.

When encoding devices 200*a* through 200*g* each later described are not distinguished therebetween, these devices are simply referred to as "encoding device 200". Moreover, when decoding devices 300*a* through 300*g* each later described are not distinguished therebetween, these devices are simply referred to as "decoding device 300".

Also note that an image indicated by the original signal SR (i.e. image prior to the encoding) is written as "original image", and an image reconstructed by decoding with the decoding device 300 is described as "reconstructed image".

Contents indicated by the original signal SR include contents such as a video image, a still image, audio, and the like; in each embodiment, descriptions are provided on the assumption of a video image in particular. Furthermore, the video image may be, for example, a video image that is displayed in real time with a receiver or the like of a standard definition television (SDTV) or a high definition television (HDTV). The video image is to be made of a plurality of frames (screens) that are consecutive in terms of time.

(Overview of Sharpening Process Section)

Figure 19:
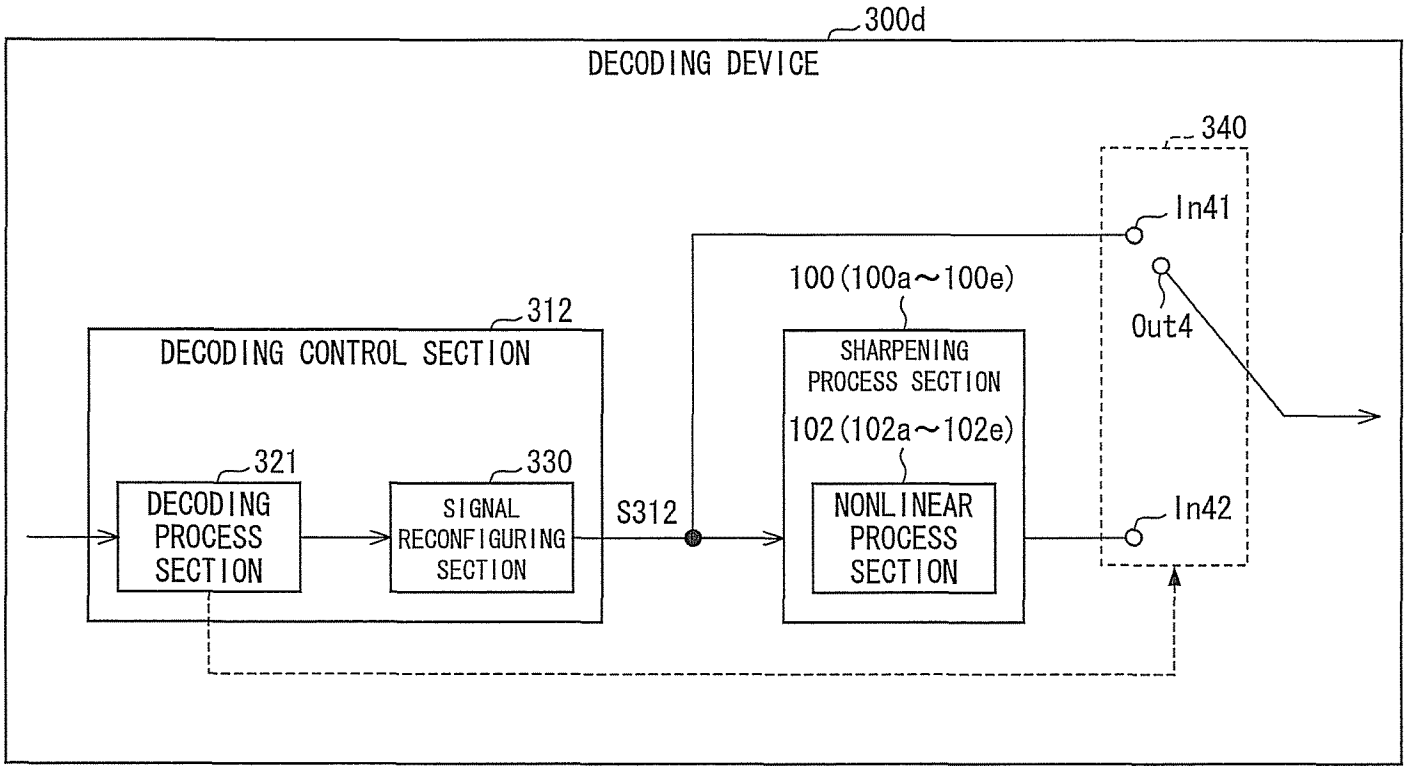
FIG. 19 is a block diagram showing a configuration example of a modification of the decoding device shown in FIG. 18.

The following description explains an overview of a sharpening process section (high-frequency component generation means) 100, which serves as a structural component of the encoding device 200 and the decoding device 300 (see for example FIG. 19). A specific configuration of the sharpening process section 100 is described later. When the sharpening process sections 100*a* through 100*e* later described are not distinguished therebetween, these are referred to simply as "sharpening process section 100".

The sharpening process section 100 is a device for carrying out a sharpening process to a signal received by the sharpening process section 100 (hereinafter, simply referred to as signal input) for sharpening a waveform of the signal input and outputting a sharpened signal output. The sharpening process indicates a process for making rising and falling of a signal input steep (i.e. enhancing rising and falling of a signal input). In particular, when the signal input indicates an image, rising and falling of a signal that corresponds to an outline part (edge) in the image is made steep.

Hereinafter, a signal input to the sharpening process section 100 is referred to as an input signal Sin. A signal output from the sharpening process section 100 is referred to as an output signal Sout.

As mentioned later, the sharpening process section 100 includes at least a nonlinear process section (nonlinear process means, second nonlinear process means, third nonlinear process means) 102. The nonlinear process section 102 is a general name for nonlinear process sections 102*a* through 102*e*, each of which are described later. The sharpening process section 100 can make the output signal Sout include a high-frequency component which is not included in the input signal Sin (specifically, frequency component whose frequencies are higher than Nyquist frequency, which Nyquist frequency is half the sampling frequency when the input signal Sin is made discrete) by subjecting a high-frequency component of the input signal Sin to nonlinear operation in the nonlinear process section 102. Consequently, the sharpening process carried out by the sharpening process section 100 enables rising and falling of a signal input to be sharper than a case of a sharpening process based on linear operation.

Embodiment 1 as Reference Embodiment

Described below is an embodiment serving as a Reference Embodiment of the present invention, with reference to FIG. 3 to FIG. 16. The encoding device 200 of the present embodiment is referred to as an encoding device 200*a*. Moreover, the decoding device 300 of the present embodiment is referred to as a decoding device 300*a*.

(Configuration of Encoding Device and Decoding Device)

Figure 3:
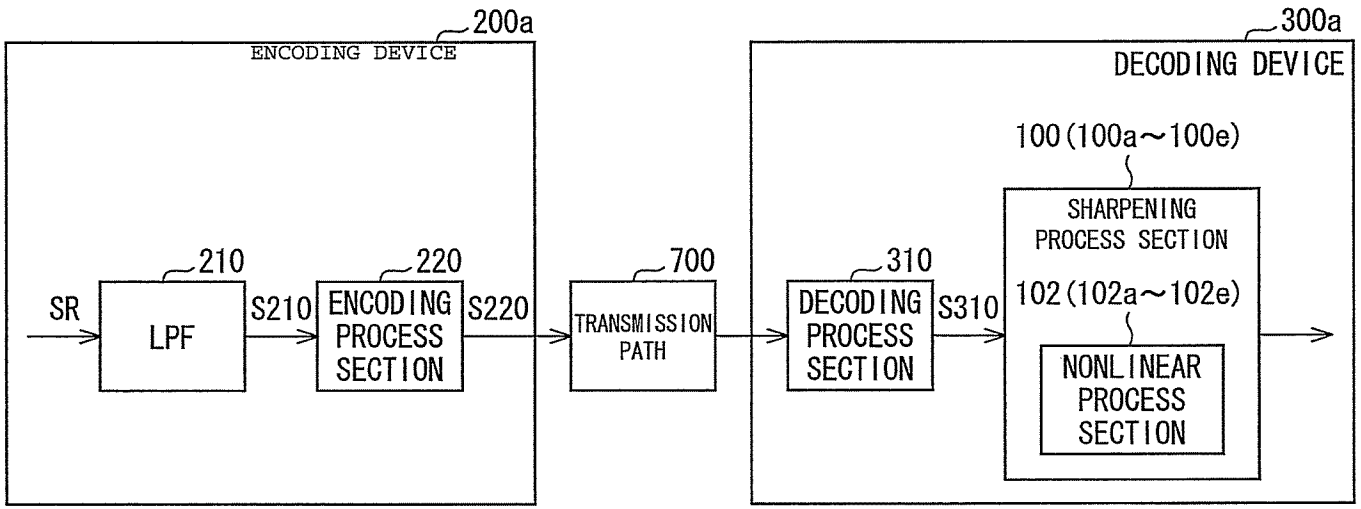
FIG. 3 is a block diagram showing a configuration of an encoding device and a decoding device, as a reference embodiment.

The following describes configurations of the encoding device 200*a* and the decoding device 300*a*, with reference to FIG. 3. FIG. 3 is a block diagram illustrating the configurations of the encoding device 200*a* and the decoding device 300*a*.

First described is the configuration of the encoding device 200*a*. As shown in FIG. 3, the encoding device 200*a* includes a low-pass filter (hereinafter, referred to as LPF) (frequency component extracting means) 210 and an encoding process section 220.

The LPF 210 is a commonly known low-pass filter, and removes high-frequency components out of frequency components of the original signal SR, from the original signal SR. The LPF 210 may be a low-pass filter in which frequency characteristics are adjustable (so-called adaptive low-pass filter). Note that a signal outputted from the LPF 210 is referred to as a high-frequency-free signal S210.

The encoding process section 220 is provided subsequently to the LPF 210, and encodes the high-frequency-free signal S210 outputted from the LPF 210. A signal outputted from the encoding process section 220 is referred to as an encoded signal S220.

The encoding process section 220 and a decoding process section 310 described later serve as a pair, and the encoding process section 220 is designed to output an encoded signal S220 that is decodable by the decoding process section 310.

In a case in which a video image is to be encoded, the encoding process section 220 performs compression encoding by the commonly known inter-frame predictive coding. Further, the encoded signal S220 is outputted including a motion vector used for carrying out motion compensation in the decoding process section 310.

Next describes the configuration of the decoding device 300*a*. The decoding device 300*a* includes a decoding process section 310 and a sharpening process section 100, as shown in FIG. 3.

The decoding process section 310, as described above, decodes the encoded signal S220 that is outputted from the encoding process section 220 of the encoding device 200*a*. When a video image is to be decoded, the decoding process section 310 performs motion compensation by carrying out inter-frame prediction using the motion vector included in the encoded signal S220.

The signal outputted from the decoding process section 310 is referred to as a decoded signal S310. The decoded signal S310 is a signal indicative of a reconstructed image corresponding to the original image indicated by the original signal SR.

Next described is the sharpening process section 100. As described above, the sharpening process section 100 subjects a high-frequency component of the signal input to nonlinear operation in the nonlinear process section 102, so that a high-frequency component not included in the signal input (specifically, a frequency component whose frequencies are higher than a Nyquist frequency, which Nyquist frequency is half a sampling frequency when an input signal Sin is made discrete) is included in the signal output, and causes the rise and fall of the signal input to be steep.

Since the decoding device 300*a* is designed in such a manner that the sharpening process section 100 is provided subsequently to the decoding process section 310, the decoded signal S310 outputted from the decoding process section 310 serves as the signal input of the sharpening process section 100. Accordingly, the decoding device 300*a* carries out a sharpening process to the decoded signal S310 in the sharpening process section 100, based on the nonlinear operation. Namely, the sharpening process section 100 of the decoding device 300*a* sharpens the reconstructed image of the decoded signal S310.

(Effect Attained by Configuration)

As described above, the encoding device 200*a* encodes the high-frequency-free signal S210 in which the high-frequency component is removed from the original signal SR. Hence, as compared to a case in which the original signal SR is encoded with the encoding device 200*a*, it is possible to reduce data amount of the encoded data by a removed amount of the high-frequency component. That is to say, the encoding device 200*a* allows for reducing a transmission rate of a signal to be transmitted through the transmission path 700. The reduction of the transmission rate allows for reducing costs required for the data transmission.

However, since the high-frequency component that was included in the original signal SR is removed, none of the removed high-frequency component will be included in the signal thus decoded if the encoded signal S220 that has been subjected to encoding is decoded on the receiving side. In this case, the reconstructed image indicated by the decoded signal S310 deteriorates (or is removed) in its part that corresponds to the high frequency component, as compared to the original image indicated by the original signal SR. That is to say, an outline part (edge) of the reconstructed image, which outline part corresponds to the high frequency component, cannot be sufficiently reconstructed in the reconstructed image; as a result, the reconstructed image becomes unsharp (the reconstructed image blurs). The same applies in a case in which the contents indicated by the original signal SR is of audio; audio thus decoded becomes unclear (e.g. sound quality deteriorates).

Meanwhile, the decoding device 300*a* of the present embodiment includes the sharpening process section 100 subsequently to the decoding process section 310, as described above. Since the sharpening process section 100 can make the signal output include the high-frequency component not included in the signal input, it is possible to sharpen the rise and fall of the decoded signal S310. As a result, the decoding device 300*a* can sharpen the contents indicated by a signal thus decoded, thereby making it possible to, for example in a case in which the contents is of image, minimize the blur of the image indicated by the decoded signal and improve its resolution. Moreover, the contents is similarly sharpened also in a case in which the contents is of audio, thereby allowing for clarifying the sound quality.

As a result, with the configuration in which encoding is carried out in the encoding device 200*a* and decoding is carried out in the decoding device 300*a*, such an effect is attained that a transmission rate of a signal to be transmitted through the transmission path 700 is reduced while the contents of signals that have been decoded on the receiving side are minimized in the degree of becoming unsharp.

(Modification 1)

Although the encoding device 200*a* is designed in such a manner that the LPF 210 and the encoding process section 220 are provided adjacent to each other, the LPF 210 and the encoding process section 220 are not necessarily provided adjacent to each other. That is, another device(s) (apparatus (es)) may be provided between the LPF 210 and the encoding process section 220, and the signal outputted from the LPF 210 may be received by the encoding process section 220 via the another device(s). Similarly, although the decoding device 300*a* is designed in such a manner that the decoding process section 310 and the sharpening process section 100 are provided adjacent to each other, these members do not necessarily need to be adjacent to each other. Namely, another device(s) (apparatus(es)) may be provided between the decoding process section 310 and the sharpening process section 100, and the signal outputted from the decoding process section 310 may be received by the sharpening process section 100 via the another device(s).

Figure 4:
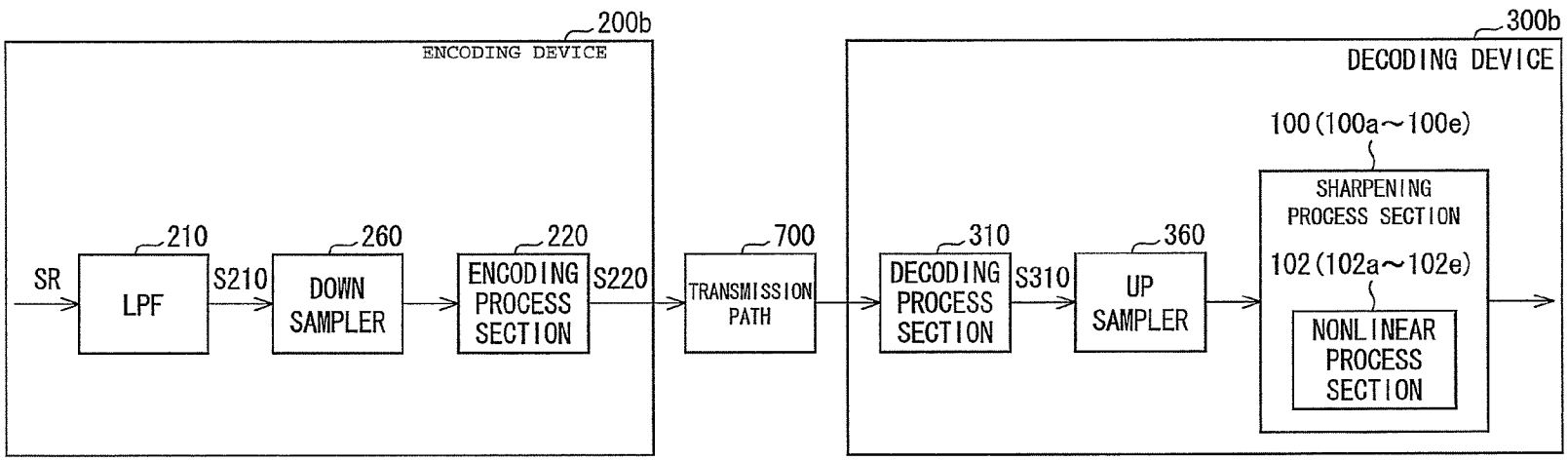
FIG. 4 is a block diagram showing an example of a configuration of a modification of the encoding device and the decoding device shown in FIG. 3.

Described below is a configuration example in which another device (apparatus) is provided between the LPF 210 and the encoding process section 220 and between the decoding process section 310 and the sharpening process section 100, with reference to FIG. 4. FIG. 4 is a block diagram showing a configuration example of an encoding device 200*b*, which is a modification of the encoding device 200*a*, and a decoding device 300*b*, which is a modification of the decoding device 300*a*.

As shown in FIG. 4, the encoding device 200*b* has a down sampler 260 disposed between the LPF 210 and the encoding process section 220. The down sampler 260 carries out a common decimation to the high-frequency-free signal S210 outputted from the LPF 210. A signal thus thinned is inputted into the encoding process section 220.

The decoding device 300*b* has an up sampler 360 disposed between the decoding process section 310 and the sharpening process section 100. The up sampler 360 corresponds to the down sampler 260, and carries out a common interpolation to the decoded signal S310 outputted from the decoding process section 310. A signal thus interpolated is thereafter received by the sharpening process section 100.

According to the configuration, data is decimated before the data is encoded. This allows for further reducing the data amount achieved as a result of the encoding. Namely, such an effect is attained that a transmission rate of a signal transmitted through the transmission path 700 may be further reduced.

Note that on the receiving side, interpolation is carried out to the decimated parts, to minimize the deterioration of the contents caused by the decimation.

After the interpolation by the up sampler 360, the interpolated signal is subjected to the nonlinear process by carrying out the sharpening process with the sharpening process section 100, to compensate a high-frequency band that exceeds the Nyquist frequency. This minimizes the image blur caused by the decimation and interpolation, and minimizes a decrease in resolution.

In a case in which a sharpening process by linear operation (conventional technique) is carried out to the signal after the signal is interpolated, the high-frequency band exceeding the Nyquist frequency cannot be compensated. Hence, the unsharpness cannot be improved that much (in a case of an image, it results in the blur remaining or in which the resolution does not improve that much).

(Modification 2)

Modification 2 described above deals with a configuration in which a down sampler is provided in the sending side and an up sampler corresponding to the down sampler is provided in the receiving side. A possible alternative configuration is one in which no down sampler is provided in the sending side, and just an up sampler is provided on the receiving side.

For example, assume a case in which, in a transmission system to transmit a signal for HDTV, a display device provided on the receiving side is a display having a pixel number of approximately 4000×2000 (so-called 4K display), which is a number larger than the number of pixels of a HDTV or the like. In this case, carrying out display on the display device upon up-converting the signal for the HDTV allows for improving the image quality of the image as compared to a case in which the image is displayed on the display device without up-converting the signal.

As described above, if it is preferable to carry out up-converting of contents on the receiving side, the receiving side is preferably provided with the up sampler 360 in the configuration of the receiving side as in the encoding device 200*b*, regardless of the configuration of the sending side.

(Modification 3)

It is generally known that when encoding and decoding contents, the contents that are decoded slightly deteriorate as compared to the contents which have not been encoded. Hence, regardless of the configuration of the encoding device on the sending side, it is preferable that the decoding device on the receiving side always includes the sharpening process section 100. This allows for the contents indicated by the decoded signal to always be sharpened, and minimizes the unsharpness caused in the contents.

(Configuration of Sharpening Process Section)

The following details the configuration of the sharpening process section 100.

Figure 5:
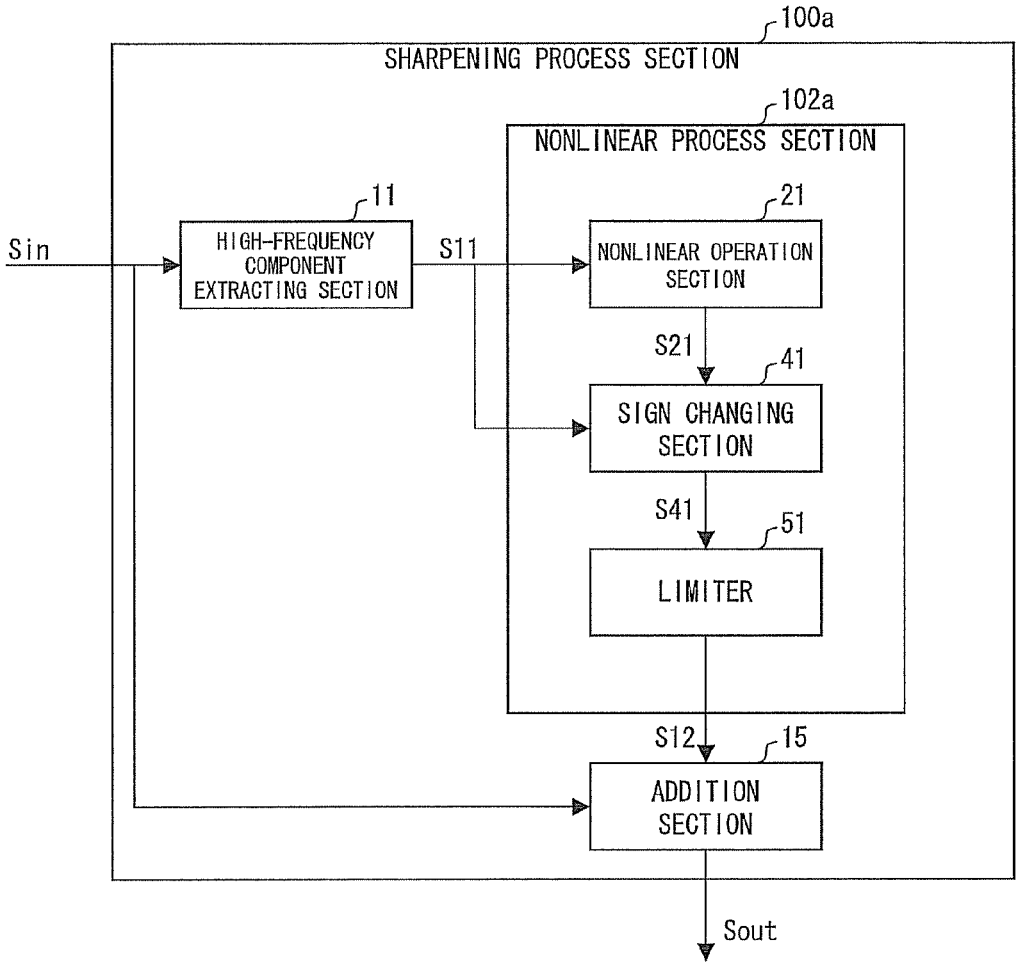
FIG. 5 is a block diagram showing a configuration of a sharpening process section included in an encoding device of the present invention.

FIG. 5 is a block diagram showing a configuration of a sharpening process section 100*a*. As shown in FIG. 5, the sharpening process section 100*a* includes a high-frequency component extracting section (low-frequency component removing means, second low-frequency component removing means, third low-frequency component removing means) 11, a nonlinear process section 102*a*, and an addition section (addition means, second addition means, third addition means) 15.

Figure 6:
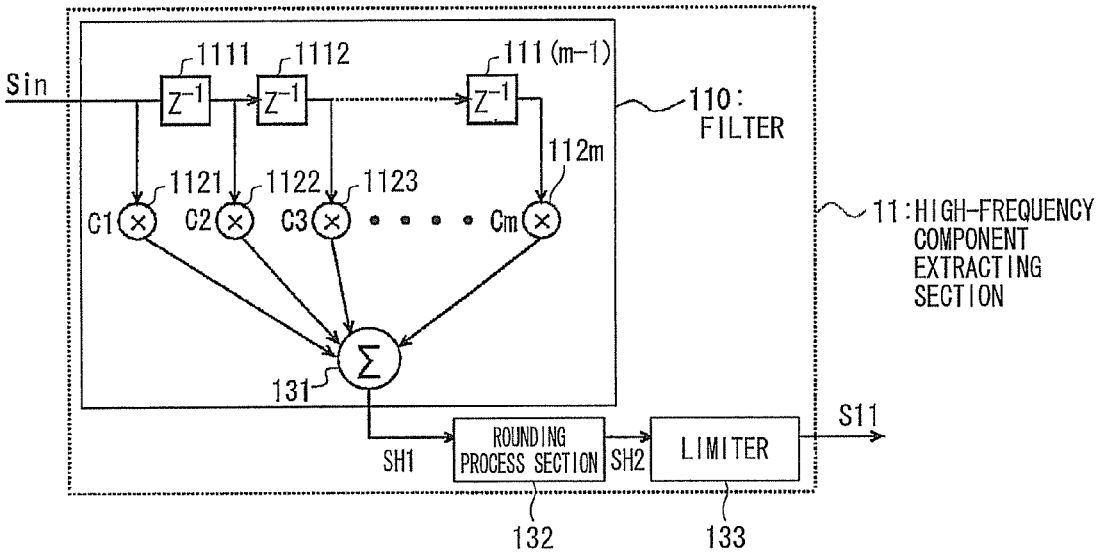
FIG. 6 is a block diagram showing a high-frequency component extracting section included in the sharpening process section shown in FIG. 5.

First, an explanation is made as to the high frequency component extracting section 11. Schematically, the high frequency component extracting section 11 extracts a high frequency component in the input signal Sin and outputs the component as a high-frequency signal S11 (low-frequency-free signal, second low-frequency-free signal, third low-frequency-free signal) (low-frequency component removing step). With reference to FIG. 6, an explanation is made as to a configuration of the high-frequency component extracting section 11. FIG. 6 is a block diagram showing the configuration of the high-frequency component extracting section 11.

As shown in FIG. 6, the high-frequency component extracting section 11 includes a filter 110, a rounding process section (low-level signal removing means) 132, and a limiter (high-level signal removing means) 133.

The filter 110 is an m-tap transversal high-pass filter including m−1 unit delay elements 111*h* (h=1, 2, . . . , m−1: m is a positive integer of 3 or greater), m multiplication sections 112*k* (k=1, 2, . . . , m), and an addition section 131. The filter 110 receives the input signal Sin as input and outputs a high band signal SH1.

Each of the unit delay elements 111*h* delays an input signal by unit time and outputs the delayed signal. The unit delay element 1111 (h=1) receives the input signal Sin.

Each of the multiplication sections 112*k* multiplies the input signal with a coefficient Ck, and outputs the result of the multiplication to the addition section 131. The coefficient Ck is set beforehand so that the filter 110 serves as a high-pass filter. For example, in a case where m=3, by setting C1, C2, and C3 to 0.5, −1, and 0.5, respectively, the filter 110 serves as a high-pass filter.

The addition section 131 adds signals from the addition sections 112*k* so as to generate the high band signal SH1.

Figure 7:
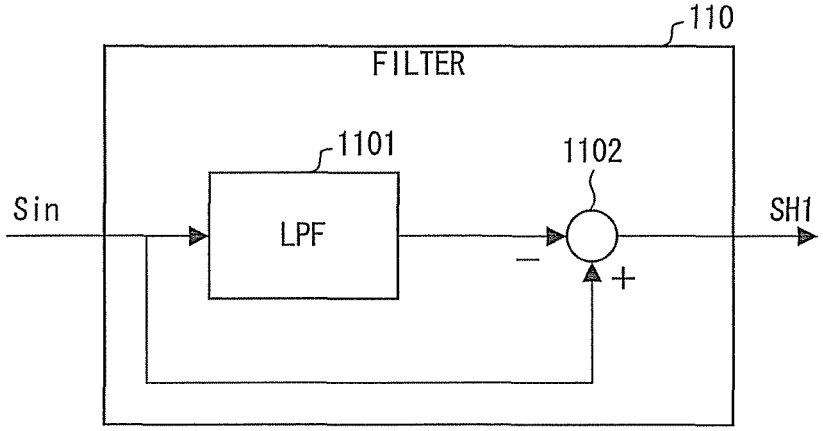
FIG. 7 is a block diagram showing another configuration example of a filter included in the high-frequency component extracting section shown in FIG. 6.

As is generally known, a low-pass filter is easier to fabricate than fabricating a high-pass filter. Therefore, the filter 110 may be constituted of a low-pass filter. FIG. 7 shows another configuration example of the filter 110. As shown in FIG. 7, the filter 110 may be constituted of a low-pass filter 1101 and a subtraction section 1102.

In order not to amplitude noises in the nonlinear process section 102 provided subsequently, the rounding process section 132 removes a low level signal which can be regarded as a noise in the high band signal SH1, thereby generating a low-level-free signal SH2.

Specifically, out of signal values of the high band signal SH1, the rounding process section 132 changes a signal value whose absolute value is not more than a predetermined lower limit LV to "0", thereby generating the low-level-free signal SH2.

For example, in a case where the input signal Sin can be any integer ranging from −255 to 255, when the lower limit LV is "2", the rounding process section 132 regards, as noises, all signal values whose absolute value is not more than "2" out of signal values of the high band signal SH1, and changes such signal values to "0" (i.e. rounds such signal values).

Subsequently, in order that a signal already having a sufficiently high energy is not further amplified in the nonlinear process section 102 provided subsequently, the limiter 133 removes a high-level signal value in the low-level-free signal SH2, thereby generating a high-frequency signal S11.

Specifically, in order that a signal value of the low-level-free signal SH2 is not more than a predetermined upper limit UV1, with respect to signal values of the low-level-free signal SH2, the limiter 133 carries out a process of changing signal values whose absolute values are more than the upper limit UV1 so that their absolute values are not more than the upper limit UV1 (hereinafter also referred to as a clipping process), thereby generating the high-frequency signal S11.

For example, out of signal values of the low-level-free signal SH2, signal values whose absolute values are more than "64" are changed to "64" or "−64" according to signs. Alternatively, the signal values may be changed to "0".

In a case where the input signal Sin is an 8-bit signal, the filter 110 adds, to the input signal Sin, a signal limited to be not more than 3rdMSB (approximately 64 or −64 in 8-bit signal) based on 12-bit calculation. Accordingly, the rounding process section 132 and the limiter 133 carry out a process of limiting the result of calculation by the filter 110 to 8-bit signals.

In the above explanation, the high-frequency component extracting section 11 includes the rounding process section 132 and the limiter 133. Alternatively, the high-frequency component extracting section 11 may include a member obtained by integrating the rounding process section 132 and the limiter 133 with each other.

Next, the nonlinear process section 102*a* is to be described. The nonlinear process section 102*a* includes a nonlinear operation section (even exponentiation operation means, square root operation means) 21, a sign changing section (sign changing means) 41, and a limiter (amplitude adjustment means) 51 (see FIG. 5).

The nonlinear operation section 21 carries out a nonlinear operation to the high-frequency signal S11, so as to generate a nonlinear signal S21.

The nonlinear operation which is carried out by the nonlinear operation section 21 is described here. The following description denotes a signal value to be supplied to the nonlinear operation section 21 as x, denotes a signal value to be supplied from the nonlinear operation section 21 as y, and expresses the nonlinear operation which is carried out by the nonlinear operation section 21 as a function y=f(x).

Assume here that the function f(x) is a nonlinear monotone increasing function which monotonically increases so as to be in positive and negative symmetry (origin symmetry). Note that "monotone increasing" means broad monotone increasing. However, it is only necessary that the function f(x) monotonically increase at least in the vicinity of x="0". It is preferable that the function f(x) be |f(x)|>|x| at least in the vicinity of x="0".

Such a function f(x) is exemplified by those expressed as the following expressions (1) through (3). Note that it is preferable that the functions f(x) expressed as the expressions (2) and (3) be used in an interval $0 \le x \le 1$ since the functions f(x) greatly increase in the interval.

Math. 1

$$f(x)=x^{2n} (n \text{ is a natural number}) \quad (1)$$

Math. 2

$$f(x)=|x|^{1/2} \quad (2)$$

Math. 3

$$f(x)=|x|^{1/10} \quad (3)$$

In a case in which the expression (1) is used as the function f(x), the nonlinear operation section 21 raises the high-frequency signal S11 to an even exponent not less than 2, so as to generate the nonlinear signal S21 (even exponentiation signal, square root signal). For example, in a case in which n=1 (i.e., $f(x)=x^2$) in the expression (1), the nonlinear operation section 21 squares the high-frequency signal S11, to generate the nonlinear signal S21. Assuming in this case that data rows constituting the high-frequency signal S11 are X1, X2, X3, . . . , the nonlinear signal S21 obtained by squaring the high-frequency signal S11 becomes a digital signal constituted by data rows $X1^2$, $X2^2$, and $X3^2$, . . . .

In a case in which a signal value of the high-frequency signal S11 is any of integer values −255 through 255, 255 may be used to normalize x, in using the function f(x). For example, the expression (2) may be replaced with the following expression (4) obtained by using x/255 to normalize x on the right side of the function f(x) expressed as the expression (2) and multiplying the right side by 255. Note that the expression (4) meets the requirement of f(x)>x.

Math. 4

$$f(x)=255|x/255|^{1/2} \quad (4)$$

In the expression (4), 255 is used to normalize x on the right side of the function f(x) expressed as the expression (2) and the right side is multiplied by 255. However, a numerical value by which the right side is multiplied does not need to be identical to a value (255 in this example) to normalize x. It is only necessary that the numerical value meet the requirement of |f(x)|>|x|. For example, the following expression (5) in which the right side is multiplied by 100 instead of 255 may be replaced with the expression (4).

Math. 5

$$f(x)=100|x/255|^{1/2} \quad (5)$$

Further, the function f(x) may be expressed as the following expression (6), which uses a trigonometric function.

Math. 6

$$f(x)=255|\sin[(x/255)(\pi/2)]| \quad (6)$$

Subsequently, in accordance with sign bit information on the high-frequency signal S11, the sign changing section 41 generates, as a sign change signal S41, a signal obtained by reflecting a sign of the high-frequency signal S11 in the nonlinear signal S21. Namely, the sign changing section 41 retains a sign of a part of the nonlinear signal S21 which part is identical in sign to the high-frequency signal S11. In contrast, the sign changing section 41 reverses positive and negative signs of a part of the nonlinear signal S21 which part is different in sign from the high-frequency signal S11.

Then, the limiter 51 carries out a process (hereinafter also described as an amplitude adjustment process) for adjusting an amplitude (signal level, intensity) of the sign change signal S41 which is generated by the sign changing section 41, to generate a nonlinear process signal (second nonlinear process signal, third nonlinear process signal) S12. Specifically, the limiter 51 multiplies the sign change signal S41 by a specific magnification value ($|\alpha|<1$), so as to adjust the amplitude of the sign change signal S41. The magnification value $\alpha$ is appropriately set according to characteristics of a transmission path.

In order not to further amplify a signal which has sufficient energy, the limiter 51 carries out a process (hereinafter also described as a clip process) for changing, to a value not more than a predetermined upper limit UV2, an absolute value of a part of the nonlinear process signal S12 which part has an absolute value higher than the upper limit UV2, so that a signal value of the nonlinear process signal S12 is not more than the upper limit UV2. For example, in a case where a part of the nonlinear process signal S12 has a signal value whose absolute value exceeds "64", the limiter 51 changes the signal value to "64" or "−64" in accordance with a sign of the absolute value. Alternatively, the limiter 51 changes the absolute value to "0".

Note that the nonlinear process section 102*a* may include no limiter 51 that carries out the amplitude adjustment process and the clip process to the sign change signal S41. In this case, the nonlinear process section 102*a* outputs, as the nonlinear process signal S12, the sign change signal S41 which is generated by the sign changing section 41.

Finally, the addition section 15 is to be described. The addition section 15 adds the nonlinear process signal S12 as a correction signal to the input signal Sin, so as to generate the output signal Sout. Note that the addition section 15 appropriately includes a delay element for adjusting a timing between the input signal Sin and the nonlinear process signal S12.

(Waveform of Signal in Configuration Example 1)

Figure 8:
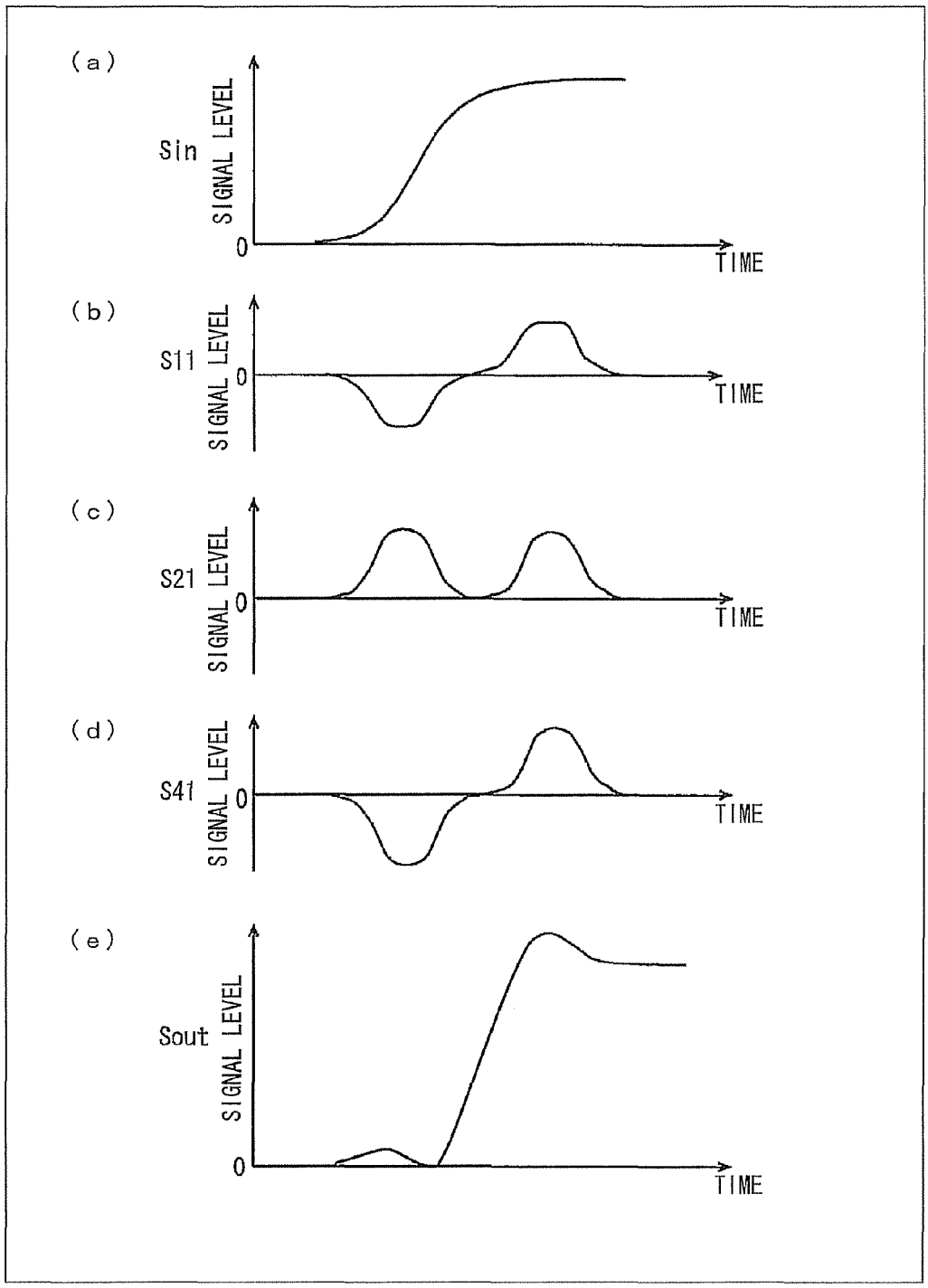
FIG. 8 (*a*) of FIG. 8 schematically shows a waveform of a signal inputted to the sharpening process section shown in FIG. 5. (*b*) of FIG. 8 schematically shows a waveform of a high-frequency signal generated by the sharpening process section shown in FIG. 5. (*c*) of FIG. 8 schematically shows a waveform of a nonlinear signal generated in the sharpening process section shown in FIG. 5. (*d*) of FIG. 8 schematically shows a waveform of a sign change signal generated in the sharpening process section shown in FIG. 5. (*e*) of FIG. 8 schematically shows a waveform of an output signal generated in the sharpening process section shown in FIG. 5.

The following description discusses waveforms of signals generated by sections of the sharpening process section 100*a* with reference to (*a*) through (*e*) of FIG. 8. (*a*) through (*e*) of FIG. 8 schematically illustrate waveforms of the signals generated by the sections of the sharpening process section 100*a*. It is assumed here that the sharpening process section 100*a* receives the signal shown in (*a*) of FIG. 8 as the input signal Sin.

Initially, when the input signal Sin is inputted to the high-frequency component extracting section 11, a high-frequency component included in the input signal Sin is extracted so that the high-frequency signal S11 shown in (*b*) of FIG. 8 is generated.

Next, in a case in which the nonlinear operation carried out by the nonlinear operation section 21 of the nonlinear process section 102*a* is $f(x)=x^2$, the nonlinear operation section 21 generates the nonlinear signal S21 obtained by squaring the high-frequency signal S11 (see (*c*) of FIG. 8).

Subsequently, the sign changing section 41 which has received the nonlinear signal S21 generates the sign change signal S41 (see (*d*) of FIG. 8). As illustrated in (*d*) of FIG. 8, the sign change signal S41 retains positive and negative signs of the high-frequency signal S11 shown in (*b*) of FIG. 8.

Then, the limiter 51 which has received the sign change signal S41 carries out the amplitude adjustment process and the clip process, so as to generate the nonlinear process signal S12. Thereafter, the addition section 15 adds the nonlinear process signal S12 to the input signal Sin, so as to generate the output signal Sout (see (*e*) of FIG. 8).

Note that a rise and a fall of the signal of the nonlinear process signal S12 (see (*e*) of FIG. 8), which are steeper than those of a signal obtained by enhancing the input signal Sin by use of the linear operation, are to be described with reference to FIG. 9.

Figure 9:
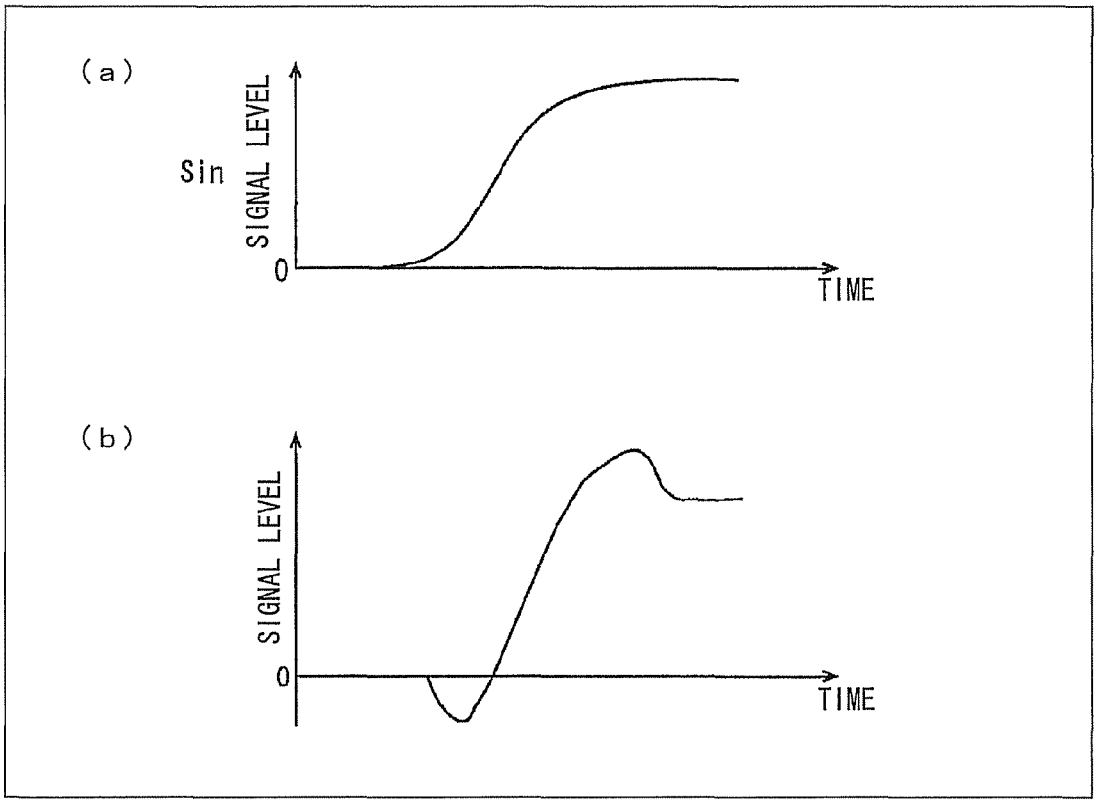
FIG. 9 (*a*) of FIG. 9 is a drawing schematically showing a waveform of a signal inputted to the sharpening process section shown in FIG. 5. (*b*) of FIG. 9 is a drawing schematically showing a waveform obtained by enhancing, according to the prior art, the waveform of the signal shown in (*a*) of FIG. 9.

The signal shown in (*a*) of FIG. 9 is identical to the input signal Sin shown in (*a*) of FIG. 8. In order to enhance the input signal Sin shown in (*a*) of FIG. 9, a sharpening process using the linear operation uses a method in which a high-frequency signal is extracted from the input signal Sin shown in (*a*) of FIG. 9 and the input signal Sin is added to the high-frequency signal thus extracted. Therefore, a signal component which is not contained in the input signal Sin and exceeds the Nyquist frequency is not added in the conventional sharpening process using the linear operation.

Consequently, in the sharpening process based on linear operation, a signal shown in (*b*) of FIG. 9 is generated. Rising of the signal shown in (*b*) of FIG. 9 is sharper than rising of the input signal Sin shown in (*a*) of FIG. 9. However, rising of the non-liner process signal S12 ((*e*) of FIG. 8) generated by the sharpening process section 100*a* is further steeper.

(Configuration Example 2 of Sharpening Process Section)

The nonlinear process section 102*a* described above may differentiate the nonlinear signal S21 which is generated by the nonlinear operation section 21. This is because differentiation of the nonlinear signal S21 allows removal of a direct-current component contained in the nonlinear operation section 21.

Figure 10:
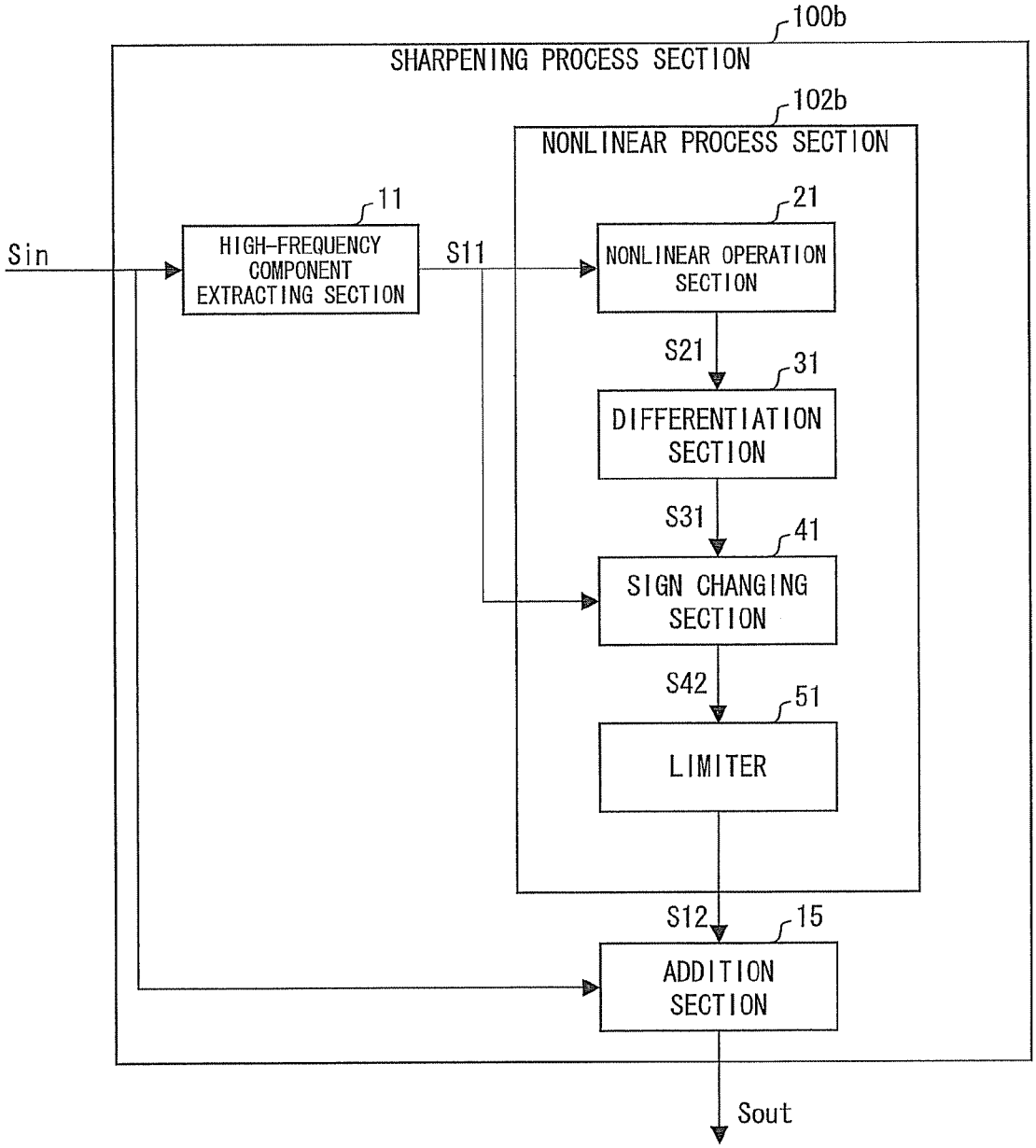
FIG. 10 is a block diagram showing another configuration of the sharpening process section of the present invention.

Therefore, a configuration example of the sharpening process section 100*b* is to be described with reference to FIG. 10. FIG. 10 is a block diagram illustrating a configuration of the sharpening process section 100*b*.

As shown in FIG. 10, the sharpening process section 100*b* includes a high-frequency component extracting section 11, a nonlinear process section 102*b*, and an addition section 15. The nonlinear process section 102*b* includes not only the configuration of the nonlinear process section 102*a* shown in FIG. 5 but also a differentiation section (differentiation means) 31 between the nonlinear operation section 21 and the sign changing section 41. The high-frequency component extracting section 11, members other than the differentiation section 31 in the nonlinear process section 102*b*, and the addition section 15 are the same as those explained above and therefore detailed explanations thereof are omitted here.

The differentiation section 31 differentiates the nonlinear signal S21 generated by the nonlinear operation section 21, thereby generating a differentiation signal S31.

Figure 11:
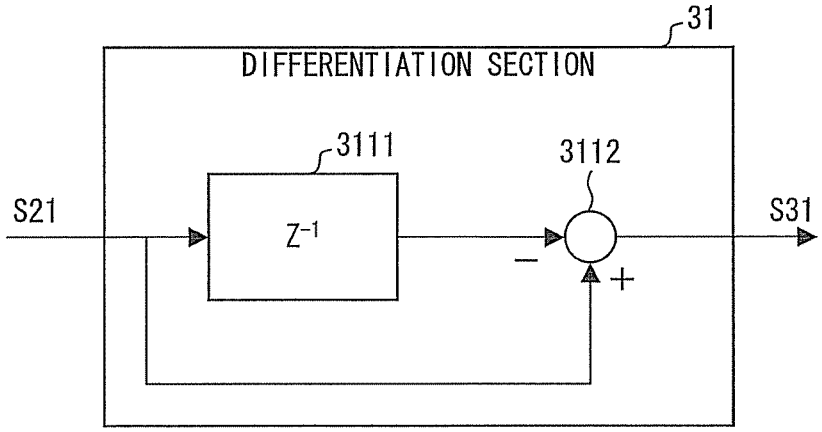
FIG. 11 is a block diagram showing a configuration of a differentiation section included in the sharpening process section shown in FIG. 10.

A configuration of the differentiation section 31 is to be described with reference to FIG. 11. FIG. 11 is a block diagram illustrating a configuration of the differentiation section 31. As shown in FIG. 11, the differentiation section 31 includes a unit delay element 3111 and a subtraction section 3112. The differentiation section 31 finds a backward difference with respect to a signal to be supplied to the differentiation section 31.

With respect to the differential signal S31 which has been generated by the differentiation section 31, in accordance with sign bit information on the high-frequency signal S11, the sign changing section 41 generates, as a sign change signal S42, a signal obtained by reflecting a sign of the high-frequency signal S11 in the nonlinear signal S21. Namely, the sign changing section 41 retains a sign of a part of the differential signal S31 which part is identical in sign to the high-frequency signal S11. In contrast, the sign changing section 41 reverses positive and negative signs of a part of the nonlinear signal S21 which part is different in sign from the high-frequency signal S11.

The limiter 51 carries out the amplitude adjustment process and the clip process with respect to the sign change signal S42 which is generated by the sign changing section 41, so as to generate the nonlinear process signal S12. According to the amplitude adjustment process, the sign change signal S42 is multiplied by a predetermined magnification value $\alpha$, to adjust an amplitude of the sign change signal S42.

Note that the nonlinear process section 102*b* may include no limiter 51 and not carry out the amplitude adjustment process and the clip process with respect to the sign change signal S42. In this case, the nonlinear process section 102*b* outputs, as the nonlinear process signal S12, the sign change signal S42 which is generated by the sign changing section 41.

(Waveform of Signal in Configuration Example 2)

Figure 12:
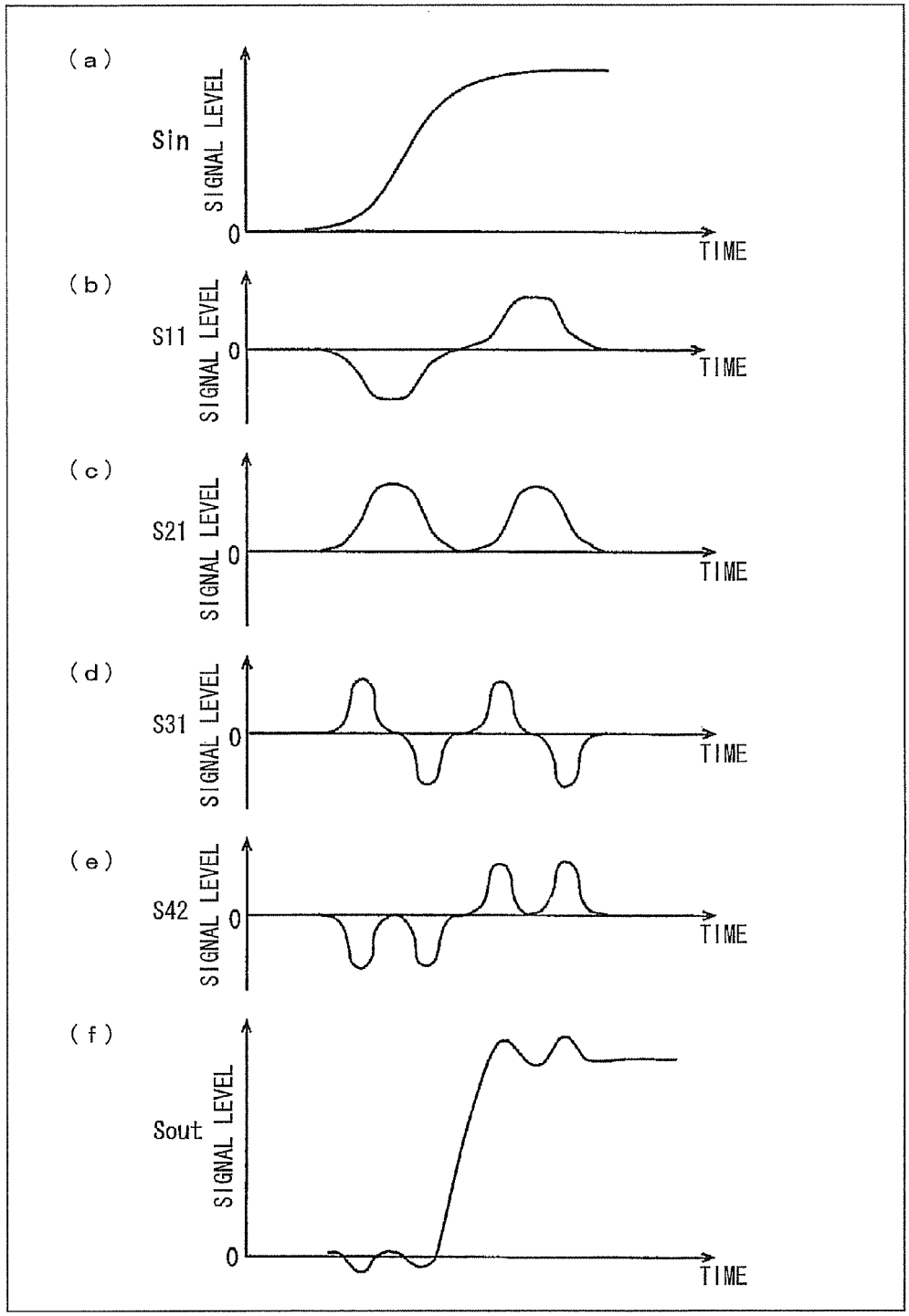
FIG. 12 (*a*) of FIG. 12 schematically shows a waveform of a signal inputted to the sharpening process section shown in FIG. 10. (*b*) of FIG. 12 schematically shows a waveform of a high-frequency signal generated in the sharpening process section shown in FIG. 10. (*c*) of FIG. 12 schematically shows a waveform of a nonlinear signal generated in the sharpening process section shown in FIG. 10. (*d*) of FIG. 12 schematically shows a waveform of a differentiation signal generated in the sharpening process section shown in FIG. 10. (*e*) of FIG. 12 schematically shows a waveform of a sign change signal generated in the sharpening process section shown in FIG. 10. (*f*) of FIG. 12 schematically shows a waveform of an output signal generated in the sharpening process section shown in FIG. 10.

The following explains waveforms of signals generated by sections of the waveform shaping device 100*b* with reference to (*a*) through (*f*) of FIG. 12. (*a*) through (*f*) of FIG. 12 schematically show waveforms of signals generated by sections of the sharpening process section 100*b*. Here, it is assumed that a signal shown in (*a*) of FIG. 12 is inputted as the input signal Sin to the sharpening process section 100*b*. The signal shown in (*a*) of FIG. 12 is the same as the signal shown in (*a*) of FIG. 8.

Initially, when the input signal Sin is inputted to the high-frequency component extracting section 11, a high-frequency component included in the input signal Sin is extracted so that the high-frequency signal S11 shown in (*b*) of FIG. 12 is generated.

Subsequently, when nonlinear operation carried out by the nonlinear operation section 21 of the nonlinear process section 102*b* is based on $f(x)=x^2$, the nonlinear signal S21 obtained by squaring the high-frequency signal S11 is generated by the nonlinear operation section 21 (see (*c*) of FIG. 12).

Subsequently, when the nonlinear signal S21 is inputted to the differentiation section 31, the differentiation signal S31 shown in (*d*) of FIG. 12 is generated. It should be noted that the differentiation signal S31 does not include a direct current component which has been included in the nonlinear signal S21.

Subsequently, when the differentiation signal S31 is inputted into the sign changing section 41, the sign change signal S42 shown in (*e*) of FIG. 12 is generated. As shown in (*e*) of FIG. 12, the sign change signal S42 has the same positive and negative signs as those of the high-frequency signal S11 shown in (*b*) of FIG. 12.

Subsequently, when the sign change signal S41 is inputted to the limiter 51, the amplitude adjustment process and the clipping process are carried out, to generate the nonlinear process signal S12. Lastly, the addition section 15 adds the nonlinear process signal S12 to the input signal Sin, thereby generating the output signal Sout (see (*f*) of FIG. 12).

Rising and falling of the output signal Sout shown in (f) of FIG. 12 are steeper than those of a signal sharpened based on linear operation.

(Configuration Example 3 of Sharpening Process Section)

The nonlinear process section 102*a* and the nonlinear process section 102*b* explained above include the sign changing section 41. Alternatively, the nonlinear process section of the present invention may be arranged not to include the sign changing section 41 as long as the nonlinear operation carried out on the high-frequency signal S11 retains the positive and negative signs of the high-frequency signal S11.

Figure 13:
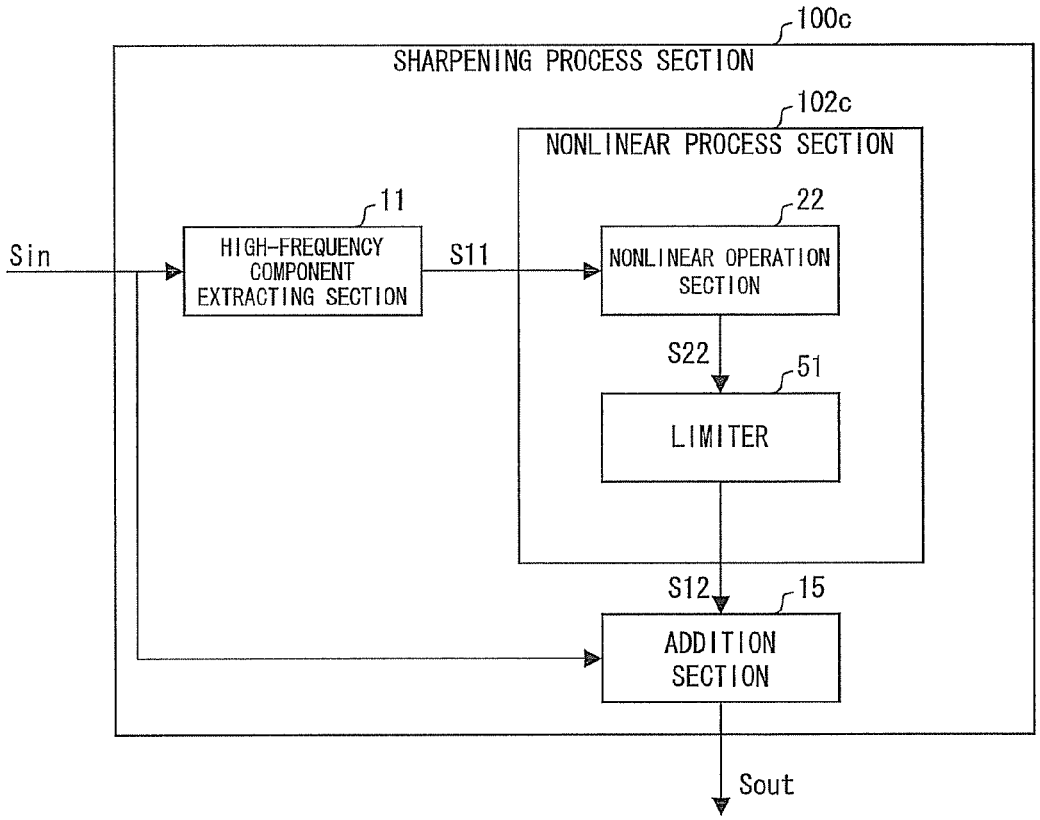
FIG. 13 is a block diagram showing yet another configuration of the sharpening process section included in the encoding device of the present invention.

With reference to FIG. 13, the following explains a configuration example of a sharpening process section 100*c* which does not include the sign changing section 41. FIG. 13 is a block diagram showing a configuration of the sharpening process section 100*c*.

As shown in FIG. 13, the sharpening process section 100*c* includes a high-frequency component extracting section 11, a nonlinear process section 102*c*, and an addition section 15. The nonlinear process section 102*c* includes a nonlinear operation section (odd exponentiation operation means) 22 and a limiter 51. The high-frequency component extracting section 11, the limiter 51, and the addition section 15 are the same as those explained above and detailed explanations thereof are omitted here.

The nonlinear operation section 22 carries out nonlinear operation on the high-frequency signal S11, thereby generating a nonlinear signal S22.

The nonlinear operation which is carried out by the nonlinear operation section 22 is described here. The following description denotes a signal value to be supplied to the nonlinear operation section 22 as x, denotes a signal value to be supplied from the nonlinear operation section 22 as y, and expresses the nonlinear operation which is carried out by the nonlinear operation section 22 as a function y=g(x).

Assume here that the function g(x) is a nonlinear monotone increasing function which monotonically increases so as to be in positive and negative symmetry (origin symmetry). Note that "monotone increasing" means broad monotone increasing. However, it is only necessary that the function g(x) monotonically increases at least in the vicinity of x="0". It is preferable that the function g(x) be |g(x)|>|x| at least in the vicinity of x="0".

Such a function g(x) is exemplified by that expressed as the following expression (7).

Math. 7

$$g(x)=x^{3n}(n \text{ is a natural number}) \tag{7}$$

In a case in which the expression (7) is used as the function g (x), the nonlinear operation section 22 raises the high-frequency signal S11 to an odd exponent not less than 3, so as to generate the nonlinear signal S22. For example, in a case in which n=1 (i.e., $g(x)=x^3$) in the expression (7), the nonlinear operation section 22 cubes the high-frequency signal S11, so as to generate the nonlinear signal S22. Assuming in this case that data rows constituting the high-frequency signal S11 are X1, X2, X3, . . . , the nonlinear signal S22 obtained by cubing the high-frequency signal S11 becomes a digital signal constituted by data rows $X1^3$, $X2^3$, and $X3^3$, . . . .

The limiter 51 carries out the amplitude adjustment process and the clip process to the nonlinear signal S22 generated by the nonlinear operation section 22, so as to generate the nonlinear process signal S12.

Note that the nonlinear process section 102*c* may include no limiter 51 that carries out the amplitude adjustment process and the clip process to the nonlinear signal S22. In this case, the nonlinear process section 102*c* outputs, as the nonlinear process signal S12, the nonlinear signal S22 which is generated by the nonlinear operation section 22.

(Waveform of Signal in Configuration Example 3)

Figure 14:
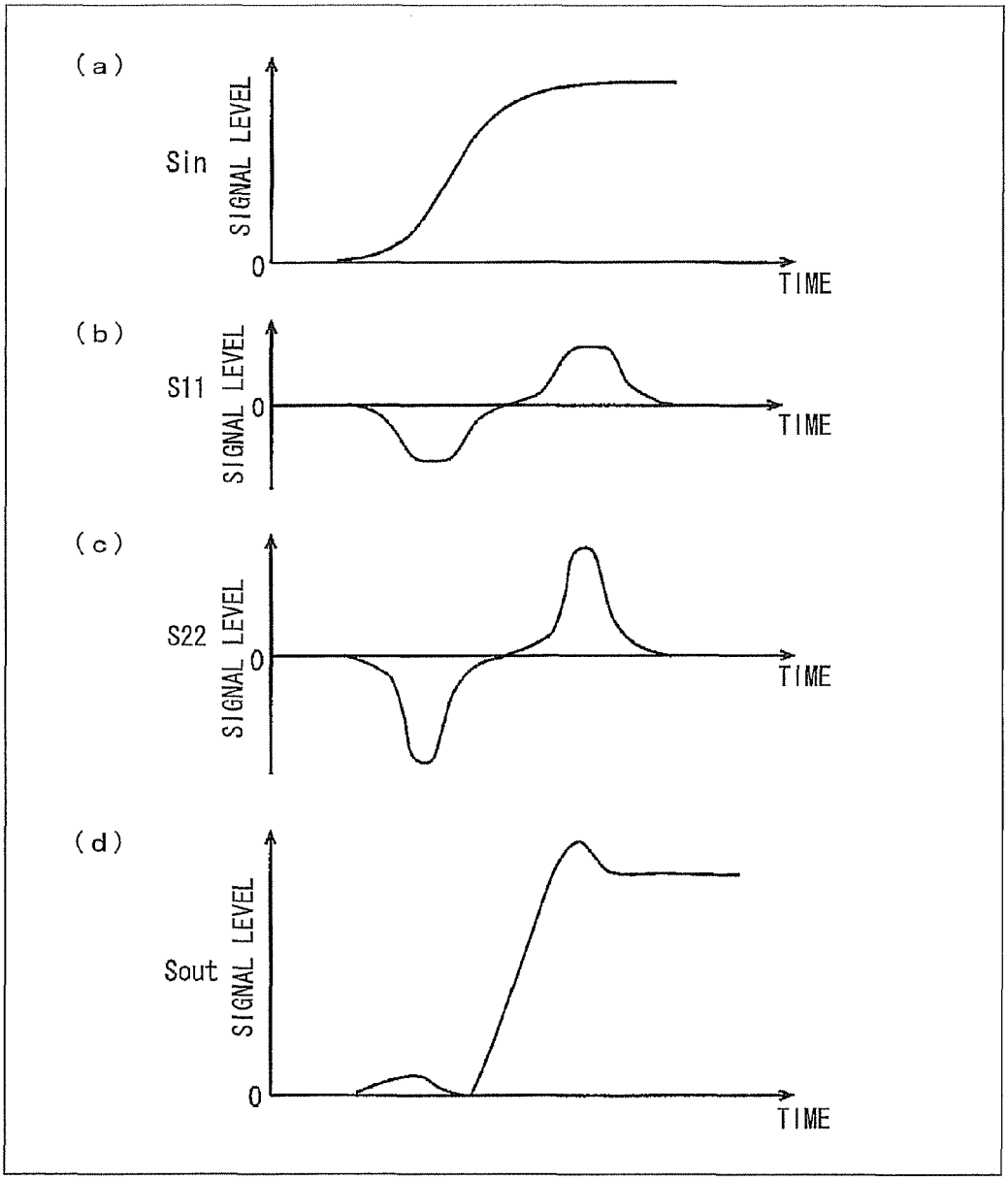
FIG. 14 (*a*) of FIG. 14 schematically shows a waveform of a signal inputted to the sharpening process section shown in FIG. 13. (*b*) of FIG. 14 schematically shows a waveform of a high-frequency signal generated in the sharpening process section of FIG. 13. (*c*) of FIG. 14 schematically shows a waveform of a nonlinear signal generated in the sharpening process section shown in FIG. 13. (*d*) of FIG. 14 schematically shows a waveform of an output signal generated in the sharpening process section shown in FIG. 13.

The following explains waveforms of signals generated by sections of the sharpening process section 100*c* with reference to (*a*) through (*d*) of FIG. 14. (*a*) through (*d*) of FIG. 14 schematically show waveforms of the signals generated by sections of the sharpening process section 100*c*. Here, it is assumed that a signal shown in (*a*) of FIG. 14 is inputted to the sharpening process section 100*c* as the input signal Sin. The signal shown in (*a*) of FIG. 14 is the same as the signal shown in (*a*) of FIG. 8.

Initially, when the input signal Sin is inputted to the high-frequency component extracting section 11, a high-frequency component included in the input signal Sin is extracted so that the high-frequency signal S11 shown in (*b*) of FIG. 14 is generated.

Subsequently, when nonlinear operation carried out by the nonlinear operation section 22 is $f(x)=x^3$, the nonlinear signal S22 obtained by raising the high-frequency signal S11 to the power of three is generated by the nonlinear operation section 22 (see (*c*) of FIG. 14).

Subsequently, when the nonlinear signal S22 is inputted to the limiter 51, the amplitude regulating process and the clipping process are carried out, to generate the nonlinear process signal S12. Lastly, the addition section 15 adds the nonlinear process signal S12 to the input signal Sin, thereby generating the output signal Sout (see (*d*) of FIG. 14).

Rising and falling of the output signal Sout shown in (d) of FIG. 14 are steeper than those of a signal sharpened based on linear operation.

(Reason why Frequency Higher than Nyquist Frequency is Generated)

The following explains why the output signal Sout generated by the sharpening process section 100 includes a high-frequency component higher than Nyquist frequency fs/2, such as a harmonic wave component included in the input signal Sin.

Here, it is assumed that the input signal Sin is represented by a function F(x) where x represents time. When a base angular frequency of the input signal Sin is ω, the function F(x) can be represented by formula (8) below which is a Fourier series.

Math. 8

$$\begin{aligned}F(x)=&a_{-N}\cos(-N)\omega x+a_{-N+1}\cos(-N+1)\omega x+\ldots+a_{-1}\\&\cos(-1)\omega x+a_0+a_1\cos\omega x+a_2\cos 2\omega x+\ldots+a_N\\&\cos N\omega x+b_{-N}\sin(-N)\omega x+b_{-N+1}\sin(-\\&N+1)\omega x+\ldots+b_{-1}\sin(-1)\omega x+b_1\sin\omega x+b_2\sin\\&2\omega x+\ldots+b_N\sin N\omega x\end{aligned} \tag{8}$$

In the expression (8), N is a degree of a higher harmonic wave having a maximum frequency which does not exceed the Nyquist frequency fs/2 with respect to the sampling frequency fs. Namely, the following expression (9) is met.

Math. 9

$$N\omega/(2\pi)<fs/2\leq(N+1)\omega/(2\pi) \tag{9}$$

Next, in a case in which a signal of the input signal Sin expressed as the function F(x) other than a direct-current component $a_0$ is denoted as G(x), G(x) is expressed as the following expression (10).

Math. 10

$$\begin{aligned}G(x)=&a_{-N}\cos(-N)\omega x+a_{-N+1}\cos(-N+1)\omega x+\ldots+a_{-1}\\&\cos(-1)\omega x+a_1\cos\omega x+a_2\cos 2\omega x+\ldots+a_N\cos\\&N\omega x+b_{-N}\sin(-N)\omega x+b_{-N+1}\sin(-N+\\&1)\omega x+\ldots+b_{-1}\sin(-1)\omega x+b_1\sin\omega x+b_2\\&\sin 2\omega x+\ldots+b_N\sin N\omega x\end{aligned} \tag{10}$$

Here, the input signal Sin inputted into the sharpening process section 100 includes a signal G(x) or a high-frequency component of the signal G(x).

For example, in a case in which the nonlinear operation section 21 carries out the nonlinear operation of $f(x)=x^2$, the nonlinear operation section 21 generates the nonlinear signal S21 by squaring the high-frequency signal S11. Note here that each term of $(G(x))^2$ is expressed as any of the following expressions (11) through (13) based on the expression (10) (i=±1, ±2, . . . , ±N; j=±1, ±2, . . . , ±N).

Math. 11

$$a_i \cos i\omega x \cdot a_j \cos j\omega x \quad (11)$$

Math. 12

$$a_i \cos i\omega x \cdot b_j \sin j\omega x \quad (12)$$

Math. 13

$$b_i \sin i\omega x \cdot b_j \sin j\omega x \quad (13)$$

Note here that the expressions (11) through (13) can be rewritten to the following respective expressions (14) through (16) by use of trigonometric formulae.

Math. 14

$$(a_i a_j/2)\{\cos(i+j)\omega x+\cos(i-j)\omega x\} \quad (14)$$

Math. 15

$$(a_i b_j/2)\{\sin(i+j)\omega x-\sin(i-j)\omega x\} \quad (15)$$

Math. 16

$$(-b_i b_j/2)\{\cos(i+j)\omega x-\cos(i-j)\omega x\} \quad (16)$$

$(G(x))^2$ contains angular frequency components such as (N+1)ω, (N+2)ω, . . . , and 2Nω (see expressions (14) through (16)).

Accordingly, $(G(x))^2$ contains a frequency component which is higher than the Nyquist frequency fs/2. Namely, the nonlinear signal S21 which is generated by the nonlinear operation section 21 contains a frequency component which is higher than the Nyquist frequency fs/2 such as a harmonic component having a frequency of 2Nω/(2π).

Similarly, for example, in a case in which the nonlinear operation section 22 carries out the nonlinear operation of $f(x)=x^3$, the nonlinear operation section 22 generates the nonlinear signal S22 by cubing the high-frequency signal S11. Note here that each term of $(G(x))^3$ is expressed as any of the following expressions (17) through (20) based on the expression (10) (i=±1, ±2, . . . , ±N; j=±1, ±2, . . . , ±N).

Math. 17

$$a_i \cos i\omega x \cdot a_j \cos j\omega x \cdot a_k \cos k\omega x \quad (17)$$

Math. 18

$$a_i \cos i\omega x \cdot a_j \cos j\omega x \cdot b_k \sin k\omega x \quad (18)$$

Math. 19

$$a_i \cos i\omega x \cdot b_j \sin j\omega x \cdot b_k \sin k\omega x \quad (19)$$

Math. 20

$$b_i \sin i\omega x \cdot b_j \sin j\omega x \cdot b_k \sin k\omega x \quad (20)$$

Note here that, in a case in which attention is paid to terms in which i=j=k=N and which are expressed as the expressions (17) and (20), these terms can be rewritten to the following respective expressions (21) and (22) by use of trigonometric formulae.

Math. 21

$$(a_N \cos N\omega x)^3=a_N^3\{(3/4)\cos N\omega x+(1/4)\cos 3N\omega x\} \quad (21)$$

Math. 22

$$(b_N \sin N\omega x)^3=b_N^3\{(3/4)\sin N\omega x-(1/4)\sin 3N\omega x\} \quad (22)$$

Moreover, for example, in a case in which attention is paid to terms in which i=j=k=−N and which are expressed as the expressions (17) and (20), these terms can be rewritten to the following respective expressions (23) and (24) by use of trigonometric formulae.

Math. 23

$$\{a_N \cos(-N\omega x)\}^3=a_N^3\{(3/4)\cos(-N\omega x)+(1/4)\cos(-3N\omega x)\} \quad (23)$$

Math. 24

$$\{b_N \sin(-N\omega x)\}^3=b_N^3\{(3/4)\sin(-N\omega x)-(1/4)\sin(-3N\omega x)\} \quad (24)$$

$(G(x))^3$ contains a frequency component which is 3N times a base angular frequency ω and a frequency component which is −3N times the base angular frequency ω (see the expressions (21) through (24)). The expressions (21) through (24) show that, in a case in which the other terms of $(G(x))^3$ are rewritten by use of trigonometric formulae, $(G(x))^3$ contains various frequency components which range from 3N times to −3N times the base angular frequency ω.

Accordingly, $(G(x))^3$ contains a frequency component which is higher than the Nyquist frequency fs/2. Namely, the nonlinear signal S22 which is generated by the nonlinear operation section 22 contains a frequency component which is higher than the Nyquist frequency fs/2 such as a harmonic component having a frequency of 3Nω/(2π).

As described above, the output signal Sout generated by the sharpening process section 100 includes a high frequency component which is not included in the input signal Sin, i.e. a frequency component whose frequencies are higher than the Nyquist frequency.

(Another Configuration Example 1 of Sharpening Process Section)

Figure 15:
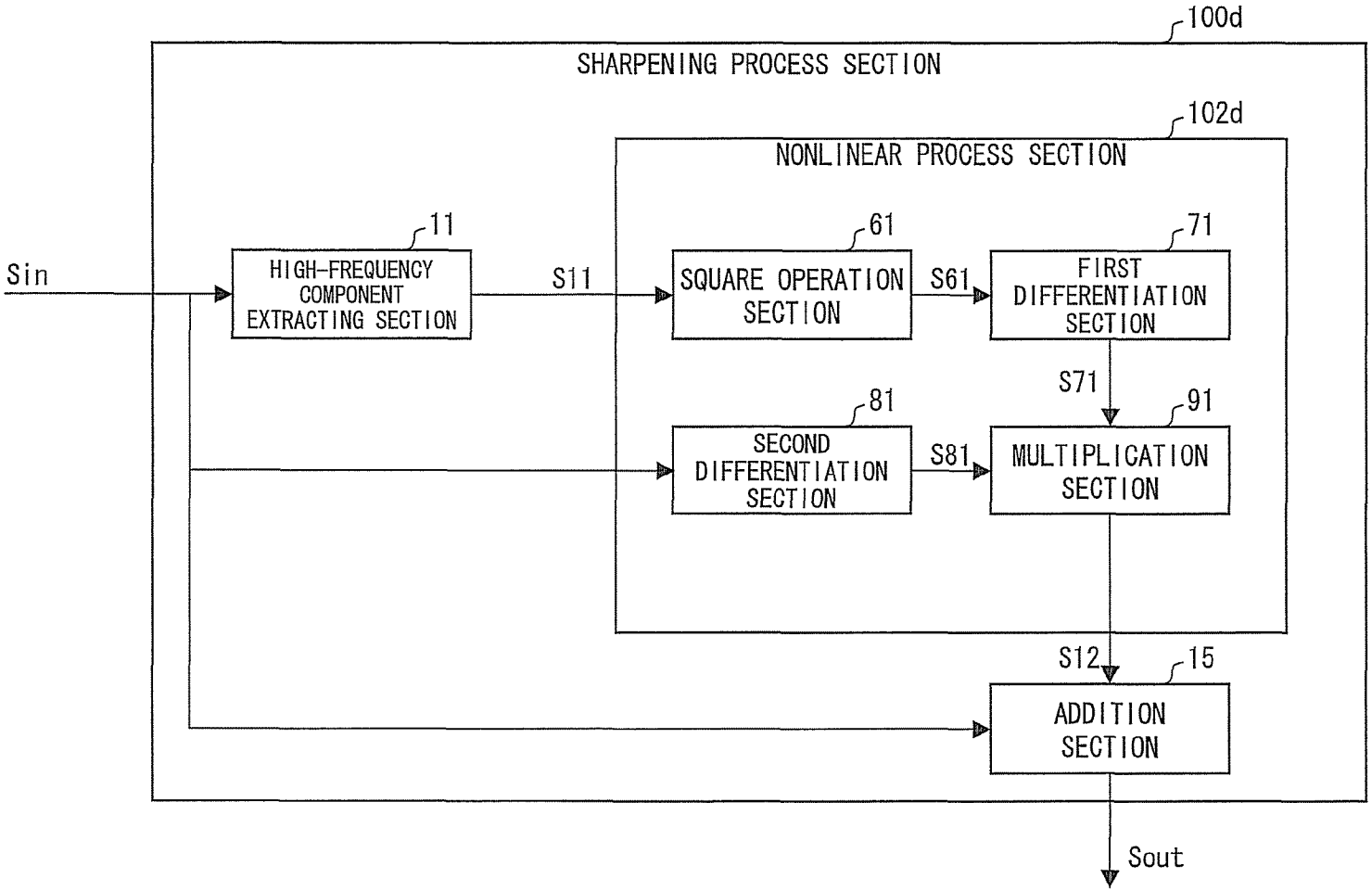
FIG. 15 is a block diagram showing yet another configuration of the sharpening process section included in an encoding device of the present invention.
Figure 16:
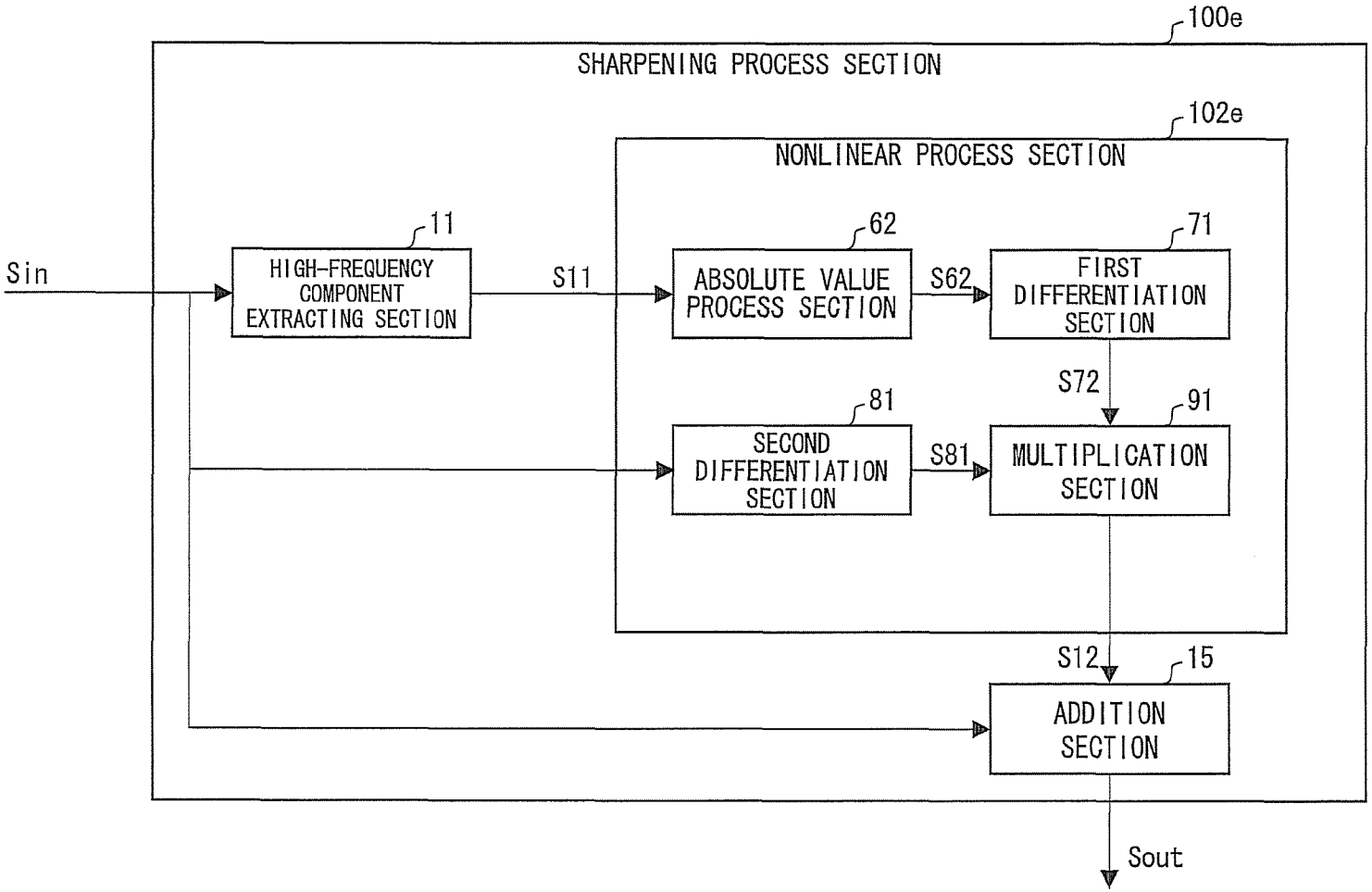
FIG. 16 is a block diagram showing yet another configuration of the sharpening process section included in an encoding device of the present invention.

There are many kinds of nonlinear operations carried out by the sharpening process section 100 other than those explained above. With reference to FIGS. 15 and 16, the following explains configuration examples of a sharpening process section 100*d* and a sharpening process section 100*e*.

Initially, FIG. 15 is a block diagram showing a configuration of the sharpening process section 100*d*. As shown in FIG. 15, the sharpening process section 100*d* includes a high frequency component extracting section 11, a nonlinear process section 102*d*, and an addition section 15. The high-frequency component extracting section 11 and the addition section 15 are the same as those explained above and thus detailed explanations thereof are omitted here.

The nonlinear process section 102*d* includes a square operation section 61, a first differentiation section 71, a second differentiation section 81, and a multiplication section 91.

The square operation section 61 squares the high-frequency signal S11, thereby generating a square signal S61. That is, when data rows constituting the high-frequency signal S11 are X1, X2, X3, . . . , the square signal S61 obtained by squaring the high-frequency signal S11 is a digital signal constituted by data rows $X1^2$, $X2^2$, $X3^2$, . . . .

Subsequently, the first differentiation section 71 differentiates the square signal S61 generated by the square operation section 61, thereby generating a first differentiation signal S71. The configuration of the first differentiation section 71 is the same as that of the differentiation section 31 for example.

Subsequently, the second differentiation section 81 differentiates the input signal Sin, thereby generating a second differentiation signal S81. The configuration of the second differentiation section 81 is the same as that of the differentiation section 31 for example.

Subsequently, the multiplication section 91 multiplies the first differentiation signal S71 with the second differentiation signal S81, thereby generating a nonlinear process signal S12. That is, when data rows constituting the first differentiation signal S71 are U1, U2, U3, . . . and data rows constituting the second differentiation signal S81 are V1, V2, V3, . . . , the nonlinear process signal S12 is a digital signal constituted by data rows U1·V1, U2·V2, U3·V3, . . . .

In the configuration explained above, there is provided the square operation section 61 in order to carry out nonlinear operation. Alternatively, there may be used a fourth power operation section which raises the high-frequency signal S11 to the fourth power. More generally, there may be used an exponentiation operation section which generates a signal obtained by raising the high-frequency signal S11 to an even exponent not less than 2.

(Another Configuration Example 2 of Sharpening Process Section)

The sharpening process section 100*d* explained above includes the square operation section 61. Alternatively, the sharpening process section may include, instead of the square operation section 61, an absolute value process section 62 which calculates the absolute value of an input signal.

Accordingly, with reference to FIG. 16, the following explains a sharpening process section 100*e* including the absolute value process section 62. FIG. 16 is a block diagram showing a configuration of the sharpening process section 100*e*.

As shown in FIG. 16, the sharpening process section 100*e* includes a high frequency component extracting section 11, a nonlinear process section 102*e*, and an addition section 15. The high-frequency component extracting section 11 and the addition section 15 are the same as those explained above, and thus detailed explanations thereof are omitted here.

The nonlinear process section 102*e* includes the absolute value process section 62, a first differentiation section 71, a second differentiation section 81, and a multiplication section 91. The first differentiation section 71, the second differentiation section 81, and the multiplication section 91 are the same as those explained above, and thus detailed explanations thereof are omitted here.

The absolute value process section 62 generates an absolute value signal S62 which is a signal whose values correspond to absolute values of the high-frequency signal S11. That is, when data rows constituting the high-frequency signal S11 are X1, X2, X3, . . . , the absolute value signal S62 is a digital signal constituted by data rows |X1|, |X2|, |X3|, . . . .

Subsequently, the first differentiation section 71 differentiates the absolute value signal S62 generated by the absolute value process section 62, thereby generating a first differentiation signal S72.

Subsequently, the multiplication section 91 multiplies the first differentiation signal S72 with the second differentiation signal S81, thereby generating a nonlinear process signal S12.

Embodiment 2

The encoding device 200*a* described in Embodiment 1 is of a configuration in which the encoded signal S220 is outputted by encoding, in the encoding process section 220, just the high-frequency-free signal S210 in which the high frequency component of the original signal SR is removed. In the decoding process section 310 of the decoding device 300*a*, the decoding process is carried out based on just the encoded signal S220; the reconstructed image thus indicated by the decoded signal S310 outputted from the decoding process section 310 inevitably becomes deteriorated as compared to the original image indicated by the original signal SR.

In a case in which a degree of reducing the transmission rate of the signal to be transmitted through the transmission path 700 is allowed to be decreased in degree, the configuration may be designed to encode the original signal SR instead of the high-frequency-free signal S210 every predetermined period, in order to minimize the deterioration of the reconstructed image. For example, the configuration may be one in which the original signal SR is encoded one frame per several frames.

The present embodiment describes a mode in which the original signal SR is encoded instead of the high-frequency-free signal S210, every predetermined period on the sending side.

Described below is an embodiment of the present invention, with reference to FIG. 17 to FIG. 19. The encoding device 200 according to the present embodiment is referred to as an encoding device 200*c*. Moreover, the decoding device 300 according to the present embodiment is referred to as a decoding device 300*c*.

For easy explanation, members having identical functions as the members shown in Embodiment 1 are provided with identical reference signs, and their descriptions are omitted unless particularly required.

(Configuration of Encoding Device and Decoding Device)

Figure 17:
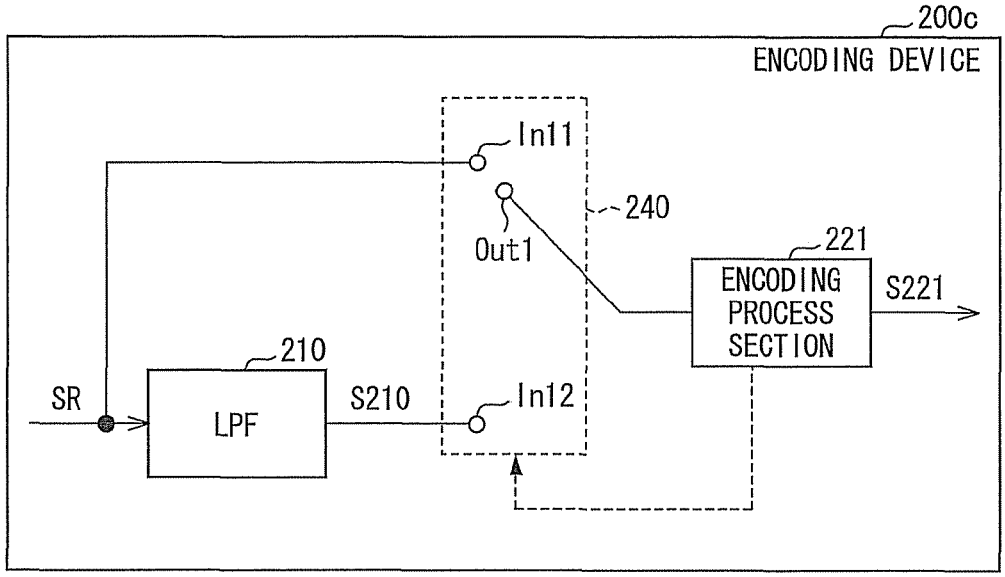
FIG. 17 is a block diagram showing another configuration of an encoding device of the present invention.
Figure 18:
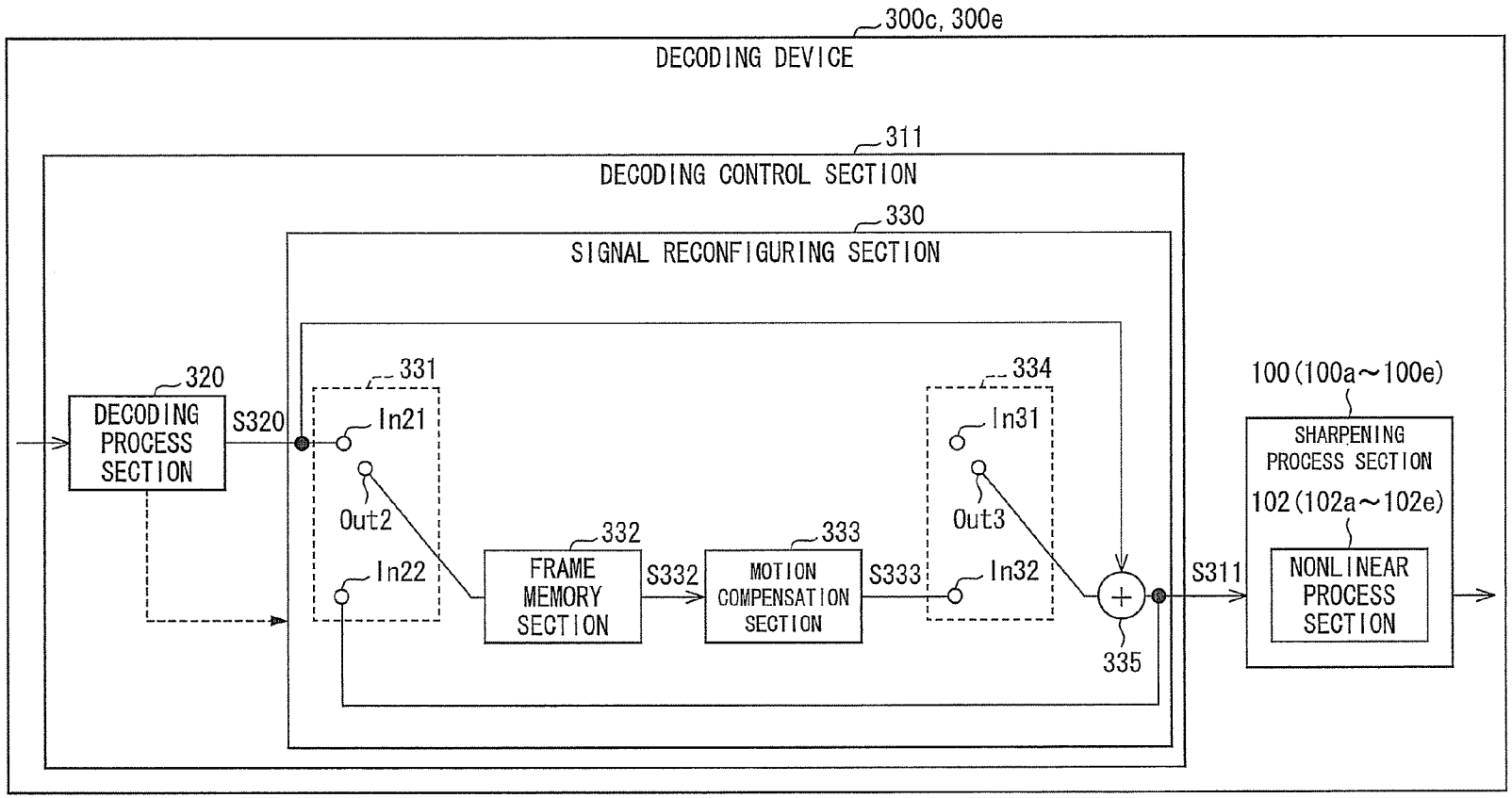
FIG. 18 is a block diagram showing a configuration of a decoding device of the present invention.

The following description explains configuration examples of the encoding device 200*c* and the decoding device 300*c*, with reference to FIG. 17 and FIG. 18. FIG. 17 and FIG. 18 are block diagrams showing configuration examples of the encoding device 200*c* and the decoding device 300*c*, respectively.

First described is the configuration of the encoding device 200*c*. As shown in FIG. 17, the encoding device 200*c* includes an LPF 210, a signal switching section 240, and an encoding process section (encoding means) 221.

The signal switching section 240 is a switch that switches a connection of a signal line to which input is provided to the encoding process section 221. The signal switching section 240, depending on an instruction from the encoding process section 221, switches between whether to connect a connection point Out1 with a connection point In11 or with a connection point In12. In the present embodiment, when the connection point Out1 connects with the connection point In12, the high-frequency-free signal S210 is inputted into the encoding process section 221, whereas when the connection point Out1 is connected with the connection point In11, the original signal SR is inputted into the encoding process section 221.

The encoding process section 221 encodes a signal received via the signal switching section 240. The signal outputted from the encoding process section 221 is referred to as an encoded signal S221. In the present embodiment, the encoded signal S221 includes a signal in which the original signal SR is encoded and a signal in which the high-frequency-free signal S210 is encoded.

The encoding process section 221 and a decoding process section 320 later described serve as a pair, and the encoding process section 221 is designed so as to output the encoded signal S221 that is decodable by the decoding process section 320.

Moreover, in the case in which a video image is to be encoded, the encoding process section 221 carries out compression encoding, by use of the commonly known inter-frame predictive coding (encoding step). Furthermore, the encoding process section 221 makes a motion vector, used for the decoding process section 320 to carry out motion compensation, be included in the encoded signal S221, and outputs such an encoded signal S221.

Furthermore, the encoding process section 221 instructs the signal switching section 240 with which of the connection point In11 and connection point In12 the connection point Out1 is to be connected. More specifically, the encoding process section 221 usually instructs to connect the connection point Out1 with the connection point In12, whereas the encoding process section 221 instructs to connect the connection point Out1 with the connection point In11 every predetermined period (hereinafter, predetermined period T1).

The predetermined period T1 is set as appropriate in accordance with encoding efficiency and image quality of the reconstructed image. In the present embodiment, for example when the encoding efficiency is to be improved, the predetermined period T1 is set so that frames in which the high-frequency-free signal S210 is encoded is large in number and frames in which the original signal SR is encoded is small in number (one example is, for every predetermined several hundred frames in which the high-frequency-free signal S210 is encoded, a subsequent one frame encodes the original signal SR).

On the other hand, in a case in which the image quality of the reconstructed image is given weight, the predetermined period T1 is sufficiently set so that the number of frames in which the original signal SR is encoded is large in number (one example is, every time a predetermined several frames of the high-frequency-free signal S210 is encoded, the subsequent one frame has the original signal SR be encoded therein).

The encoding process section 221 multiplexes, to the encoded signal S221, information (hereinafter, referred to as encoding information E1) indicative of whether or not the encoded signal S221 encodes a signal inputted via the connection point In11 of the signal switching section 240 (hereinafter, referred to as input signal A11) or encodes a signal inputted via the connection point In12 (hereinafter, referred to as input signal A12). In the present embodiment, the input signal A11 is the original signal SR, and the input signal A12 is the high-frequency-free signal S210.

Next described is the configuration of the decoding device 300*c*. The decoding device 300*c*, as shown in FIG. 18, includes a decoding control section (decoding means) 311 and a sharpening process section 100.

First described is the decoding control section 311. The decoding control section 311 includes a decoding process section 320 and a signal reconfiguring section 330. The signal outputted from the decoding control section 311 is referred to as a decoding result signal (decoded signal) S311. The decoding result signal S311 is a signal indicative of a reconstructed image that corresponds to the original image.

As described above, the decoding process section 320 decodes the encoded signal S221 outputted from the encoding process section 221 (decoding step). When a video is to be decoded, the decoding process section 320 carries out inter-frame prediction with use of the motion vector included in the encoded signal S221, to carry out motion compensation thereof.

A signal outputted from the decoding process section 320 is referred to as a decoded signal S320. As described above, in the present embodiment, the encoded signal S221 includes the signal in which the original signal SR is encoded and the signal in which the high-frequency-free signal S210 is encoded. Hence, the decoded signal S320 includes a signal in which the signal in which the original signal SR is encoded is decoded (hereinafter referred to as decoded original signal) and a signal in which the signal in which the high-frequency-free signal S210 is encoded is decoded (hereinafter, referred to as decoded high-frequency-free signal).

Furthermore, the decoding process section 320 instructs, to a first signal switching section 331 (later described) included in the signal reconfiguring section 330, whether to connect the connection point Out2 with a connection point In21 or with a connection point In22. Moreover, the decoding process section 320 instructs, to a second signal switching section 334 (later described), whether to connect a connection point Out3 with a connection point In31 or with a connection point In32.

More specifically, the decoding process section 320 initially extracts the encoding information E1 included in the encoded signal S221. In a case in which the encoding information E1 indicates that the encoded signal S221 is a signal in which the input signal A11 (i.e. original signal SR) is encoded, the decoding process section 320 instructs the first signal switching section 331 to connect the connection point Out2 with the connection point In21, and instructs the second signal switching section 334 to connect the connection point Out3 with the connection point In31.

On the other hand, in a case in which the encoding information E1 indicates that the encoded signal S221 is a signal in which the input signal A12 (i.e. high-frequency-free signal S210) is encoded, the decoding process section 320 instructs the first signal switching section 331 to connect the connection point Out2 with the connection point In22, and instructs the second signal switching section 334 to connect the connection point Out3 with the connection point In32.

Next described is the signal reconfiguring section 330. The signal reconfiguring section 330, in brief, outputs a decoding result signal (decoded signal) S311 indicative of a reconstructed image, on the basis of the decoded original signal and the decoded high-frequency-free signal each included in the decoded signal S320. More specifically, in the present embodiment, when the decoded signal S320 is the decoded original signal, the decoded original signal is outputted as it is, as the decoding result signal S311. On the other hand, when the decoded signal S320 is the decoded high-frequency-free signal, the decoded high-frequency-free signal is added to a signal of a decoding result signal S311, corresponding to a frame immediately before, having been subjected to motion compensation, to output a decoding result signal S311 that corresponds to a latest frame.

In order to carry out the foregoing process, the signal reconfiguring section 330 includes a first signal switching section 331, a frame memory section 332, a motion compensation section 333, a second signal switching section 334, and an addition section 335.

The first signal switching section 331 is a switch for switching over a connection of a signal line from which input is provided to the frame memory section 332. The first signal switching section 331, in response to an instruction from the decoding process section 320, switches over between the connection point Out2 being connected to the connection point In21 or being connected to the connection point In22. When the connection point Out2 is connected to the connection point In21, the frame memory section 332 receives the decoded signal S320, whereas when the connection point Out2 is connected to the connection point In22, the frame memory section 332 receives the decoding result signal S311.

The connection point Out2 is connected with the connection point In21 when the encoding information E1 extracted by the decoding process section 320 indicates that the encoded signal is a signal in which the input signal A11 (i.e. original signal SR) is encoded, and the decoding process section 320 outputs the decoded original signal as the decoded signal S320. Hence, when the connection point Out2 is connected with the connection point In21, the decoded original signal is received by the frame memory section 332.

The frame memory section 332 holds one frame worth of the signal received via the first signal switching section 331. Hence, the frame memory section 332 holds one frame worth of one of the decoded original signal and the decoding result signal S311. Furthermore, the frame memory section 332 outputs the signal thus held to the motion compensation section 333, frame by frame. The signal outputted from the frame memory section 332 is referred to as a memory signal S332.

The motion compensation section 333 carries out motion compensation based on a motion vector to a frame immediately before, which frame is indicated by the memory signal S332, to calculate a latest frame. The motion vector used for the motion compensation is the motion vector used for the motion compensation carried out in the decoding process section 320, which motion vector is received from the decoding process section 320. Hence, the motion compensation section 333 includes, as appropriate, a delay element which adjusts a timing between the memory signal S332 and the motion vector received from the decoding process section 320. A signal outputted from the motion compensation section 333 is referred to as a motion compensation signal S333.

The second signal switching section 334 is a switch that switches a connection of a signal line from which input is provided to the addition section 335. The second signal switching section 334, in response to an instruction from the decoding process section 320, switches the connection of the connection point Out3 between a connection with the connection point In31 or a connection with the connection point In32. In the present embodiment, the motion compensation signal S333 is inputted to the addition section 335 when the connection point Out3 is connected to the connection point In32, whereas when the connection point Out3 is connected to the connection point In31, nothing is inputted into the addition section 335.

The addition section 335 adds a signal received from the second signal switching section 334 to the decoded signal S320, to output the decoding result signal S311. Accordingly, when the connection point Out3 is connected with the connection point In32 in the second signal switching section 334, the decoded signal S320 is added to the motion compensation signal S333, to output the decoding result signal S311. On the other hand, when the connection point Out3 is connected with the connection point In31 in the second signal switching section 334, the decoded signal S320 is outputted as it is, as the decoding result signal S311.

The addition section 335 includes a delay element as appropriate, for adjusting a timing between a signal received from the second signal switching section 334 and the decoded signal S320.

As from the configuration described above, in the present embodiment, the decoding control section 311 exhibits as follows: (1) when the encoding information E1 indicates that the encoded signal S221 is a signal in which the input signal A11 (i.e. original signal SR) is encoded, the decoding control section 311 (i) outputs a decoded original signal as the decoded signal S320, (ii) holds the decoded original signal in the frame memory section 332 via the first signal switching section 331, and (iii) outputs the decoded original signal as the decoding result signal S311 via the addition section 335; (2) on the other hand, when the encoding information E1 indicates that the encoded signal S221 is a signal in which the input signal A12 (i.e. high-frequency-free signal S210) is encoded, the decoding control section 311 (i) outputs a decoded high-frequency-free signal as the decoded signal S320, and (ii) outputs a decoding result signal S311 by adding a motion compensation signal S333 generated by carrying out motion compensation to the memory signal S332 outputted from the frame memory section 332 in the motion compensation section 333, to the decoded high-frequency-free signal, at the addition section 335. Thereafter, in order to have the decoding result signal S311 be subjected to the motion compensation in the motion compensation section 333 subsequently, the decoding result signal S311 is held in the frame memory section 332 via the first signal switching section 331.

By repeating the foregoing processes, the decoding control section 311 outputs the decoding result signal S311 indicative of a reconstructed image that corresponds to the original image.

Finally, the decoding device 300*c* is a configuration in which the sharpening process section 100 is provided subsequently to the decoding control section 311, and the decoding result signal S311 outputted from the decoding control section 311 serves as a signal input of the sharpening process section 100. Therefore, the decoding device 300*c* carries out a sharpening process to the decoding result signal S311 in the sharpening process section 100 based on nonlinear operation. That is to say, the sharpening process section 100 of the decoding device 300*c* sharpens a reconstructed image indicated by the decoding result signal S311.

(Effect Attained by Foregoing Configuration)

The encoding device 200*c* encodes the original signal SR instead of the high-frequency-free signal S210 per predetermined period. The decoding device 300*c* outputs, by the decoding control section 311, a signal in which a decoded high-frequency-free signal is added to a signal in which a signal indicative of a frame immediately before is subjected to motion compensation, as the decoding result signal S311, and further outputs, every predetermination period, the decoded original signal as it is, as the decoding result signal S311. Hence, the decoding device 300*c* can reduce the deterioration in the reconstructed image more than the encoding device 200*a* described in Embodiment 1. In particular, the decoding device 300*c* is effective in reducing blur caused by a lack of high-definition signals.

(Modification 1)

The decoding device 300*c* described above is of a configuration which carries out the sharpening process to the entirety of the decoding result signal S311, in the sharpening process section 100. The configuration alternatively may be one which suitably switches between whether or not to carry out the sharpening process to the decoding result signal S311. For example, the decoding device 300*c* may be designed so that when the decoded original signal is outputted as it is as the decoding result signal S311, no sharpening process is carried out to the decoding result signal S311, whereas when the decoding result signal S311 is outputted with use of the decoded high-frequency-free signal, the sharpening process is carried out to the decoding result signal S311. This makes it possible to carry out the sharpening process to not the entire decoding result signal S311, but just to parts of the decoding result signal S311 which are considered as being deteriorated.

The foregoing configuration is described with reference to FIG. 19. FIG. 19 is a block diagram showing a configuration example of a decoding device 300*d*, which is a modification of the decoding device 300*c*.

As shown in FIG. 19, the decoding device 300*d* includes a decoding control section (decoding means) 312, a sharpening process section 100, and an output switching section 340. A signal outputted from the decoding control section 312 is referred to as a decoding result signal (decoded signal) S312. The decoding result signal S312 is a signal indicative of a reconstructed image that corresponds to the original image.

The output switching section 340 is a switch that switches a signal line from which output is provided from the decoding device 300*d*. The output switching section 340, in response to an instruction from the decoding process section 321 of the decoding control section 312, switches between whether to connect the connection point Out4 with the connection point In41 or with the connection point In42. When the connection point Out4 is connected with the connection point In42, the decoding device 300*d* outputs the output signal of the sharpening process section 100. On the other hand, when the connection point Out4 is connected with the connection point In41, the decoding device 300*d* outputs the decoding result signal S312.

The decoding control section 312 is identical in configuration to the decoding control section 311, except that the decoding process section 320 is replaced with a decoding process section 321. The decoding process section 321 includes all functions capable by the decoding process section 320. The decoding process section 321 further has a function to instruct the output switching section 340 of whether to connect the connection point Out4 with the connection point In41 or with the connection point In42.

More specifically, the decoding process section 321 extracts the encoding information E1 included in the encoded signal S221, and (1) in a case in which the encoding information E1 indicates that the encoded signal S221 is a signal in which the input signal A11 (i.e. original signal SR) is encoded, the decoding process section 321 instructs to the output switching section 340 to connect the connection point Out4 with the connection point In41. Consequently, when the decoded original signal is outputted as the decoding result signal S312, the decoding result signal S312 as it is serves as a signal that is outputted from the decoding device 300*d*.

On the other hand, (2) in a case in which the encoding information E1 indicates that the encoded signal S221 is a signal in which the input signal A12 (i.e. high-frequency-free signal S210) is encoded, the decoding process section 321 instructs the output switching section 340 to connect the connection point Out4 with the connection point In42. Accordingly, when the decoding result signal S312 is outputted from the signal reconfiguring section 330 with use of the decoded high-frequency-free signal, a signal having been subjected to the sharpening process in the sharpening process section 100 serves as the signal to be outputted from the decoding device 300*d*.

According to the configuration, it is possible to carry out the sharpening process to not the entirety of the decoded signal but just to a part of the decoding result signal S312 in which the degree of deterioration is considered as great (i.e. when the decoding result signal S312 is outputted with use of the decoded high-frequency-free signal).

(Modification 2)

The decoding device 300*c* described above is of a configuration in which the sharpening process section 100 is provided subsequently to the decoding control section 311. However, the sharpening process section 100 is not always necessarily provided. In particular, in a case in which the reconstructed image indicated by the decoding result signal S311 is not unsharp to the degree that the sharpening process is required, the sharpening process section 100 can be not provided.

Embodiment 3

The encoding device 200*c* described above is of a configuration in which the LPF 210 and the signal switching section 240 are used to encode any one of the original signal SR and the high-frequency-free signal S210. However, the high-frequency-free signal S210 is a signal in which a high frequency component is removed from the original signal SR by LPF, therefore a signal corresponding to an outline part (edge) in the original image is small in amount. This causes a case in which the outline part (edge) cannot be sufficiently reconstructed, in a reconstructed image indicated by a signal decoded by the decoding device 300*c*.

Accordingly, the present embodiment describes a configuration in which the outline part (edge) of the reconstructed image can be sufficiently reconstructed while the transmission rate of a signal to be transmitted through the transmission path 700 is held down.

Figure 1:
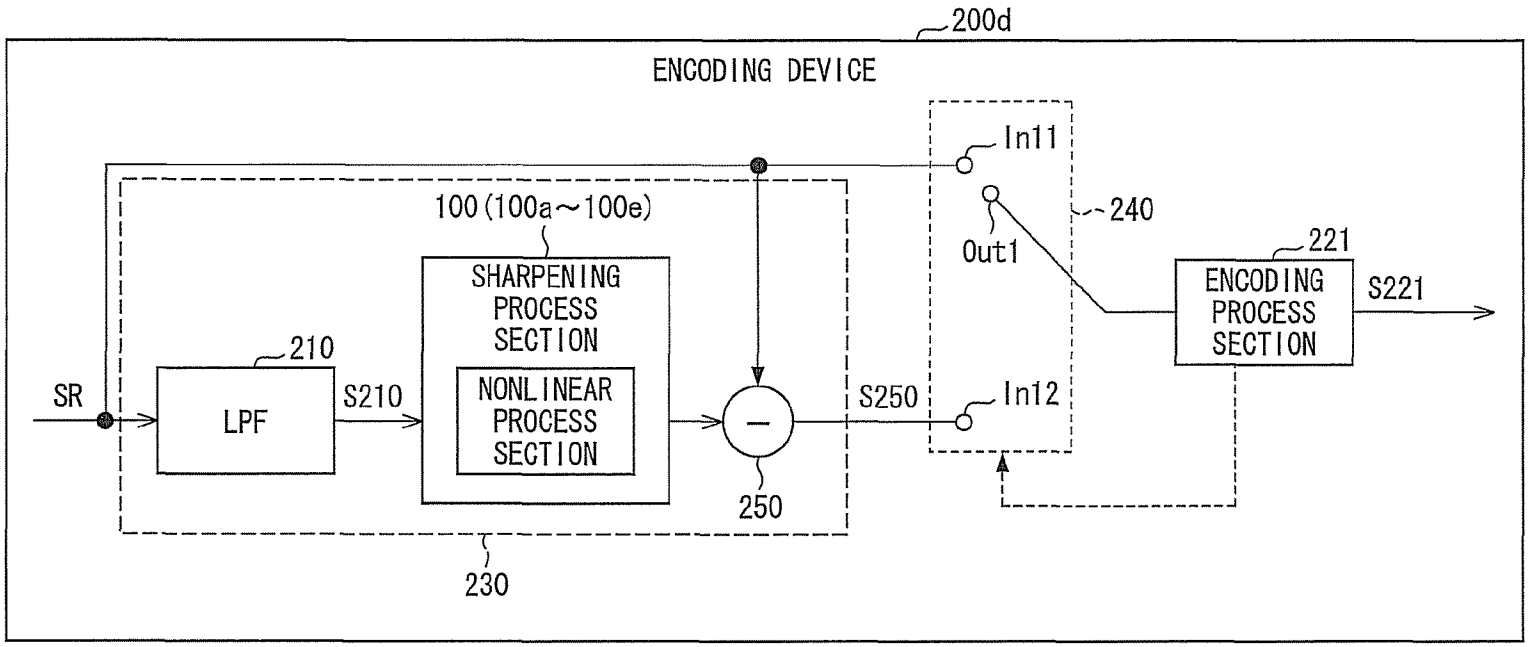
FIG. 1 is a block diagram showing a configuration of an encoding device according to the present invention.

One embodiment of the present invention is described below, with reference to FIG. 1, FIG. 18 and FIG. 20. The encoding device 200 according to the present embodiment is referred to as an encoding device 200*d*. Moreover, a decoding device 300 according to the present embodiment is referred to as a decoding device 300*e*.

For easy explanation, members having identical functions as those shown in Embodiments 1 and 2 are provided with identical reference signs, and unless particularly required, explanations of these members are omitted.

(Configuration of Encoding Device and Decoding Device)

Described below is a configuration example of the encoding device 200*d* and the decoding device 300*e*, with reference to FIG. 1 and FIG. 18. FIG. 1 and FIG. 18 are block diagrams showing configuration examples of the encoding device 200*d* and the decoding device 300*e*, respectively.

First described is the configuration of the encoding device 200*d*. As illustrated in FIG. 1, the encoding device 200*d* includes an LPF (high-frequency component removing means) 210, a sharpening process section 100, a subtraction section (subtraction means) 250, a signal switching section 240, and an encoding process section 221. The LPF 210, the sharpening process section 100, and the subtraction section 250 are collectively called a frequency component extraction section (frequency component extracting means) 230.

The sharpening process section 100 of the encoding device 200*d* is provided subsequently to the LPF 210, and outputs a signal in which a sharpening process is carried out to the high-frequency-free signal S210 outputted from the LPF 210 (hereinafter, referred to also as harmonics of the high-frequency-free signal S210).

The subtraction section 250 subtracts harmonics of the high-frequency-free signal S210 from the original signal SR (frequency component extraction step). The subtraction section 250 includes, as appropriate, a delay element for adjusting a timing between the original signal SR and the harmonics of the high-frequency-free signal S210.

A signal outputted from the subtraction section 250 is referred to as a difference signal (frequency component extraction signal) S250. The difference signal S250 can be said as a signal corresponding to an outline part (edge) included in the original image that the original signal SR indicates.

The LPF 210, the signal switching section 240, and the encoding process section 221 are capable of the functions described in Embodiment 2.

However, in the present embodiment, when the connection point Out1 is connected with the connection point In12 in the signal switching section 240, the encoding process section 221 receives the difference signal S250, whereas when the connection point Out1 is connected with the connection point In11, the encoding process section 221 receives the original signal SR. Hence, in the case of the present embodiment, the encoded signal S221 includes a signal in which the difference signal S250 is encoded and a signal in which the original signal SR is encoded.

Moreover, in the present embodiment, the input signal A11 is the original signal SR, and the input signal A12 is the difference signal S250.

Next described is a configuration of the decoding device 300*e*. The decoding device 300*e* has identical configurations to the decoding device 300*c* of Embodiment 2 shown in FIG. 18.

In the present embodiment, when the extracted encoding information E1 (1) indicates that the encoded signal S221 is a signal in which the input signal A11 (i.e. original signal SR) is encoded, the decoding process section 320 instructs the first signal switching section 331 to connect the connection point Out2 with the connection point In21, and instructs the second signal switching section 334 to connect the connection point Out3 with the connection point In31.

On the other hand, when the encoding information E1 (2) indicates that the encoded signal S221 is a signal in which the input signal A12 (i.e. difference signal S250) is encoded, the decoding process section 320 instructs the first signal switching section 331 to connect the connection point Out2 with the connection point In22 and instructs the second signal switching section 334 to connect the connection point Out3 with the connection point In32.

As described above, in the case of the present embodiment, the encoded signal S221 includes a signal in which the original signal SR is encoded and a signal in which the difference signal S250 is encoded. Therefore, the decoded signal S320 outputted from the decoding process section 320 includes a signal in which the signal in which the original signal SR is encoded is decoded (hereinafter referred to as decoded original signal) and a signal in which the signal in which the difference signal S250 is encoded is decoded (hereinafter referred to as decoded difference signal).

Further, in the present embodiment, when the decoded signal S320 is the decoded original signal, the signal reconfiguring section 330 outputs the decoded original signal as it is, as the decoding result signal S311. On the other hand, when the decoded signal S320 is the decoded difference signal, a decoding result signal S311 corresponding to a latest frame is outputted, by adding the decoded difference signal to a signal in which motion compensation is carried out to the decoding result signal S311 corresponding to a frame immediately before.

More specifically, when the decoded signal S320 is the decoded original signal, the decoded original signal is held in the frame memory section 332 via the first signal switching section 331, and the decoded original signal is outputted as the decoding result signal S311 via the addition section 335. On the other hand, when the decoded signal S320 is the decoded difference signal, first in the addition section 335, the decoded difference signal is added to a motion compensation signal S333 generated by carrying out, in a motion compensation section 333, a motion compensation to a memory signal S332 outputted from the frame memory section 332, to generate the decoding result signal S311. Thereafter, the decoding result signal S311 is outputted. The decoding result signal S311 is held in the frame memory section 332 via the first signal switching section 331, to carry out motion compensation by the motion compensation section 333 subsequently.

Thereafter, a reconstructed image indicated by the decoding result signal S311 is sharpened by the sharpening process section 100.

(Effect Attained by Foregoing Configuration)

As described above, the encoding device 200*d* generates a difference signal S250 by subtracting from the original signal SR a signal in which a sharpening process is carried out to the high-frequency-free signal S210 in the sharpening process section 100. Thereafter, encoding is carried out by switching between the original signal SR and the difference signal S250. Hence, with the encoding device 200*d*, it is possible to reduce the transmission rate of a signal to be transmitted through the transmission path 700. The reduction of the transmission rate allows for reducing costs required for the data transmission.

With the decoding device 300*e*, the contents indicated by the decoding result signal S311 is sharpened by the sharpening process section 100; in a case in which the contents is of image, image blur is minimized in the image which has been subjected to the decoding, thereby allowing for improving its resolution. Moreover, the contents is similarly sharpened in a case in which the contents is of audio, which allows for making the sound quality clear.

Therefore, according to the foregoing configuration in which encoding is carried out in the encoding device 200*d* and decoding is carried out in the decoding device 300*e*, such an effect is attained that a transmission rate of a signal to be transmitted through the transmission path 700 is reduced while contents having been subjected to decoding on the receiving side is minimized in unsharpness.

(Modification 1)

The encoding device 200*d* described above is designed to output, with use of the LPF 210, the sharpening process section 100, and the subtraction section 250, the difference signal S250 as a signal corresponding to an outline part (edge) included in the original image that is indicated by the original signal SR. However, the signal corresponding to the outline part (edge) included in the original image may be generated by other methods. The simplest configuration is to pass the original signal SR through a high-pass filter (hereinafter, HPF), to generate the signal corresponding to the outline part (edge) included in the original image.

Below describes the foregoing configuration, with reference to FIG. 20. FIG. 20 is a block diagram showing a configuration example of an encoding device 200*e*, which is a modification of the encoding device 200*d*.

Figure 20:
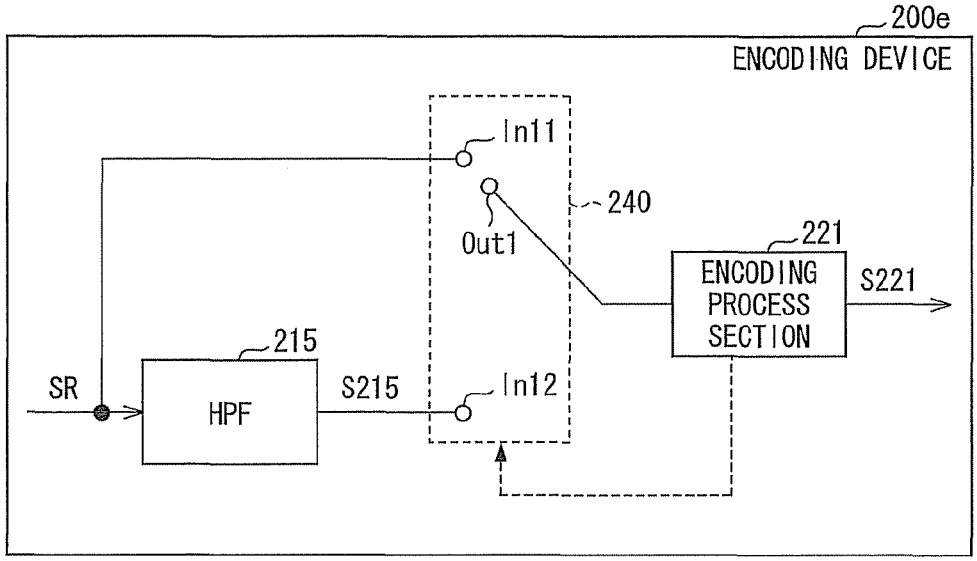
FIG. 20 is a block diagram showing a configuration example of a modification of the encoding device shown in FIG. 17.

As shown in FIG. 20, the encoding device 200*e* includes an HPF (frequency component extracting means) 215 as a replacement of the LPF 210, the sharpening process section 100, and the subtraction section 250 of the encoding device 200*d*.

The HPF 215 is a commonly known high-pass filter, and removes, from the original signal SR, a low-frequency component included in frequency components of the original signal SR. The HPF 215 may be a high-pass filter that can be adjustable in its frequency characteristics (so-called adaptive high-pass filter). The signal outputted from the HPF 215 is referred to as a low-frequency-free signal (frequency component extraction signal) S215. The low-frequency-free signal S215 is a signal corresponding to an outline part (edge) included in the original image that is indicated by the original signal SR.

As described above, similarly with the encoding device 200*d*, the encoding device 200*e* carries out encoding by switching between the original signal SR and a part of frequency components included in the original signal SR, with a simple configuration.

However, since the low-frequency-free signal S215 generated in the encoding device 200*e* is simply a signal that removes the low-frequency component from the original signal SR, the low-frequency-free signal S215 includes a high frequency component, which is in the vicinity of Nyquist frequency of the original signal SR. Accordingly, the low-frequency-free signal S215 includes many noises and fine edges than the difference signal S250 generated by the encoding device 200*d*, and becomes greater in data amount than the difference signal S250.

Therefore, the encoding device 200*e* can increase the transmission rate of the signal to be transmitted through the transmission path 700 more than that of the encoding device 200*d*, and in a case in which reduction of the circuit scale and cost is given more weight at the sacrifice of a slightly unsharp image upon decoding, the encoding device 200*e* is more suitably used than the encoding device 200*d*.

(Modification 2)

The decoding device 300*e* described above has a configuration in which a sharpening process is carried out to an entirety of the decoding result signal S311, in the sharpening process section 100. However, the configuration can be one in which whether or not the sharpening process is carried out to the decoding result signal S311 is switched as appropriate. For example, the configuration may be one in which when the decoded original signal serves as the decoding result signal S311 as it is, no sharpening process is carried out to the decoding result signal S311, whereas when the decoding result signal S311 is outputted based on the decoded difference signal, the sharpening process is carried out to the decoding result signal S311. This allows for carrying out the sharpening process to not the entire decoding result signal S311 but just to a part of the decoding result signal S311 that is considered as being deteriorated (i.e. when the decoding result signal S311 is one based on the decoded difference signal).

The foregoing configuration is identical to the decoding device 300*d*, and thus explanation thereof is omitted here.

(Modification 3)

The decoding device 300*e* described above does not necessarily need to provide the sharpening process section 100, as with the decoding device 300*c* of the configuration in which the sharpening process section 100 is provided subsequently to the decoding control section 311. In particular, the configuration can be one in which no sharpening process section 100 is provided in a case in which the reconstructed image indicated by the decoding result signal S311 is not so unsharp to the degree that the sharpening process is required.

Embodiment 4

A degree of deterioration of the contents which has been subjected to the decoding differs as appropriate depending on variation of a transmission band in the transmission path 700 and on the contents itself. Hence, the data amount of the difference signal S250 may be adjusted by adjusting the frequency characteristics of the LPF 210 and the high frequency component extracting section 11.

The present embodiment describes a mode in which the contents prior to encoding is compared with the contents reconstructed after the decoding, and the frequency characteristics of the LPF 210 and the high frequency component extracting section 11 are adjusted in accordance with the comparison results.

One embodiment of the present invention is described below with reference to FIG. 21 and FIG. 22. The encoding device 200 according to the present embodiment is referred to as an encoding device 200*f*. Moreover, the decoding device 300 according to the present embodiment is referred to as a decoding device 300*f*.

For easy explanation, members having identical functions as those shown in Embodiments 1 through 3 are provided with identical reference signs, and their explanations have been omitted.

(Configuration of Encoding Device and Decoding Device)

Figure 21:
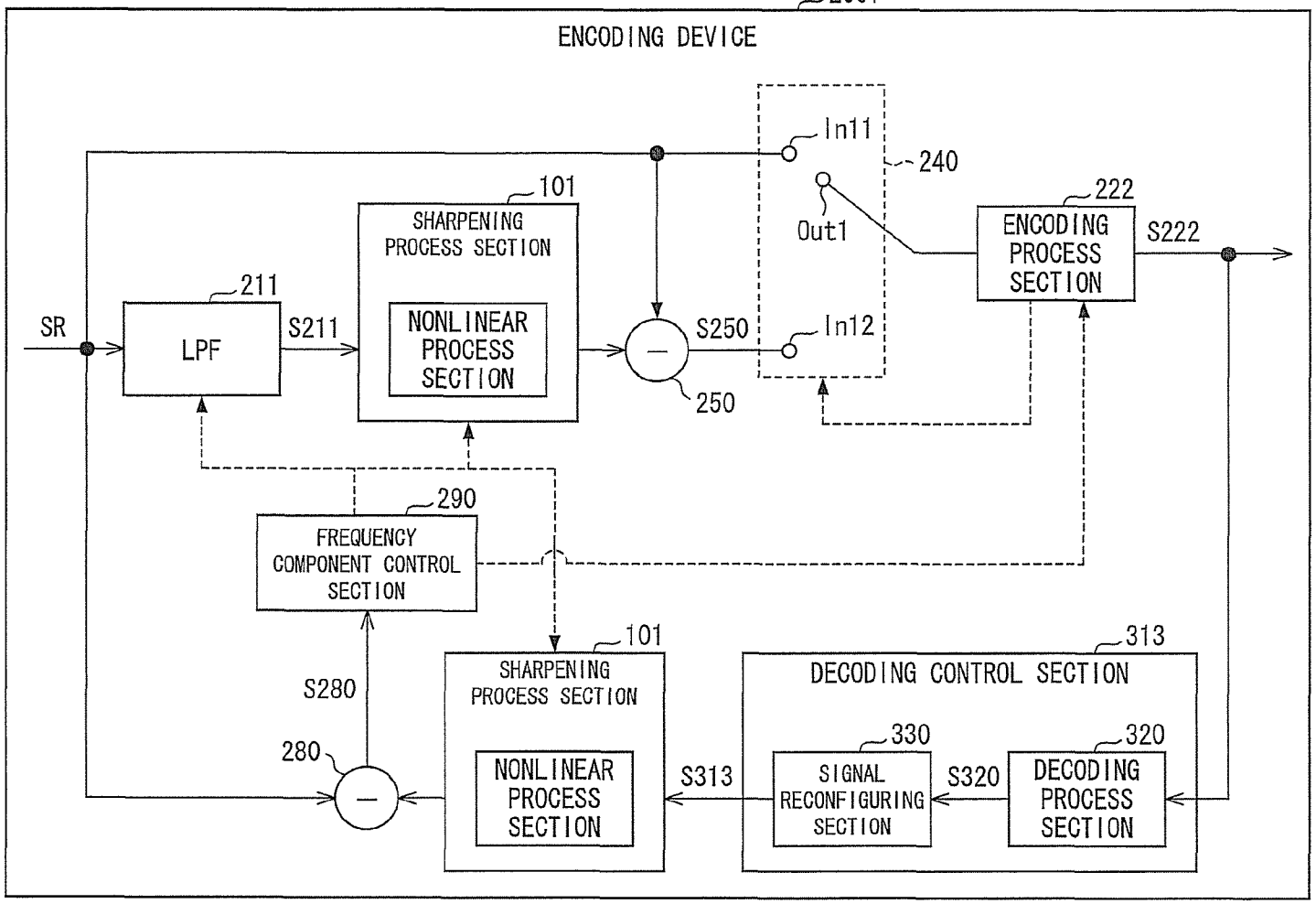
FIG. 21 is a block diagram showing yet another configuration of the encoding device of the present invention.
Figure 22:
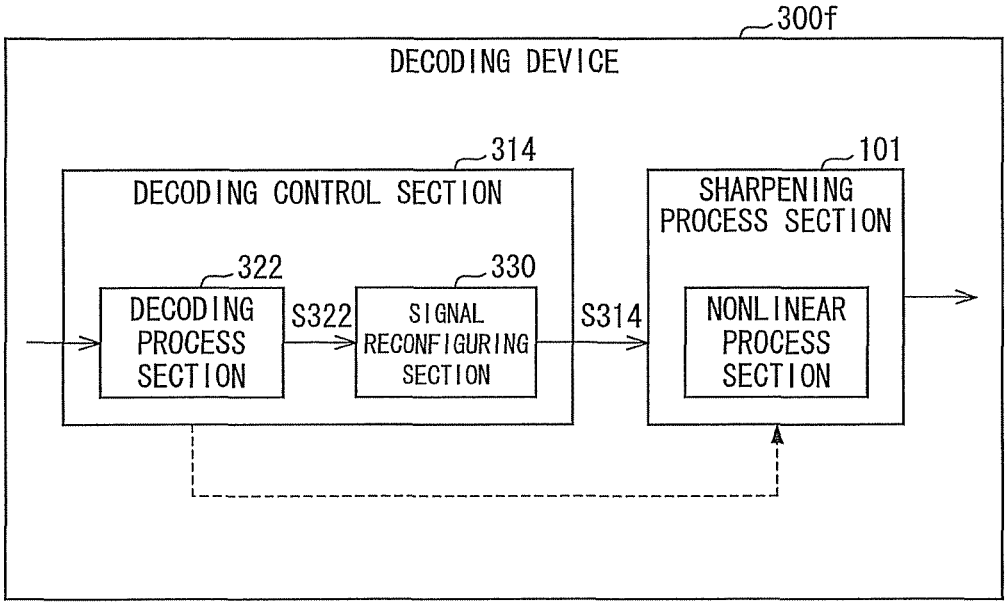
FIG. 22 is a block diagram showing a configuration of a decoding device corresponding to the encoding device shown in FIG. 21.

The following describes configuration examples of the encoding device 200*f* and the decoding device 300*f*, with reference to FIG. 21 and FIG. 22. FIG. 21 and FIG. 22 are block diagrams showing configuration examples of the encoding device 200*f* and the decoding device 300*f*, respectively.

First described is the configuration of the encoding device 200*f*. As shown in FIG. 21, the encoding device 200*f* includes an LPF 211, a sharpening process section 101 (hereinafter referred to as sharpening process section 101A) (high-frequency component generation means) provided subsequently to the LPF 211, a subtraction section 250, a signal switching section 240, an encoding process section (encoding means) 222, a decoding control section 313, a sharpening process section 101 (hereinafter, referred to as sharpening process section 101B) (second high-frequency component generation means) provided subsequently to the decoding control section 313, the subtraction section (second subtraction means) 280, and the frequency component control section (frequency component control means) 290. When the sharpening process sections 101A and 101B, and a sharpening process section 101C later described are not distinguished from each other, these members will simply be referred to as "sharpening process section 101".

The sharpening process section 101 has an identical configuration as the sharpening process section 100, except for the following difference. The difference is that frequency characteristics of the high frequency component extracting section 11 are adjustable (i.e. increase and decrease in high frequency components extracted by the high frequency component extracting section 11 is adjustable) in response to an instruction received from outside. More specifically, a filter coefficient is adjustable. Explanation is omitted regarding the configuration of the sharpening process section 101.

The LPF 211 is a low-pass filter whose frequency characteristics are adjustable (so-called adaptive low-pass filter) in response to an instruction from outside. More specifically, the filter coefficient can be adjusted. That is to say, the LPF 211 allows for adjusting the increasing and decreasing of the high frequency components to be removed. The signal outputted from the LPF 211 is referred to as a high-frequency-free signal S211.

The sharpening process section 101A is provided subsequently to the LPF 211, and outputs a signal in which a sharpening process is carried out to the high-frequency-free signal S211 that is outputted from the LPF 211 (hereinafter referred to also as harmonics of the high-frequency-free signal S211).

The encoding process section 222 has functions similar to the encoding process section 221. A signal outputted from the encoding process section 222 is referred to as an encoded signal S222. The encoding process section 222 is associated with (a) the decoding process section 320 of the decoding control section 313 and (b) a decoding process section 322 of a decoding control section (decoding means) 314 later described, and the encoding process section 222 is configured to output an encoded signal S222 decodable by the decoding process section 320 of the decoding control section 313 and by the decoding process section 322 of the decoding control section 314.

The decoding control section 313 has an identical configuration to that of the decoding control section 311 described in FIG. 18, and includes the decoding process section 320 and the signal reconfiguring section 330. A signal outputted from the decoding control section 313 is described as a decoding result signal S313.

The sharpening process section 101B is provided subsequent to the decoding control section 313, and outputs a signal in which the sharpening process is carried out to the decoding result signal S313 outputted from the decoding control section 313 (hereinafter, described also as harmonics of the decoding result signal S313).

The subtraction section 280 subtracts the harmonics of the decoding result signal S313 from the original signal SR. A signal outputted from the subtraction section 280 is described as a difference signal S280. The subtraction section 280 includes, as appropriate, a delay element for adjusting a timing between the original signal SR and the harmonics of the decoding result signal S313.

The frequency component control section 290 controls the LPF 211 and the high frequency component extracting section 11 of the sharpening process section 101A and the sharpening process section 101B, so that a difference between the image indicated by the harmonics of the decoding result signal S313 and the original image is made small, and adjusts the frequency characteristics.

Hence, the frequency component control section 290 first compares a total value of an absolute value of the difference signal S280 (hereinafter referred to as total SU) with a predetermined threshold. The total SU can be said as a value indicative of a difference between the image indicative of the harmonics of the decoding result signal S311 and the original image.

The image indicated by the harmonics of the decoding result signal S313 is an image identical to an image indicated by the harmonics of the decoding result signal (decoded signal) S314 decoded by the decoding device 300*f* later described. Hence, the total SU can be said as a value indicative of a difference between the reconstructed image and the original image. Accordingly, the greater the value of the total SU, the greater the difference between the reconstructed image and the original image.

As a result of the comparison, when the total SU is greater than a predetermined threshold, the frequency component control section 290 controls the LPF 211, the sharpening process section 101A, and the sharpening process section 101B so that the difference between the reconstructed image and the original image is made small. Namely, the frequency component control section 290 controls so that the data amount of the difference signal S250 increases. More specifically, the frequency component control section 290 carries out the following (A) or (B), or both of the (A) and (B): (A) adjust frequency characteristics of the LPF 211 so as to reduce the high-frequency components removed by the LPF 211, (B) adjust frequency characteristics of the high-frequency component extracting section 11 of the sharpening process sections 101A and 101B so that the high frequency components extracted by the sharpening process sections 101A and 101B are increased.

On the other hand, when the total SU is not more than a predetermined value as a result of the comparison, the frequency component control section 290 controls the LPF 211, the sharpening process section 101A, and the sharpening process section 101B so that the data amount of the difference signal S250 is made small. More specifically, the frequency component control section 290 carries out the following (C) or (D), or both of the (C) and (D): (C) adjust frequency characteristics of the LPF 211 so that the high frequency components removed by the LPF 211 is increased in amount, or (D) adjust frequency characteristics of the high frequency component extracting section 11 of the sharpening process sections 101A and 101B so that the high frequency components extracted by the sharpening process sections 101A and 101B is reduced.

The frequency characteristics of the high frequency component extracting section 11 of the sharpening process sections 101A and 101B are adjusted to be identical to each other.

Moreover, adjusted details of the frequency characteristics of the high frequency component extracting section 11 included in the sharpening process sections 101A and 101B (hereinafter referred to as frequency characteristics adjusted information F1) is sent to the decoding device 300*f*. For example, the frequency characteristics adjusted information F1 is sent to the decoding device 300*f* via the encoding process section 222, upon multiplexing with the encoded signal S222.

Next described is a configuration of the decoding device 300*f*. The decoding device 300*f* includes a decoding control section 314, and a sharpening process section 101 (hereinafter referred to as sharpening process section 101C) (third high-frequency component generation means) provided subsequently to the decoding control section 314.

The decoding control section 314 has an identical configuration as the decoding control section 311 except that the decoding process section 320 is replaced with the decoding process section 322. The decoding process section 322 has the same functions as the decoding process section 320, except for the following difference. The difference is that the decoding process section 322 adjusts an increase and decrease in the high-frequency component extracted by the sharpening process section 101C provided subsequently to the decoding control section 314, in accordance with the frequency characteristics adjusted information F1 received from the encoding device 200*f*. More specifically, the difference is that the decoding process section 322 adjusts the frequency characteristics of the high-frequency component extracting section 11 included in the sharpening process section 101C. The details of the adjustment is identical to that of the frequency characteristics of the high frequency component extracting section 11 included in the sharpening process sections 101A and 101B.

The signal outputted from the decoding control section 314 is described as a decoding result signal S314. The decoding result signal S314 is a signal indicative of a reconstructed image that corresponds to the original image.

The decoding device 300*f* provides the sharpening process section 101C subsequently to the decoding control section 314; the decoding result signal S314 outputted from the decoding control section 314 serves as a signal input of the sharpening process section 101C. Hence, the decoding device 300*f* carries out a sharpening process to the decoding result signal S314 in the sharpening process section 101C, based on nonlinear operation. Namely, the sharpening process section 100 of the decoding device 300*f* sharpens a reconstructed image indicated by the decoding result signal S314.

(Effect Attained by Foregoing Configuration)

As described above, the encoding device 200*f* includes functions similar to the decoding device 300*f*, and is capable of generating a reconstructed image decoded by the decoding device 300*f* and comparing its difference from the original image. Thereafter, in accordance with the comparison result, the data amount of the difference signal S250 is to be adjusted. Moreover, the amount adjusted by the encoding device 200*f* is transmitted to the decoding device 300*f* so as to reflect the amount into the sharpening process carried out by the decoding device 300*f*. As a result, it is possible to adjust image quality of the reconstructed image decoded by the decoding device 300*f* and to adjust the data amount to be transmitted through the transmission path 700.

Accordingly, in the transmission system including the encoding device 200*f* and the decoding device 300*f*, it is possible to suitably adjust the degree of deterioration of the decoded contents and the data amount to be transmitted through the transmission path 700.

(Modification 1)

In order to minimize the data amount to be transmitted through the transmission path 700, the transmission system may be configured in such a manner that the encoding device further carries out signal decimation before carrying out the encoding, and that interpolation of the signal is carried out after the signal is decoded.

Figure 23:
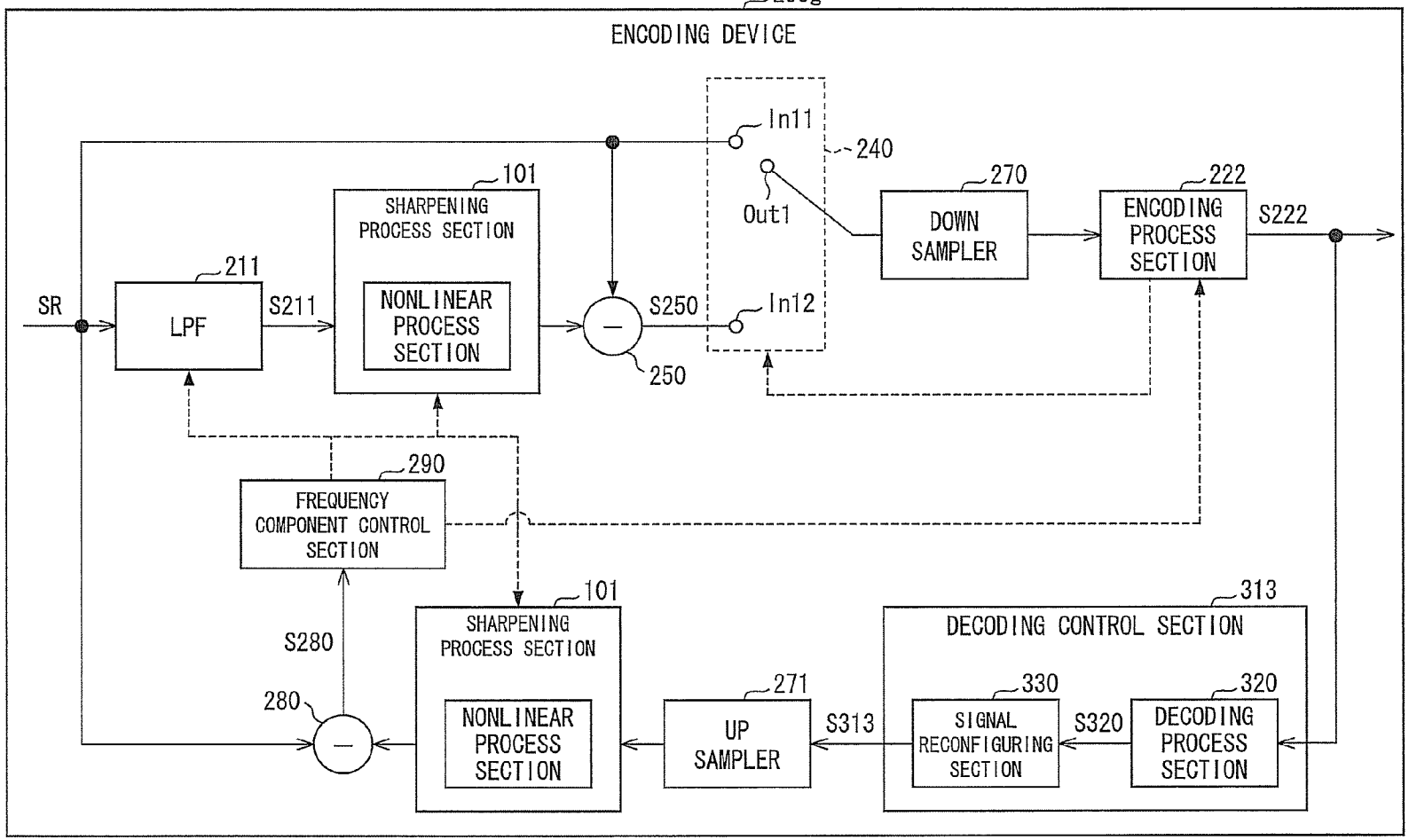
FIG. 23 is a block diagram showing a configuration example of a modification of the encoding device illustrated in FIG. 21.
Figure 24:
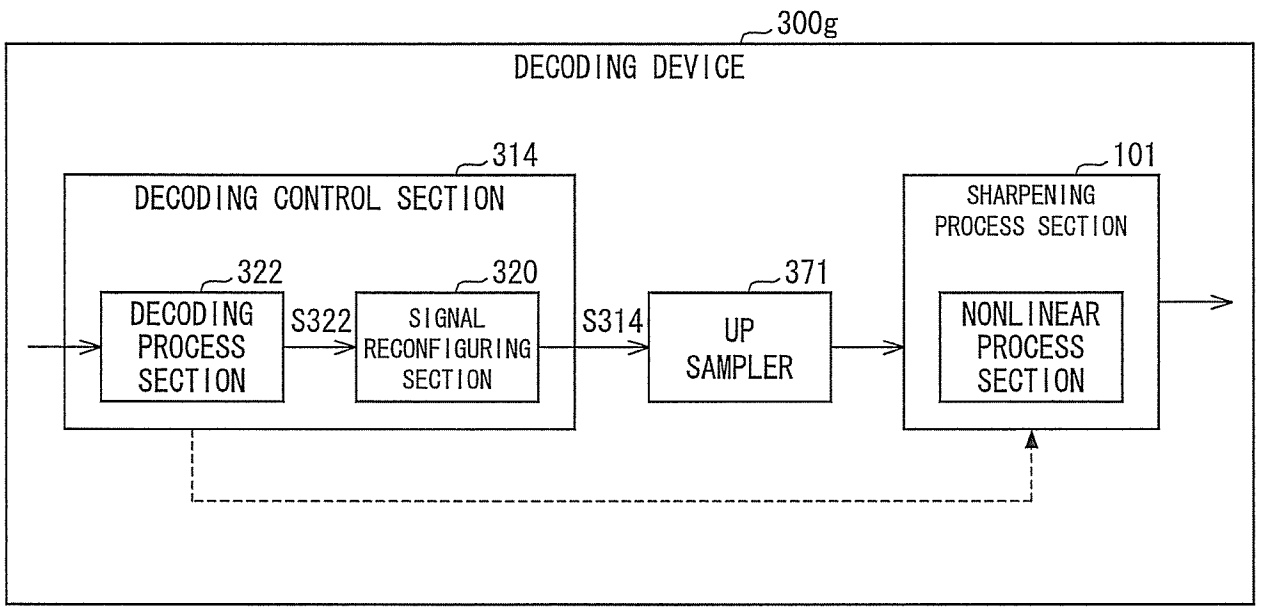
FIG. 24 is a block diagram showing a configuration example of a modification of the decoding device shown in FIG. 22.

This configuration is described below, with reference to FIG. 23 and FIG. 24. FIG. 23 and FIG. 24 are block diagrams respectively showing configuration examples of an encoding device 200*g*, which is a modification of the encoding device 200*f*, and a decoding device 300*g*, which is a modification of the decoding device 300*f*.

As shown in FIG. 23, the encoding device 200*g* includes an identical configuration as that of the encoding device 200*f*, and further includes a down sampler (signal decimation means) 270 disposed between the signal switching section 240 and the encoding process section 222, and also an up sampler (signal interpolation means) 271 disposed between the decoding control section 313 and the sharpening process section 101B.

Moreover, as shown in FIG. 24, the decoding device 300*g* has an identical configuration as the decoding device 300*f*, however further includes an up sampler 371 disposed between the decoding control section 314 and the sharpening process section 101C.

(Modification 2)

The encoding device 200*f* and the decoding device 300*f* described above provide the sharpening process section 101B and the sharpening process section 101C, respectively, to sharpen the decoded reconstructed image. However, the sharpening process section 101B and the sharpening process section 101C do not necessarily need to be provided. In particular, when the reconstructed image is not so unsharp to the degree that the sharpening process is required, the sharpening process section 100 may be not provided.

In this case, when the total SU is greater than a predetermined threshold, the frequency component control section 290 carries out (A) or (B'), or both (A) and (B'): (A) adjust the frequency characteristics of the LPF 211 so that the high frequency component to be removed by the LPF 211 is reduced; and (B') adjust the frequency characteristics of the high frequency component extracting section 11 of the sharpening process section 101A so that the high frequency component extracted by the sharpening process section 101A is increased.

On the other hand, when the total SU is not more than the predetermined threshold, the frequency component control section 290 carries out the following (C) or (D'), or both (C) and (D'): (C) adjust the frequency characteristics of the LPF 211 so that the high frequency component to be removed by the LPF 211 is increased; and (D') adjust the frequency characteristics of the high frequency component extracting section 11 of the sharpening process section 101A so that the high frequency component extracted by the sharpening process section 101A is reduced.

Moreover, in a case in which the sharpening process section 101C is not provided, the encoding device 200*f* does not need to send the frequency characteristics adjusted information F1 to the decoding device 300*f*.

(Modification 3)

Embodiment 3 described above with reference to FIG. 20 as a modification of the encoding device, describes the configuration that generates a signal corresponding to an outline part (edge) included in the original image, by passing the original signal SR through the HPF. The present embodiment also may include an HPF 291 (not illustrated) instead of the LPF 211, the sharpening process section 101A, and the subtraction section 250 of the encoding device 200*f*. The HPF 291 is a high-pass filter that can adjust frequency characteristics (so-called adaptive high-pass filter), in response to an instruction received from outside. Namely, the HPF 291 can adjust the increase and reduction in the low-frequency component to be reduced.

The frequency characteristics of the HPF 291 is to be adjusted so that when the total SU is greater than the predetermined threshold the frequency component control section 290 controls to increase the low-frequency component to be removed by the HPF 291, and that the frequency component control section 290 reduces the low-frequency component to be removed by the HPF 291 when the total SU is not more than the predetermined threshold.

(Modification 4)

The decoding device 300*f* described above is of a configuration in which the sharpening process is carried out in the sharpening process section 101C to the entirety of the decoding result signal S313, however this configuration may be one in which whether or not the sharpening process is to be carried out to the decoding result signal S313 is switched as appropriate. For example, when the decoded original signal is outputted as it is as the decoding result signal S313, no sharpening process is carried out to the decoding result signal S313, whereas when the decoding result signal S313 based on the decoded difference signal is outputted, the sharpening process is carried out to the decoding result signal S313. This allows for carrying out a sharpening process to not the entire decoding result signal S313, but to just a part of the decoding result signal S313 in which it is considered as being deteriorated (i.e. when the decoding result signal S313 is outputted based on the decoded difference signal).

The configuration that carries out the switching over is identical to that of the decoding device 300*d*, and thus description thereof is omitted here.

Additional Matter

Finally, the functions of the encoding device 200 and the decoding device 300 may be realized by way of hardware or software as executed by a CPU (central processing unit) as follows:

In a case of realizing by way of software, the encoding device 200 and the decoding device 300 (in particular, the sharpening process sections 100 and 101, the decoding control sections 311 through 314, and the frequency component control section 290) each include a CPU (central processing unit) and memory devices (memory media). The CPU (central processing unit) executes instructions in control programs realizing the functions. The memory devices include a ROM (read only memory) which contains programs, a RAM (random access memory) to which the programs are loaded, and a memory containing the programs and various data. The objective of the present invention can also be achieved by mounting to the encoding device 200 and the decoding device 300 a computer-readable storage medium containing control program codes (executable program, intermediate code program, or source program) for the encoding device 200 and the decoding device 300, which is software realizing the aforementioned functions, in order for the computer (or CPU, MPU) to retrieve and execute the program code contained in the storage medium.

The storage medium may be, for example, a tape, such as a magnetic tape or a cassette tape; a magnetic disk, such as a Floppy (Registered Trademark) disk or a hard disk, or an optical disk, such as CD-ROM/MO/MD/DVD/CD-R; a card, such as an IC card (memory card) or an optical card; or a semiconductor memory, such as a mask ROM/EPROM/EEPROM/flash ROM.

The encoding device 200 and decoding device 300 may be arranged to be connectable to a communications network so that the program code may be delivered over the communications network. The communications network is not limited in any particular manner, and may be, for example, the Internet, an intranet, extranet, LAN, ISDN, VAN, CATV communications network, virtual dedicated network (virtual private network), telephone line network, mobile communications network, or satellite communications network. The transfer medium which makes up the communications network is not limited in any particular manner, and may be, for example, wired line, such as IEEE 1394, USB, electric power line, cable TV line, telephone line, or ADSL line; or wireless, such as infrared radiation (IrDA, remote control), Bluetooth (registered trademark), 802.11 wireless, HDR, mobile telephone network, satellite line, or terrestrial digital network. The present invention encompasses a carrier wave or data signal transmission in which the program code is embodied electronically.

In the present specification, "means" does not necessary denote physical means, and also includes cases in which functions of the means are realized by way of software. Furthermore, a function of one means may be realized by two or more physical means, or alternatively, functions of two or more means may be realized by one physical means.

As described above, an encoding device according to the present invention is an encoding device that outputs an encoded signal, the encoded signal including a signal in which an original signal is encoded, the original signal being indicative of contents of at least one of image and audio, the encoding device including: frequency component extracting means for extracting, from the original signal, a part of frequency components included in the original signal, to generate a frequency component extraction signal; and encoding means for encoding the frequency component extraction signal and the original signal in such a manner that the encoding is carried out while switching over between the frequency component extraction signal and the original signal, and making the signal thus encoded be included in the encoded signal.

Moreover, a control method for an encoding device according to the present invention is a method of controlling an encoding device that outputs an encoded signal, the encoded signal including a signal in which an original signal is encoded, the original signal being indicative of contents of at least one of image and audio, the method including: extracting from the original signal a part of frequency components included in the original signal, to generate a frequency component extraction signal; encoding the frequency component extraction signal and the original signal in such a manner that the encoding is carried out while switching over between the frequency component extraction signal and the original signal; and making the signal thus encoded be included in the encoded signal.

The high frequency component includes a large amount of image information. Accordingly, the information amount of the encoded signal is reduced by the whole as compared to a case where a signal in which the original signal is encoded is always included in the encoded signal.

Therefore, such an effect is attained that a transmission rate in a transmission path is reduced in a case in which an encoded signal is transmitted from the encoding device to the decoding device. Reduction of the transmission rate allows for reducing costs required for transmission, such as establishment costs and maintenance costs of the transmission path.

Moreover, a decoding device according to the present invention is a decoding device that generates a decoded signal by receiving, as an input, an encoded signal including a signal in which an original signal is encoded, the original signal being indicative of contents of at least one of image and audio, the contents being constituted of a plurality of frames that are consecutive in terms of time, the encoding of the original signal causing an output of motion vector information for carrying out motion compensation prediction among the frames, the encoded signal including, in each frame, any one of a first signal or a second signal, the first signal being a signal in which the original signal is encoded and the second signal being a signal in which a part of frequency components included in the original signal is encoded, the decoding device including: decoding means for generating, as the decoded signal when the first signal is decoded, a signal in which the first signal is decoded, and generating, as the decoded signal when the second signal is decoded, a signal by adding (a) a signal of a decoded signal generated immediately before that has been subjected to motion compensation with use of the motion vector information and (b) a signal in which the second signal is decoded.

Moreover, a control method for a decoding device according to the present invention is a method of controlling a decoding device that generates a decoded signal by receiving, as an input, an encoded signal including a signal in which an original signal is encoded, the original signal being indicative of contents of at least one of image and audio, the contents being constituted of a plurality of frames that are consecutive in terms of time, the encoding of the original signal causing an output of motion vector information for carrying out motion compensation prediction among the frames, the encoded signal including, in each frame, any one of a first signal or a second signal, the first signal being a signal in which the original signal is encoded and the second signal being a signal in which a part of frequency components included in the original signal is encoded, the method including: generating, as the decoded signal when the first signal is decoded, a signal in which the first signal is decoded; and generating, as the decoded signal when the second signal is decoded, a signal by adding (a) a signal of a decoded signal generated immediately before that has been subjected to motion compensation with use of the motion vector information and (b) a signal in which the second signal is decoded.

The decoding device can carry out decoding by receiving, as an input, a signal equivalent to the original signal, which signal is an encoded signal with less information amount that includes, in each frame, any one of (1) a first signal in which the original signal is encoded and (2) a second signal in which a part of frequency components included in the original signal is encoded. This allows for attaining an effect that it is possible to minimize deterioration of a decoded signal while maintaining the amount reduced of the information amount by the encoding.

Furthermore, the encoding device according to the present invention may be configured in such a manner that the frequency component extracting means includes: high-frequency component removing means for removing a high-frequency component from frequency components of the original signal, to generate a high-frequency-free signal; high-frequency component generation means for generating harmonics of the high-frequency-free signal; and subtraction means for subtracting the harmonics of the high-frequency-free signal from the original signal, to generate the frequency component extraction signal, the high-frequency component generation means including: low-frequency component removing means for removing, from frequency components of the high-frequency-free signal, a low-frequency component at least including a direct current component, to generate a low-frequency-free signal; nonlinear process means for generating a nonlinear process signal (i) in which positive and negative signs of the low-frequency-free signal are retained and (ii) which broadly monotonically increases nonlinearly with respect to the low-frequency-free signal when values of the low-frequency-free signal are at least in the vicinity of 0; and addition means for adding the nonlinear process signal to the high-frequency-free signal, to generate the harmonics.

According to the configuration, a high-frequency-free signal is generated by removing a high-frequency component from frequency components of the original signal, and a low-frequency-free signal is generated by removing, from the high-frequency-free signal, at least a direct current component from frequency components of the high-frequency-free signal. Furthermore, a nonlinear process signal is generated (i) in which positive and negative signs of the low-frequency-free signal are retained and (ii) which broadly monotonically increases nonlinearly with respect to the low-frequency-free signal when values of the low-frequency-free signal is in the vicinity of 0. By adding the nonlinear process signal to the high-frequency-free signal, harmonics of the high-frequency-free signal is generated. Further, by subtracting the harmonics of the high-frequency-free signal from the original signal, the frequency component extraction signal is generated.

The harmonics of the high-frequency-free signal is, for example, generated by adding the high-frequency-free signal with a nonlinear process signal which has been subjected to a nonlinear process such as the low-frequency-free signal being squared. However, the positive and negative signs of the low-frequency-free signal are retained for the positive and negative of the signs of the harmonics.

As described above, the harmonics include a high-frequency component that is not included in the frequency component of the high-frequency-free signal. As a result, the harmonics include a frequency component whose frequencies are higher than the Nyquist frequency, which Nyquist frequency is half the sampling frequency when the high-frequency-free signal is made discrete.

Accordingly, the frequency component extraction signal generated by subtracting the harmonics of the high-frequency-free signal from the original signal is briefly a high-frequency component included in the original signal. For example, the frequency component extraction signal is a signal corresponding to an outline part (edge).

Hence, by generating an encoded signal including a signal in which the frequency component extraction signal is encoded and a signal in which the original signal is encoded, such an effect is attained that the information amount of the encoded signal is reduced and that a high frequency component included in the original signal can be reconstructed by the decoding device.

For example, in a case in which the original signal is indicative of an image, it is possible to appropriately reconstruct an outline part of an image reconstructed by the decoding device, in addition to being able to reduce the transmission rate of the transmission path.

Compared to a high-frequency component generated by removing a low-frequency component of the original signal simply by a common high-pass filter, the frequency component extraction signal generated by subtracting the harmonics of the high-frequency-free signal from the original signal has fewer data amount, and since no high-frequency component in the vicinity of Nyquist frequency of the original signal is included, the frequency component extraction signal includes no noise or small edges. Accordingly, the encoding device of the present invention is capable of generating an encoded signal including no unnecessary information such as noise, while reducing the amount of information by the encoding. In a case in which the encoded signal includes no noise or small edges, it is also possible to prevent the generation of noise and small edges in the decoded signal that is obtained by decoding the encoded signal.

Furthermore, the encoding device according to the present invention may be configured in such a manner that the contents is constituted of a plurality of frames that are consecutive in terms of time, the encoding means further (i) makes, for each frame, any one of a first signal and a second signal be included in the encoded signal, the first signal being a signal in which the original signal is encoded and the second signal being a signal in which the frequency component extraction signal is encoded, and (ii) outputs motion vector information for carrying out motion compensation prediction among the frames, the encoding device further including: decoding means for decoding the encoded signal, to generate a decoded signal; second high-frequency component generation means for generating harmonics of the decoded signal; and second subtraction means for subtracting the harmonics of the decoded signal from the original signal, to generate a difference signal, the decoding means further (i) generating, as the decoded signal when the first signal is decoded, a signal in which the first signal is decoded, and (ii) generating, as the decoded signal when the second signal is decoded, a signal by adding (a) a signal of a decoded signal generated immediately before that has been subjected to motion compensation with use of the motion vector information and (b) a signal in which the second signal is decoded, the second high-frequency component generation means including: second low-frequency component removing means for removing, from frequency components of the decoded signal, a low-frequency component at least including a direct current component, to generate a second low-frequency-free signal; second nonlinear processing means for generating a second nonlinear process signal (i) in which positive and negative signs of the second low-frequency-free signal are retained and (ii) which broadly monotonically increases nonlinearly with respect to the second low-frequency-free signal when values of the second low-frequency-free signal are at least in the vicinity of 0; and second addition means for adding the second nonlinear process signal to the decoded signal, to generate harmonics generated by the second high-frequency component generation means, each of the high-frequency component removing means, the low-frequency component removing means, and the second low-frequency component removing means increasing and reducing the frequency components to be removed, in response to an instruction received from outside, the encoding device further including: a frequency component control section that controls, depending on a value of the difference signal, the increase and reduction in the frequency components to be removed by at least one of the high-frequency component removing means, the low-frequency component removing means, and the second low-frequency component removing means.

According to the configuration, initially, (1) a decoded signal is generated, by decoding the encoded signal. At this time, when a first signal in which the original signal is encoded is decoded, the signal in which the first signal is decoded serves as the decoded signal. Moreover, when a second signal in which the frequency component extraction signal is encoded is decoded, a signal that adds (a) a signal in which a decoded signal generated immediately before has been subjected to motion compensation with use of motion vector information and (b) a signal in which the second signal is decoded serves as the decoded signal. Next, (2) a second low-frequency-free signal is generated by removing, from the decoded signal, at least a direct current component from frequency components of the decoded signal. Thereafter, a second nonlinear process signal is generated, (i) in which positive and negative signs of the second low-frequency-free signal are retained and (ii) which broadly monotonically increases nonlinearly with respect to the second low-frequency-free signal when values of the second low-frequency-free signal are at least in the vicinity of 0. Thereafter, by adding the second nonlinear process signal to the decoded signal, harmonics of the decoded signal is generated. Next, (3) a difference signal is generated, by subtracting the harmonics of the decoded signal from the original signal. Finally, (4) a frequency component to be removed is increased and decreased by at least one of the high-frequency component removing means, low-frequency component removing means, and second low-frequency component removing means, in accordance with a difference signal value.

The harmonics generated by the second high-frequency component generation means is, for example, generated by adding the decoded signal with a second nonlinear process signal, which second nonlinear process signal is a signal to which a nonlinear process is carried out, such as the second low-frequency-free signal being squared. However, the positive and negative signs of the second low-frequency-free signal are retained for the positive and negative signs of the harmonics generated by the second high-frequency component generation means. As such, the harmonics include a high-frequency component not included in the frequency components of the decoded signal. As a result, the harmonics include a frequency component higher than a Nyquist frequency, which Nyquist frequency is half the sampling frequency when the high-frequency-free signal is made discrete. Hence, the harmonics is one in which a rise and fall of a signal corresponding to an edge part included in the decoded signal is made steep.

Hence, the harmonics generated by the second high-frequency component generation means is the contents that has been sharpened, which contents are indicated by the decoded signal. Accordingly, the difference signal generated by subtracting the harmonics from the original signal indicates a difference between contents prior to the encoding, which contents is indicated by the original signal, and the contents which has been decoded, which contents is indicated by the harmonics. For example, by calculating a total of absolute values of signals included in the difference signal, it is possible to quantitatively calculate the difference between the contents prior to the encoding and the decoded contents. The greater the total, the larger the difference between the contents prior to the encoding and the decoded contents is.

The increase and decrease of the frequency components that is to be removed by the high-frequency component removing means and the low-frequency component removing means allows for adjusting the frequency components included in the frequency component extraction signal, thereby being able to adjust the information amount of the encoded signal. As a result, it is possible to adjust the sharpness of the contents indicated by the decoded signal, which decoded signal is obtained by decoding the encoded signal.

For example, when the frequency component included in the frequency component extraction signal is made less, the information amount of the encoded signal decreases. Hence, the contents indicated by the decoded signal obtained by decoding the encoded signal becomes unsharp as compared to that when the information amount of the encoded signal is great. In this case, the transmission rate of the encoded signal in the transmission path decreases.

On the other hand, when the frequency component included in the frequency component extraction signal is increased, the information amount of the encoded signal increases; as a result, the contents indicated by the decoded signal that is obtained by decoding the encoded signal is sharpened as compared to when the information amount of the encoded signal is small. In this case, the transmission rate of the encoded signal in the transmission path increases.

Moreover, by increasing and decreasing the amount of frequency components to be removed by the second low-frequency component removing means, the frequency component included in the harmonics that is generated by the second high-frequency component generation means can be adjusted, thereby allowing adjustment of the information amount of the harmonics. As a result, it is possible to adjust the sharpness of the contents indicated by the harmonics.

As described above, by increasing and decreasing the frequency components that are removed by at least one of the high-frequency component removing means, low-frequency component removing means, and second low-frequency component removing means, the information amount of the encoded signal and the sharpness of the decoded contents can be adjusted.

Consequently, according to the configuration in which the frequency components to be removed by at least one of the high-frequency component removing means, low-frequency component removing means, and second low-frequency component removing means is increased and decreased depending on the value of the difference signal, such an effect is attained that the information amount of the encoded signal and the sharpness of the decoded contents are adjustable in accordance with a difference between the contents prior to the encoding and the decoded contents.

Furthermore, the encoding device according to the present invention may be configured in such a manner that when a total of an absolute value of signals included in the difference signal is greater than a predetermined threshold, the frequency component control section controls so as to reduce a high-frequency component removed by the high-frequency component removing means, controls so as to increase a low-frequency component to be removed by the low-frequency component removing means, and controls so as to increase a low-frequency component to be removed by the second low-frequency component removing means, and when the total is not more than the predetermined threshold, the frequency component control section controls so as to increase the high-frequency component to be removed by the high-frequency component removing means, controls so as to reduce the low-frequency component to be removed by the low-frequency component removing means, and controls so as to reduce the low-frequency component to be removed by the second low-frequency component removing means.

According to the configuration, when the total of the absolute values of signals included in the difference signal is greater than a predetermined threshold, it is possible to increase the frequency components included in the frequency component extraction signal and to increase the frequency components included in the harmonics that is generated by the second high-frequency component generation means. This increases the information amount of the encoded signal, thereby allowing for sharpening the contents indicated by the decoded signal that is obtained by decoding the encoded signal, as compared to a case in which the information amount of the encoded signal is small.

Moreover, according to the configuration, when the total of the absolute values of the signals included in the difference signal is not more than the predetermined threshold, it is possible to reduce the frequency components included in the frequency component extraction signal and to reduce the frequency components included in the harmonics that is generated by the second high-frequency component generation means. As a result, the information amount of the encoded signal is reduced, thereby allowing for reducing the transmission rate of the encoded signal in the transmission path. However, the contents indicated by the decoded signal obtained by decoding the encoded signal becomes unsharp as compared to the case in which the information amount of the encoded signal is small.

Furthermore, the encoding device according to the present invention may further include: signal decimation means for decimating the original signal and the frequency component extraction signal; and signal interpolation means for interpolating the decoded signal.

According to the configuration, decimation is carried out to the signal before the signal is encoded. This allows for further reduction in the information amount of the encoded signal. Moreover, as a counter process to the decimation, signal interpolation (interpolation, up sampling) is carried out to the decoded signal. Further, by carrying out a nonlinear process to the interpolated signal, the high-frequency band that exceeds the Nyquist frequency is compensated; this minimizes the deterioration of the contents caused by the interpolation.

In a case in which the sharpening process is carried out to the signal after the interpolation by linear operation (conventional technique), the high-frequency band that exceeds the Nyquist frequency cannot be compensated. Hence, the deterioration of the contents cannot be improved that much. For example, in a case of an image, a blur remains in the image or its resolution is not much improved.

Furthermore, the encoding device according to the present invention may be configured in such a manner that the nonlinear process means includes: even exponentiation operation means for generating an even exponentiation signal by raising the low-frequency-free signal to an even exponent not less than 2; and sign changing means for generating the nonlinear process signal by reversing positive and negative signs of a part of the even exponentiation signal which part is different in sign from the low-frequency-free signal.

According to the configuration, an even exponentiation signal is further generated by raising the low-frequency-free signal to an even exponent not less than 2, and a nonlinear process signal is generated by reversing positive and negative signs of a part of the even exponentiation signal which part is different in sign from the frequency component prior to the exponentiation.

Hence, the low-frequency-free signal is raised to the even exponent of not less than 2, and the positive and negative signs of the low-frequency-free signal prior to the exponentiation is retained with the generated nonlinear process signal; this allows for an output signal obtained by adding the low-frequency-free signal and the nonlinear process signal to include a high-frequency component not included in the low-frequency-free signal (i.e. not included in the original signal).

Therefore, such an effect is attained that it is possible to make a rise and fall of a signal corresponding to an edge part of the original signal be sharper than that as a result of carrying out linear operation to the original signal.

Furthermore, the encoding device according to the present invention may be configured in such a manner that the nonlinear process means includes: even exponentiation operation means for generating an even exponentiation signal by raising the low-frequency-free signal to an even exponent not less than 2; differentiation means for generating a differential signal by differentiating the even exponentiation signal; and sign changing means for generating the nonlinear process signal by reversing positive and negative signs of a part of the differential signal which part is different in sign from the low-frequency-free signal.

Furthermore, according to the configuration, (i) an even exponentiation signal is generated by raising the low-frequency-free signal to an even exponent of not less than 2, (ii) a differentiation signal is generated by differentiating the even exponentiation signal, and (iii) a nonlinear process signal is generated by reversing positive and negative signs of a part of the differentiation signal which part is different in sign from the frequency component prior to the exponentiation.

Hence, the low-frequency-free signal is removed by raising the low-frequency-free signal to the even exponent of not less than 2 and by differentiating a direct current component which may be included in the raised signal, and further a nonlinear process signal is generated by having positive and negative signs of the low-frequency-free signal prior to the exponentiation be retained. Accordingly, an output signal obtained by adding the low-frequency-free signal and the nonlinear process signal includes a frequency component that is not included in the low-frequency-free signal (i.e. not included in the original signal).

Therefore, such an effect is attained that it is possible to sharpen a rise and a fall of a signal corresponding to the edge part included in the original signal, as compared to the method of carrying out the linear operation to the original signal. The direct current component that can be included in the raised signal is removed by the differentiation; it is thus possible to further sharpen the rise and fall of the signal as compared to a case in which the direct current component is not removed from the raised signal.

Furthermore, the encoding device according to the present invention may be configured in such a manner that the nonlinear process means includes odd exponentiation operation means for generating the nonlinear process signal by raising the low-frequency-free signal to an odd exponent not less than 3.

According to the configuration, a nonlinear process signal is generated by raising the low-frequency-free signal to an odd exponent not less than 3.

Since the low-frequency-free signal raised to the odd exponent of not less than 3 is generated as the nonlinear process signal, an output signal obtained by adding the low-frequency-free signal and the nonlinear process signal includes a frequency component not included in the low-frequency-free signal (i.e. not included in the original signal).

Hence, an effect is attained that it is possible to sharpen the rise and fall of a signal corresponding to an edge part included in the original signal, than a method of carrying out the linear operation to the original signal.

Furthermore, the encoding device according to the present invention may be configured in such a manner that the nonlinear processing means includes square root operation means for generating a square root signal by multiplying (i) a square root of an absolute value of a value calculated by dividing the low-frequency-free signal by a possible maximum value of the low-frequency-free signal, by (ii) the maximum value; and sign changing means for generating the nonlinear process signal by reversing positive and negative signs of a part of the square root signal which part is different in sign from the low-frequency-free signal.

According to the configuration, a square root signal is generated as the nonlinear process signal, which square root signal is obtained by multiplying (i) a square root of an absolute value of a value calculated by dividing the low-frequency-free signal by a possible maximum value of the low-frequency-free signal (i.e. a normalized value of the low-frequency-free signal), by (ii) the maximum value, and in which positive and negative signs of the low-frequency-free signal are retained.

Hence, an output signal obtained by adding the low-frequency-free signal with the nonlinear process signal includes a high-frequency component not included in the low-frequency-free signal (i.e. not included in the decoded signal).

Hence, such an effect is attained that it is possible to sharpen the rise and fall of a signal corresponding to an edge part included in the original signal, than by a method of carrying out the linear operation to the original signal.

Furthermore, the encoding device according to the present invention may be configured in such a manner that the nonlinear process means further includes amplitude adjustment means for adjusting an amplitude of the nonlinear process signal by multiplying the amplitude by a predetermined magnification value.

According to the configuration, it is possible to adjust an amplitude of the output signal obtained by adding the low-frequency-free signal with the nonlinear process signal, to a suitable degree. Hence, an effect is attained that the amplitude of the output signal is prevented from becoming too great.

Furthermore, the encoding device according to the present invention may be configured in such a manner that when the values of the low-frequency-free signal are around 0, the nonlinear process means generates the nonlinear process signal so that the nonlinear process signal has an absolute value larger than that of the low-frequency-free signal.

According to the configuration, when the value of the low-frequency-free signal is in the vicinity of 0, a nonlinear process signal having a greater absolute value than an absolute value of the low-frequency-free signal is generated.

This allows for, in an interval in which the value of the low-frequency-free signal is in the vicinity of 0, having a value of the nonlinear process signal to be added to the low-frequency-free signal in generating the output signal be a value larger than the low-frequency-free signal.

Hence, such an effect is attained that it is possible to sharpen a rise and fall of a signal corresponding to the edge part in the original signal, in an interval in which the value of the low-frequency-free signal is in the vicinity of 0.

Furthermore, the encoding device may be configured in such a manner that the low-frequency component removing means is a high-pass filter having 3 or more taps.

According to the configuration, the low-frequency component removing means is a high-pass filter having 3 or more taps. This allows for appropriately removing at least the direct current component from the original signal.

Hence, an output signal obtained by adding (i) a nonlinear process signal in which a nonlinear process is carried out to a low-frequency-free signal in which the direct current component included in the original signal is removed with (ii) the low-frequency-free signal includes a high-frequency component not included in the low-frequency-free signal (i.e. not included in the original signal).

Therefore, such an effect is attained that it is possible to sharpen a rise and fall of a signal corresponding to an edge part of the original signal, as compared to a method in which linear operation is carried out to the original signal.

Furthermore, the encoding device according to the present invention may be configured in such a manner that the low-frequency component removing means further includes: low-level signal removing means for changing, out of signal values of the low-frequency-free signal, signal values whose absolute values are lower than a predetermined lower limit to 0, and high-level signal removing means for changing, out of the signal values of the low-frequency-free signal, signal values whose absolute values are higher than a predetermined upper limit in such a manner that the absolute values are not higher than the predetermined upper limit while maintaining signs of that signal values.

According to the configuration, a signal value whose absolute value is lower than a predetermined lower limit out of signal values of the low-frequency-free signal is changed to 0, and a signal value whose absolute value is higher than a predetermined upper limit out of signal values of the low-frequency-free signal is changed in such a manner that the absolute value is not higher than the predetermined upper limit while maintaining signs of that signal value.

This allows for removing the noise included in the low-frequency-free signal, and allows for preventing the high-frequency component having a high energy and being included in the low-frequency-free signal be amplified by the nonlinear process.

Hence, it is possible to attain such an effect that noise is removed even from the output signal, and that amplification of a high-frequency component having high energy is prevented.

Moreover, a transmission system according to the present invention is a transmission system including: the encoding device as a transmitting device; and the decoding device as a receiving device, the contents being constituted of a plurality of frames that are consecutive in terms of time, the encoding means further (i) makes, for each frame, any one of a first signal and a second signal be included in the encoded signal, the first signal being a signal in which the original signal is encoded and the second signal being a signal in which the frequency component extraction signal is encoded, and (ii) outputs motion vector information for carrying out motion compensation prediction among the frames.

According to the configuration, an encoding device provided as a transmitting device outputs an encoded signal that includes, in each frame, any one of (1) a first signal in which the original signal is encoded and (2) a second signal in which a part of frequency components of original signal is encoded. A decoding device provided as a receiving device receives the encoded signal as input, and when decoding the first signal, generates, as a decoded signal, a signal in which the first signal is decoded, and when decoding the second signal, generates, as a subsequent decoded signal, a signal which adds (a) a signal of a decoded signal generated immediately before that has been subjected to motion compensation, to (b) a signal in which the second signal is decoded. As a result, a decoded signal generated by the decoding device becomes a signal equivalent to the original signal, excluding the deterioration caused by the encoding and decoding.

Hence, the transmission system allows for outputting from the encoding device an encoded signal of a small information amount and which includes the second signal, and for decoding in the decoding device a signal equivalent to the original signal. As a result, it is possible to minimize the deterioration of the decoded signal while maintaining the reduction in the amount of information by the encoding.

The nonlinear process described above may further be carried out to the decoded signal, to sharpen the rise and fall of the signal corresponding to an edge part of the decoded signal. This allows for highly sharpening the contents indicated by the decoded signal.

Moreover, a transmission system according to the present invention is a transmission system including: the encoding device as a transmitting device; and the decoding device as a receiving device, the decoding device further including third high-frequency component generation means for generating harmonics of the decoded signal, the third high-frequency component generation means including: third low frequency component removing means for removing, from frequency components of the decoded signal, a low-frequency component at least including a direct current component, to generate a third low-frequency-free signal; third nonlinear processing means for generating a third nonlinear process signal (i) in which positive and negative signs of the third low-frequency-free signal are retained and (ii) which broadly monotonically increases nonlinearly with respect to the third low-frequency-free signal when values of the third low-frequency-free signal are at least in the vicinity of 0; and third addition means for adding the third nonlinear process signal to the decoded signal, to generate harmonics generated by the third high-frequency component generation means, the decoding means included in the decoding device increasing and reducing the low-frequency component to be removed by the third low frequency component removing means, so that the low-frequency component removed by the second low-frequency component removing means included in the encoding device agrees with the low-frequency components removed by the third low frequency component removing means.

According to the configuration, an encoding device provided as a transmitting device outputs an encoded signal which includes, in each frame, one of (1) a first signal in which the original signal is encoded and (2) a second signal in which a part of frequency components of the original signal is encoded. Moreover, at least one of the high-frequency component removing means, the low-frequency component removing means, and the second low-frequency component removing means increases or decreases the frequency components to be removed, in response to a value of the difference signal.

On the other hand, a decoding device provided as a receiving device receives the encoded signal as input, and in a case in which the first signal is decoded, the decoding device generates a signal in which the first signal is decoded, as a decoded signal, and in a case in which the second signal is decoded, the decoding device generates a signal which adds (a) a signal as a result of carrying out motion compensation to a decoded signal generated immediately before to (b) a signal in which the second signal is decoded, as a subsequent decoded signal. As a result, the decoded signal generated by the decoding device serves as a signal equivalent to the original signal, excluding the deterioration caused by the encoding and decoding.

Furthermore, a third low-frequency-free signal is generated by removing, from the decoded signal, at least a direct current component of frequency components included in the decoded signal. Thereafter, a third nonlinear process signal is generated, (i) in which positive and negative signs of the third low-frequency-free signal are retained and (ii) which broadly monotonically increases nonlinearly with respect to the third low-frequency-free signal when values of the third low-frequency-free signal are at least in the vicinity of 0. Further, by adding the third nonlinear process signal to the decoded signal, harmonics is generated by the third high-frequency component generation means. The harmonics is, for example, generated by adding the decoded signal with a third nonlinear process signal in which a nonlinear process is carried out to the third low-frequency-free signal such as squaring the third low-frequency-free signal. However, the positive and negative signs of the third low-frequency-free signal are retained as the signs of the harmonics. As such, the harmonics generated by the third high-frequency component generation means includes a high-frequency component not included in the frequency component of the high-frequency-free signal. As a result, the harmonics include a frequency component higher than a Nyquist frequency, which Nyquist frequency is a half a sampling frequency when the high-frequency-free signal is made discrete.

The decoding device increases and reduces a low-frequency component to be removed by the third low frequency component removing means, so that the low-frequency component removed by the second low-frequency component removing means provided in the encoding device agrees with the low-frequency component removed by the third low frequency component removing means. This as a result makes it possible to have the sharpening process carried out to the decoded contents by the encoding device agree with the sharpening process carried out to the decoded contents by the decoding device.

Hence, it is possible to attain an effect that it is possible to adjust the information amount of an encoded signal while having the degree of sharpness of the decoded contents agree between the encoding device and the decoding device.

The encoding device and the decoding device can be accomplished by a computer. In this case, a control program of the encoding device and the decoding device which causes a computer to operate as means to accomplish the encoding device and the decoding device, and a computer-readable recording medium on which the control program is recorded, are also within the scope of the present invention.

Furthermore, a chip including a circuit that executes the means and a ROM (read only memory) storing the control program are also within the scope of the present invention.

The present invention is not limited to the description of the embodiments above, but may be altered by a skilled person within the scope of the claims. An embodiment based on a proper combination of technical means disclosed in different embodiments is encompassed in the technical scope of the present invention.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

The present invention is applicable to a transmission system that transmits data from a transmitting side including an encoding device to a receiving side including a decoding device. In particular, the present invention is suitably applicable to a transmission system that transmits image, audio and the like upon encoding the image, audio and the like.

REFERENCE SIGNS LIST

11 high frequency component extracting section (low-frequency component removing means, second low-frequency component removing means, third low-frequency component removing means)
15 addition section (addition means, second addition means, third addition means)
21 nonlinear operation section (even exponentiation operation means, square root operation means)
22 nonlinear operation section (odd exponentiation operation means)
31 differentiation section (differentiation means)
41 sign changing section (sign changing means)
51 limiter (amplitude adjustment means)
100, 100*a*-100*e* sharpening process section (high-frequency component generation means)
101 sharpening process section (high-frequency component generation means, second high-frequency component generation means, third high-frequency component generation means)
102, 102*a*-102*e* nonlinear process section (nonlinear process means, second nonlinear process means, third nonlinear process means)
132 rounding process section (low-level signal removing means)
133 limiter (high-level signal removing means)
200, 200*a*-200*g* encoding device
210, 211 low pass filter (high-frequency component removing means, frequency component extracting means)
215 high-pass filter (frequency component extracting means)
221, 222 encoding process section (encoding means)
230 frequency component extraction section (frequency component extracting means)
250 subtraction section (subtraction means)
270 down sampler (signal decimation means)
271 up sampler (signal interpolation means)
280 subtraction section (second subtraction means)
290 frequency component control section (frequency component control means)
300, 300*a*-300*g* decoding device,
311, 312, 314 decoding control section (decoding means)
313 decoding control section (decoding means)
900 transmission system
S11 high-frequency signal (low-frequency-free signal, second low-frequency-free signal, third low-frequency-free signal)
S12 nonlinear process signal (second nonlinear process signal, third nonlinear process signal)
S21 non-linear signal (even exponentiation signal, square root signal)
S22 non-linear signal
S31 differentiation signal
S210 high-frequency-free signal (frequency component extraction signal)
S215 low-frequency-free signal (frequency component extraction signal)
S220, S221, S222 encoded signal
S250 difference signal (frequency component extraction signal)
S311, S312, S314 decoding result signal (decoded signal)
SR original signal

The invention claimed is:

1. An encoding device configured to output an encoded signal, the encoded signal including a signal in which an original signal is encoded, the original signal being indicative of contents of at least one of image and audio, the encoding device comprising:

a frequency component extracting section configured to extract, from the original signal, a part of frequency components included in the original signal, to generate a frequency component extraction signal; and an encoding section configured to encode the frequency component extraction signal and the original signal in such a manner that the encoding is carried out while switching over between the frequency component extraction signal and the original signal, and making the signal thus encoded be included in the encoded signal, wherein the frequency component extracting section includes, a high-frequency component removing section configured to remove a high-frequency component from frequency components of the original signal, to generate a high-frequency-free signal, a high-frequency component generation section configured to generate harmonics of the high-frequency-free signal, and a subtraction section configured to subtract the harmonics of the high-frequency-free signal from the original signal, to generate the frequency component extraction signal, the high-frequency component generation section includes, a low-frequency component removing section configured to remove, from frequency components of the high-frequency-free signal, a low-frequency component at least including a direct current component, to generate a low-frequency-free signal, a nonlinear process section configured to generate a nonlinear process signal (i) in which positive and negative signs of the low-frequency-free signal are retained and (ii) which monotonically increases nonlinearly with respect to the low-frequency-free signal when values of the low-frequency-free signal are at least in the vicinity of 0, and an addition section configured to add the nonlinear process signal to the high-frequency-free signal, to generate the harmonics.

2. The encoding device according to claim 1, wherein the contents is constituted of a plurality of frames that are consecutive in terms of time, the encoding section is further configured to (i) makes, for each frame, any one of a first signal and a second signal be included in the encoded signal, the first signal being a signal in which the original signal is encoded and the second signal being a signal in which the frequency component extraction signal is encoded, and (ii) outputs motion vector information for carrying out motion compensation prediction among the frames, the encoding device further comprising:

a decoding section configured to decode the encoded signal, to generate a decoded signal;

a second high-frequency component generation section configured to generate harmonics of the decoded signal;

a second subtraction section configured to subtract the harmonics of the decoded signal from the original signal, to generate a difference signal, the decoding section further configured to (i) generate, as the decoded signal when the first signal is decoded, a signal in which the first signal is decoded, and (ii) generate, as the decoded signal when the second signal is decoded, a signal by adding (a) a signal of a decoded signal generated immediately before that has been subjected to motion compensation with use of the motion vector information and (b) a signal in which the second signal is decoded, the second high-frequency component generation section includes, a second low-frequency component removing section configured to remove, from frequency components of the decoded signal, a low-frequency component at least including a direct current component, to generate a second low-frequency-free signal;

a second nonlinear processing section configured to generate a second nonlinear process signal (i) in which positive and negative signs of the second low-frequency-free signal are retained and (ii) which monotonically increases nonlinearly with respect to the second low-frequency-free signal when values of the second low-frequency-free signal are at least in the vicinity of 0, and a second addition section for adding the second nonlinear process signal to the decoded signal, to generate harmonics generated by the second high-frequency component generation section, each of the high-frequency component removing section, the low-frequency component removing section, and the second low-frequency component removing section increasing and reducing the frequency components to be removed, in response to an instruction received from outside; and a frequency component control section configured to control, depending on a value of the difference signal, the increase and reduction in the frequency components to be removed by at least one of the high frequency component removing section, the low frequency component removing section, and the second low-frequency component removing section.

3. The encoding device according to claim 2, wherein when a total of an absolute value of signals included in the difference signal is greater than a threshold, the frequency component control section controls so as to reduce a high-frequency component removed by the high-frequency component removing section, controls so as to increase a low-frequency component to be removed by the low-frequency component removing section, and controls so as to increase a low-frequency component to be removed by the second low-frequency component removing section, and when the total is not more than the threshold, the frequency component control section controls so as to increase the high-frequency component to be removed by the high-frequency component removing section, controls so as to reduce the low-frequency component to be removed by the low-frequency component removing section, and controls so as to reduce the low-frequency component to be removed by the second low-frequency component removing section.

4. A transmission system, comprising:

the encoding device as set forth in claim 2 as a transmitting device; and a decoding device as a receiving device, the decoding device further including third high-frequency component generation section for generating harmonics of the decoded signal, the decoding device being one that generates a decoded signal by receiving, as an input, an encoded signal including a signal in which an original signal is encoded, the original signal being indicative of contents of at least one of image and audio, the contents being constituted of a plurality of frames that are consecutive in terms of time, the encoding of the original signal causing an output of motion vector information for carrying out motion compensation prediction among the frames, the encoded signal including, in each frame, any one of a first signal or a second signal, the first signal being a signal in which the original, signal is encoded and the second signal being a signal in which a part of frequency components included in the original signal is encoded, and the decoding device comprising a decoding section configured to generate, as the decoded signal when the first signal is decoded, a signal in which the first signal is decoded, and generating, as the decoded signal when the second signal is decoded, a signal by adding (a) a signal of a decoded signal generated immediately before that has been subjected to motion compensation with use of the motion vector information and (b) a signal in which the second signal is decoded;

the third high-frequency component generation section including:

a third low frequency component removing section configured to remove, from frequency components of the decoded signal, a low-frequency component at least including a direct current component, to generate a third low-frequency-free signal;

a third nonlinear processing section configured to generate a third nonlinear process signal (i) in which positive and negative signs of the third low-frequency-free signal are retained and (ii) which monotonically increases nonlinearly with respect to the third low-frequency-free signal when values of the third low-frequency-free signal are at least in the vicinity of 0; and a third addition section configured to add the third nonlinear process signal to the decoded signal, to generate harmonics generated by the third high-frequency component generation section, the decoding section included in the decoding device configured to increase and reduce the low-frequency component to be removed by the third low-frequency-component removing section, so that the low-frequency component removed by the second low-frequency component removing section included in the encoding device agrees with the low-frequency components removed by the third low frequency component removing section.

5. The encoding device according to claim 3, further comprising:

a signal decimation section configured to decimate the original signal and the frequency component extraction signal; and a signal interpolation section configured to interpolate the decoded signal.

6. The encoding device according to claim 1, wherein the nonlinear process section includes:

an even exponentiation operation section configured to generate an even exponentiation signal by raising the low-frequency-free signal to an even exponent not less than 2; and a sign changing section configured to generate the nonlinear process signal by reversing positive and negative signs of a part of the even exponentiation signal which part is different in sign from the low-frequency-free signal.

7. The encoding device according to claim 1, wherein the nonlinear process section includes:

an even exponentiation operation section configured to generate an even exponentiation signal by raising the low-frequency-free signal to an even exponent not less than 2;

a differentiation section configured to generate a differential signal by differentiating the even exponentiation signal; and a sign changing section configured to generate the nonlinear process signal by reversing positive and negative signs of a part of the differential signal which part is different in sign from the low-frequency-free signal.

8. The encoding device according to claim 1, wherein the nonlinear process section includes an odd exponentiation operation section configured to generate the nonlinear process signal by raising the low-frequency-free signal to an odd exponent not less than 3.

9. The encoding device according to claim 1, wherein the nonlinear processing section includes:

a square root operation section configured to generate a square root signal by multiplying (i) a square root of an absolute value of a value calculated by dividing the low-frequency-free signal by a possible maximum value of the low-frequency-free signal, by (ii) the maximum value; and a sign changing section configured to generate the nonlinear process signal by reversing positive and negative signs of a part of the square root signal which part is different in sign from the low-frequency-free signal.

10. The encoding device according to claim 1, wherein the nonlinear process section further includes an amplitude adjustment section configured to adjust an amplitude of the nonlinear process signal by multiplying the amplitude by a magnification value.

11. The encoding device according to claim 1, wherein when the values of the low-frequency-free signal are around 0, the nonlinear process section generates the nonlinear process signal so that the nonlinear process signal has an absolute value larger than that of the low-frequency-free signal.

12. The encoding device according to claim 1, wherein the low-frequency component removing section is a high-pass filter having 3 or more taps.

13. The encoding device according to claim 1, wherein the low-frequency component removing section further includes:

a low-level signal removing section configured to change, out of signal values of the low-frequency-free signal, signal values whose absolute values are lower than a lower limit to 0, and a high-level signal removing section configured to change, out of the signal values of the low-frequency-free signal, signal values whose absolute values are higher than an upper limit in such a manner that the absolute values are not higher than the upper limit while maintaining signs of that signal values.

14. A transmission system, comprising:

the encoding device as set forth in claim 1 as a transmitting device; and a decoding device as a receiving device, the decoding device being one that generates a decoded signal by receiving, as an input, an encoded signal including a signal in which an original signal is encoded, the original signal being indicative of contents of at least one of image and audio, the contents being constituted of a plurality of frames that are consecutive in terms of time, the encoding of the original signal causing an output of motion vector information for carrying out motion compensation prediction among the frames, the encoded signal including, in each frame, any one of a first signal or a second signal, the first signal being a signal in which the original signal is encoded and the second signal being a signal in which a part of frequency components included in the original signal is encoded, and the decoding device comprising a decoding section configured to generate, as the decoded signal when the first signal is decoded, a signal in which the first signal is decoded, and generating, as the decoded signal when the second signal is decoded, a signal by adding (a) a signal of a decoded signal generated immediately before that has been subjected to motion compensation with use of the motion vector information and (b) a signal in which the second signal is decoded;

the contents being constituted of a plurality of frames that are consecutive in terms of time, the encoding section further configured to (i) makes, for each frame, any one of a first signal and a second signal be included in the encoded signal, the first signal being a signal in which the original signal is encoded and the second signal being a signal in which the frequency component extraction signal is encoded, and (ii) outputs motion vector information for carrying out motion compensation prediction among the frames.

15. A non-transitory computer-readable recording medium in which a control program is recorded, the control program causing a computer included in the encoding device as set forth in claim 1 to operate as section of the encoding device.

16. A method of controlling an encoding device that outputs an encoded signal, the encoded signal including a signal in which an original signal is encoded, the original signal being indicative of contents of at least one of image and audio, the method comprising:

extracting from the original signal a part of frequency components included in the original signal, to generate a frequency component extraction signal;

encoding the frequency component extraction signal and the original signal in such a manner that the encoding is carried out while switching over between the frequency component extraction signal and the original signal; and making the signal thus encoded be included in the encoded signal, wherein the extracting includes, removing a high-frequency component from frequency components of the original signal, to generate a high-frequency-free signal, generating harmonics of the high-frequency-free signal, and subtracting the harmonics of the high-frequency-free signal from the original signal, to generate the frequency component extraction signal, the generating harmonics of the high-frequency-free signal includes, removing, from frequency components of the high-frequency-free signal, a low-frequency component at least including a direct current component, to generate a low-frequency-free signal, generating a nonlinear process signal (i) in which positive and negative signs of the low-frequency-free signal are retained and (ii) which monotonically increases nonlinearly with respect to the low-frequency-free signal when values of the low-frequency-free signal are at least in the vicinity of 0, and adding the nonlinear process signal to the high-frequency-free signal, to generate the harmonics.

* * * * *